US009750291B2

(12) United States Patent
Morag et al.

(10) Patent No.: US 9,750,291 B2
(45) Date of Patent: Sep. 5, 2017

(54) SHIRT, AND OTHER ARTICLES OF CLOTHING

(71) Applicant: Delta Galil Industries Ltd., Karmiel (IL)

(72) Inventors: Erez Morag, Caesarea (IL); Eli Almog, Kfar Saba (IL); Einat Tsanua Peled, Ra'anana (IL); Menny Alon, Tel Aviv (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 207 days.

(21) Appl. No.: 14/639,440

(22) Filed: Mar. 5, 2015

(65) Prior Publication Data

US 2016/0255888 A1 Sep. 8, 2016

(51) Int. Cl.

| | |
|---|---|
| ***A41B 15/00*** | (2006.01) |
| ***A41D 27/10*** | (2006.01) |
| ***A41D 31/00*** | (2006.01) |
| ***A41D 13/00*** | (2006.01) |

(52) U.S. Cl.
CPC ..... *A41D 27/10* (2013.01); *A41D 13/0015* (2013.01); *A41D 31/0005* (2013.01)

(58) Field of Classification Search
CPC ..... A41B 1/08; A41B 2500/10; A41D 27/10
See application file for complete search history.

(56) References Cited

U.S. PATENT DOCUMENTS 2,094,643 A * 10/1937 Fellroth ..... A41D 27/10 2/115
2,664,570 A * 1/1954 Artzt ..... A41D 10/00 2/401
3,037,210 A * 6/1962 Neuman ..... A41D 27/10 2/125
3,137,860 A * 6/1964 Bindler ..... A41D 27/10 2/115
5,052,058 A * 10/1991 Mueller ..... A41B 9/001 2/227
6,279,161 B1 * 8/2001 Johnston ..... A41D 27/08 2/115

(Continued)

FOREIGN PATENT DOCUMENTS

WO 2011076140 A1 6/2011

OTHER PUBLICATIONS

International Search Report for corresponding PCT application PCT/IB2016/051096 dated Jun. 13, 2016.

*Primary Examiner* — Khoa Huynh
*Assistant Examiner* — Timothy K Trieu
(74) *Attorney, Agent, or Firm* — Eitan, Mehulal & Sadot

(57) ABSTRACT

Short-sleeve shirt, long-sleeve shirt, sports shirt, athletic shirt, and other articles of clothing. A shirt includes one or more regions that de-couple the movement of arm-regions of the shirt (or sleeves of the shirt), from movement of the chest-area or trunk-area of the shirt. A sports shirt includes: a right-side short or long sleeve; a left-side short or long sleeve; a front area to cover a chest of a wearer; a back area to cover a back of the wearer; an optional collar; a right-side decoupling region to decouple movement of the right-side sleeve from movement of the front area and the back area; and a left-side decoupling region to decouple movement of the left-side sleeve from movement of the front area and the back area.

12 Claims, 62 Drawing Sheets

(56) References Cited

U.S. PATENT DOCUMENTS

| | | | | |
|---|---|---|---|---|
| 7,937,771 | B2 * | 5/2011 | Mazzarolo | A41D 13/02 2/456 |
| 2005/0273903 | A1 * | 12/2005 | Rudman | A41D 27/28 2/69 |
| 2006/0107437 | A1 * | 5/2006 | Griesbach, III | A41D 13/1209 2/114 |
| 2007/0022510 | A1 * | 2/2007 | Chapuis | A41D 13/0015 2/69 |
| 2009/0025115 | A1 * | 1/2009 | Duffy | A41D 13/0015 2/69 |
| 2014/0090146 | A1 | 4/2014 | Yeomans et al. | |
| 2014/0201883 | A1 * | 7/2014 | Achtymichuk | A41D 27/10 2/69 |

* cited by examiner

SHIRT, AND OTHER ARTICLES OF CLOTHING

FIELD OF THE INVENTION

The present invention relates to the field of articles of clothing.

BACKGROUND

A shirt is an upper-body garment or article of clothing. A shirt worn by a person, for example, may keep a person's upper body warm, may protect the upper body from sun or rain or environmental conditions, may collect sweat emitted by the body, may cover private parts (e.g., breast) of a person, or may be used for various other purposes (e.g., as a fashion garment, or to comply with a dress-code of an organization or a profession).

Various types of shirts are worn on a daily basis, by billions of people worldwide. Such shirts may include, for example, a T-shirt, a Polo shirt having a soft collar, a dress shirt having a stiff or semi-stiff collar, a long-sleeve shirt, a short-sleeve shirt, a sleeveless shirt, a pajama shirt worn for sleeping, or the like.

Some shirts may be made of natural fiber, for example, cotton, linen, silk, wool, or the like. Other shirts may be made of man-made fiber or synthetic fiber, for example, polyester, viscose, nylon, Lycra, Spandex, elastane, or the like. Some shirts may be made of a combination of natural fiber and synthetic fiber, for example, cotton and polyester.

SUMMARY

The present invention may comprise, for example, a shirt and other garments or articles of clothing; as well as methods and systems for producing such shirts and garments.

The present invention may comprise a shirt having one or more regions that de-couple the movement of arm-regions of the shirt (or sleeves of the shirt), from movement of the chest-area or trunk-area of the shirt.

In some embodiments of the present invention, a shirt may comprise, for example: a right-side sleeve (which may be a long sleeve or a short sleeve); a left-side sleeve (which may be a long sleeve or a short sleeve); a front area to cover a chest of a wearer; a back area to cover a back of the wearer; a right-side decoupling region to decouple movement of the right-side sleeve from movement of the front area and the back area; and a left-side decoupling region to decouple movement of the left-side sleeve from movement of the front area and the back area.

The present invention may provide other and/or additional benefits or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION OF THE INVENTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or modules have not been described in detail so as not to obscure the discussion.

The present invention may comprise an improved shirt, particularly a sport shirt or "performance shirt", which may be implemented as a tight-fit shirt or as a loose-fit shirt. The shirt of the present invention may be a De-Coupled Performance Shirt (DCPS), such that the arms (or sleeves) of the shirt are de-coupled from the chest-area or torso-area of the shirt. For example, motion or movement in a first region of the shirt (e.g., the arm region), may be decoupled from, and may not affect, one or more other region(s) of the shirt (e.g., the chest area, the torso area, the shoulder area, the armpit area).

Applicants have realized that in a conventional sports shirt, motion of the arms of the wearer (and motion of the sleeves of the shirt) during a sport activity (e.g., running, walking, soccer, basketball, football, tennis, golf, or the like) is coupled with (or to) the movement of the center portion of the shirt. Applicants have realized that, for example, movement of the arms while running or while shooting a basketball, may cause an undesired movement of the shirt area(s) that cover the torso or the chest or the belly of the wearer. Applicants have realized that the undesired motion-coupling may negatively affect the performance of the shirt, or may otherwise adversely affect the wearer, or may cause inconvenience to the wearer.

Figure 1B:
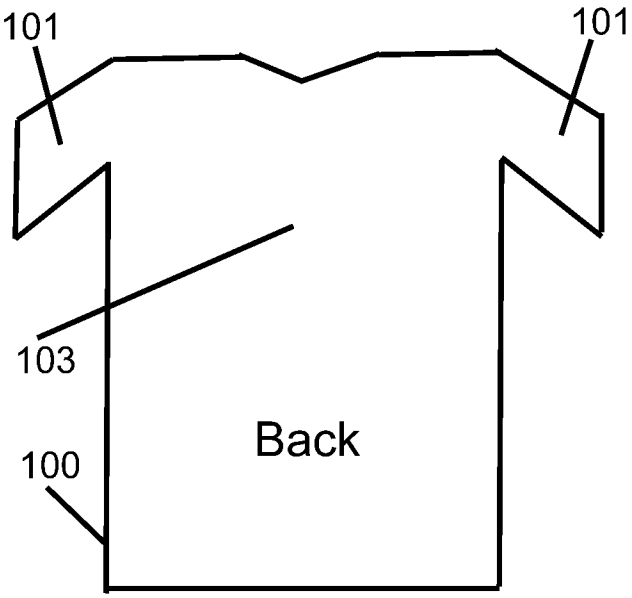
Fig. 1B (Prior Art)
FIG. 1B is a schematic illustration of a back side of prior art shirt.
Figure 1A:
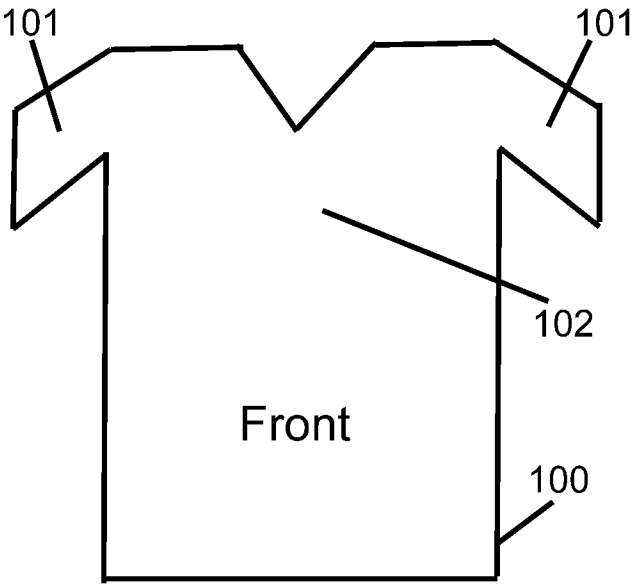
Fig. 1A (Prior Art)
FIG. 1A is a schematic illustration of a front side of a prior art shirt.

Reference is made to FIG. 1A, which is a schematic illustration of a front side of a prior art shirt 100; and to FIG. 1B, which is a schematic illustration of a back side of prior art shirt 100. Prior art shirt 100 may be a tight-fitting shirt or a loose-fitting shirt.

Applicants have realized that, for example, when prior art shirt 100 is implemented as a tight-fitting shirt, back-and-forth motion of the arms (e.g., region 101 of shirt 100) may create an increased resistance (and/or a coupled motion, or a derived motion, or a secondary motion) at the torso area or chest area (e.g., region 102 of the front side of shirt 100; and/or region 103 of the back side of shirt 100). Such increased resistance may be undesired, and may require greater effort to move the arms, and/or may require greater effort of the lungs of the wearer due to increased resistance while the volume of the lungs increases.

Applicants have further realized that, for example, when prior art shirt 100 is implemented as a loose-fitting shirt, motion of the arms or sleeves (region 101) may pull or may undesirably move one or more central regions of shirt 100, e.g., region 102 of the front side of shirt 100 and/or region 103 of the back side of shirt 100. Additionally or alternatively, lateral movement of regions 102 and/or 103 may cause friction at or around the chest area and/or the nipples area; and such friction as well as chaffing may trigger complaints among users, particularly runners who wear such prior art shirt 100.

Applicants have realized that it may be beneficial to provide a shirt in which one or more regions or areas or zones (e.g., sleeve area or arms area) are decoupled from one or more other regions (e.g., chest or torso area). In accordance with the present invention, a decoupled performance shirt or sports shirt may be provided, such that movement or motion in a first region, may minimize (or may reduce, or may avoid creating) a derivative motion or a secondary motion or friction or chaffing or increased resistance at a second region of the shirt. In accordance with the present invention, movement or motion in a first region of the shirt, may be decoupled from movement or motion of other region(s) of the shirt, which may maintain their non-moving state, or may be subject to no movement or to reduced amount of movement (e.g., compared with a conventional shirt).

The present invention may provide de-coupling between (a) the function or motion of the sleeve, and (b) the function or motion of the central region of the shirt. This may eliminate or reduce the effect of arm motion on the rest of the shirt in the primary direction of the motion.

The improved shirt(s) of the present invention, for example, may provide various benefits and advantages to users or wearers, particularly when the user engages in sports activity; may increase the comfort level or the convenience level; may eliminate or reduce undesired motion-coupling among various regions of the shirt; may eliminate or reduce undesired resistance or friction at one or more regions of the shirt; may eliminate or reduce pressure or resistance or friction on the lungs or chest or nipples of the wearer; and/or may provide other benefits to the wearer.

Figure 2A:
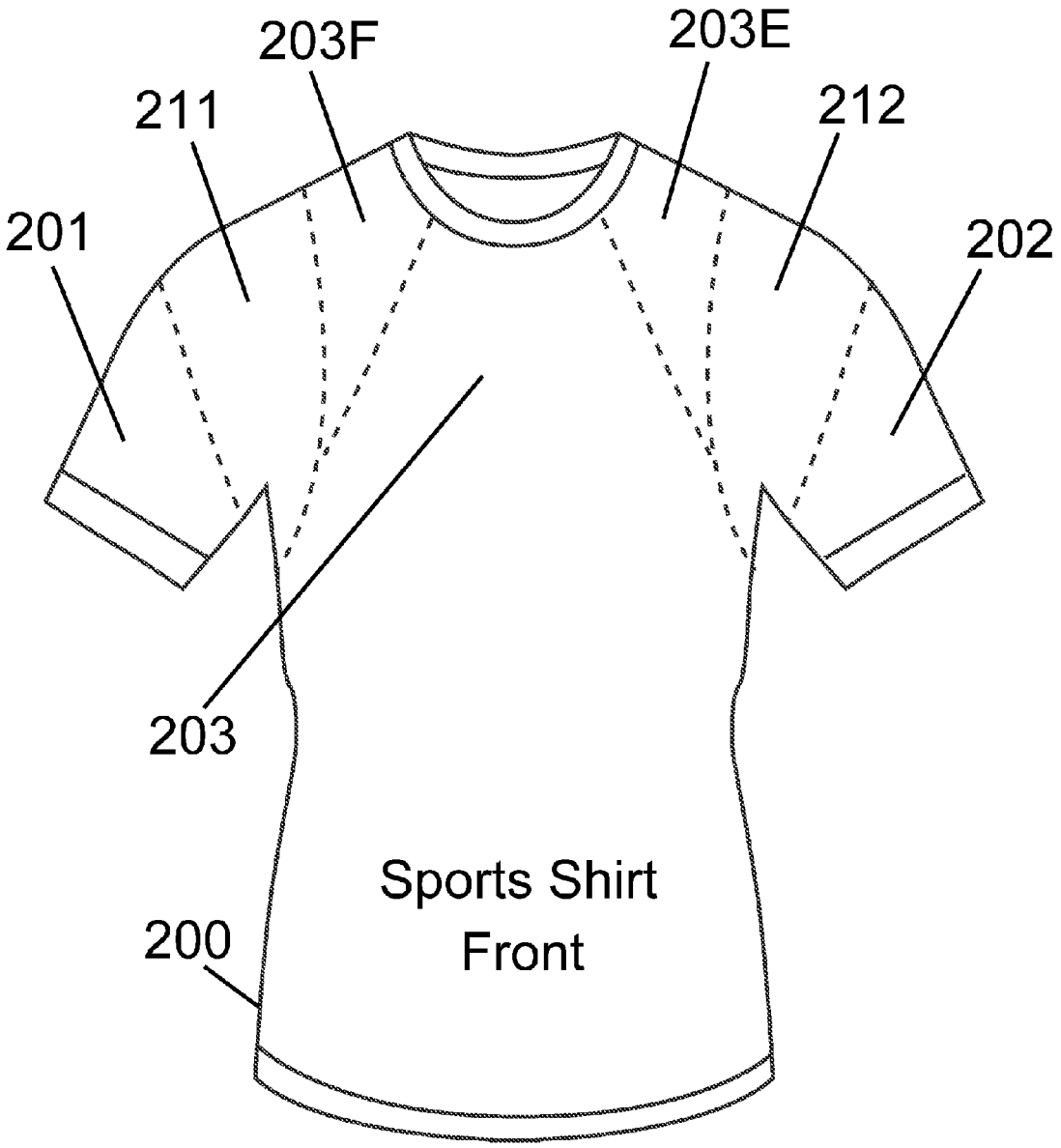
FIG. 2A is a schematic illustration of a front side of a shirt in accordance with some demonstrative embodiments of the present invention.
Figure 2B:
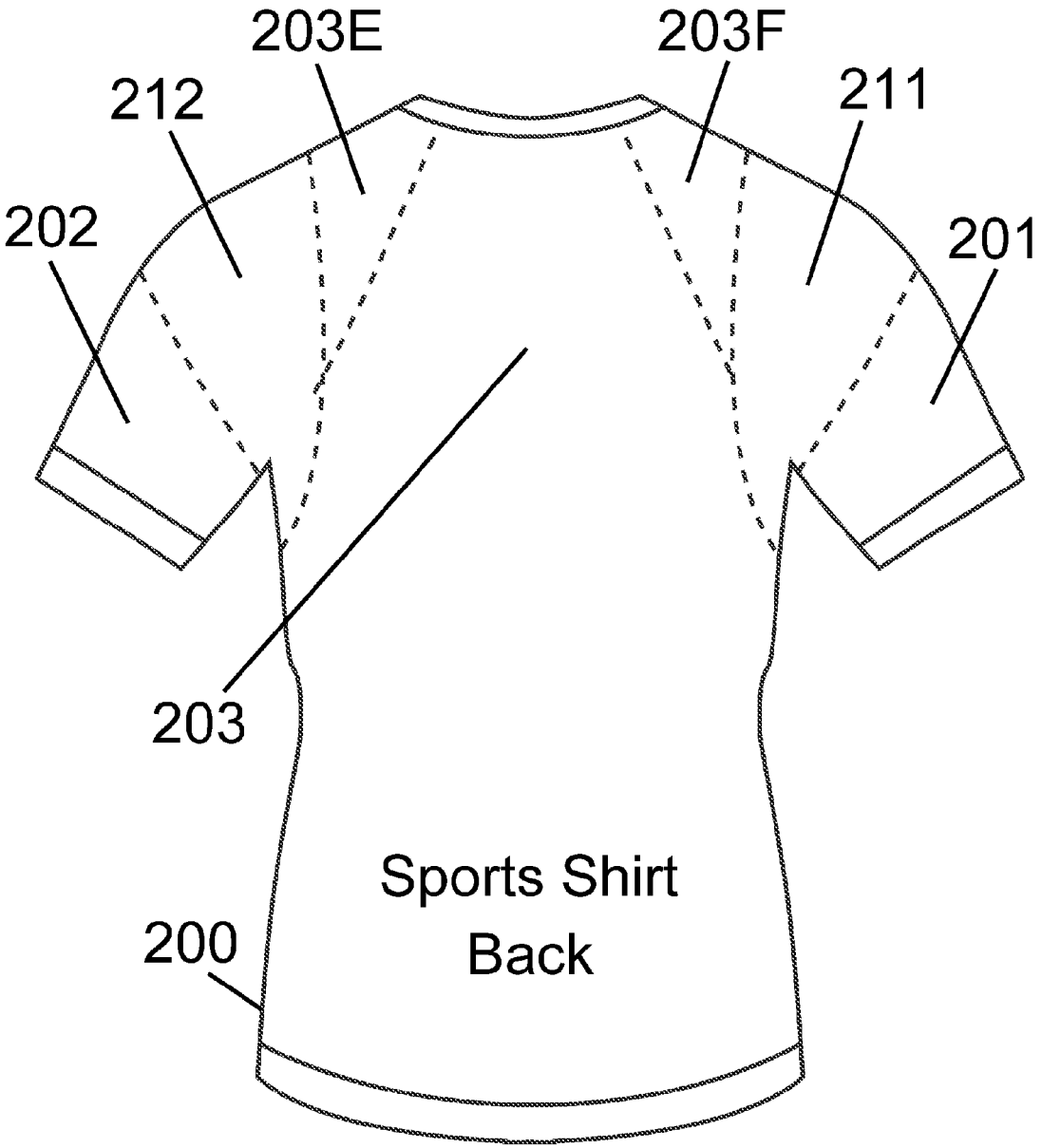
FIG. 2B is a schematic illustration of a back side of the shirt of FIG. 2A.

Reference is made to FIG. 2A, which is a schematic illustration of a front side of a shirt 200 in accordance with some demonstrative embodiments of the present invention; as well as to FIG. 2B, which is a schematic illustration of a back side of shirt 200.

Shirt 200 may comprise, for example, a right sleeve 201 and a left sleeve 202; as well as a torso region 203. Right sleeve 201 and left sleeve 202 may not be directly connected to torso region 203. Rather, right sleeve 201 may be connected or attached to an intermediary right-shoulder region 211, which in turn may be connected or attached to torso region 203. Similarly, left sleeve 202 may be connected or attached to an intermediary left-shoulder region 212, which in turn may be connected or attached to torso region 203. It is noted that the areas denoted as 203E and 203F are part of the torso region 203, or may be attached or connected to the torso region 203 via hems or seams; and that areas 203E and 203F are not part of the decoupling elements which are comprised of intermediary right-shoulder region 211 and intermediary left-shoulder region 212, respectively.

The connection or attachment between right sleeve 201 and intermediary right-shoulder region 211 may be performed by one or more suitable methods, for example, sewing, knitting, gluing, bonding, heat-and-press process, ultrasonic fusion process, or the like. The connection or attachment between left sleeve 202 and intermediary left-shoulder region 212 may be generally similar; the connection or attachment between intermediary left-shoulder region 212 and torso region 203 may be generally similar; the connection or attachment between intermediary right-shoulder region 211 and torso region 203 may be generally similar.

Figure 2C:
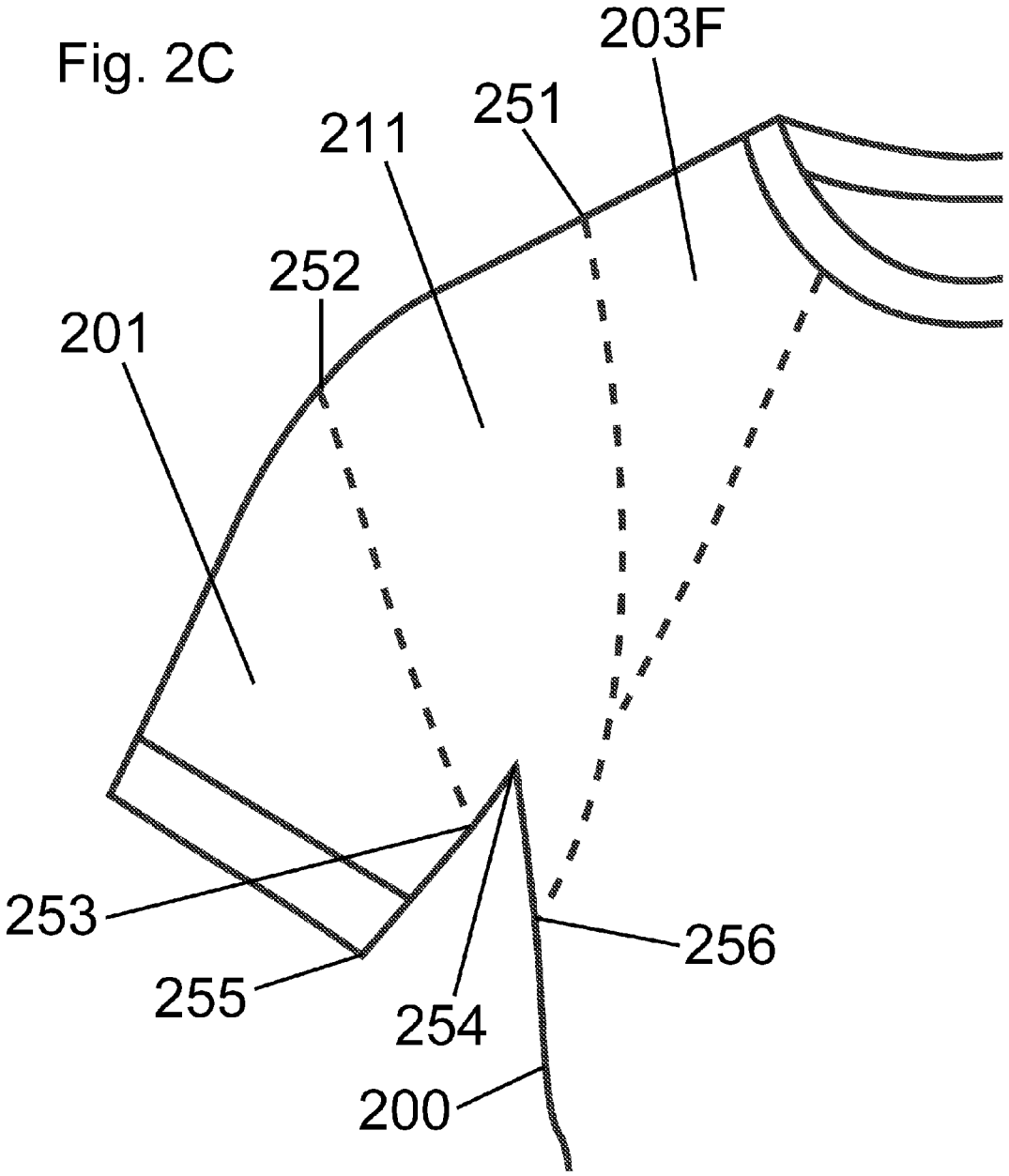
FIG. 2C is an enlarged view of a portion of the front side of the shirt of FIG. 2A.

Reference is made to FIG. 2C, which is an enlarged view (or zoomed-in view) of a portion of the front side of shirt 200 of FIG. 2A. Intermediary right-shoulder region 211 may have a structure defined by points 251-256, as follows: (A) a curved top edge defined between point 251 and point 252, such that point 251 is between the neck and the shoulder-arm connection, and such that point 252 is between the shoulder-arm connection and the top portion of the arm (e.g., slightly below the shoulder-arm connection), or such that point 252 is located within the top-third or the top-quarter of right sleeve 201; (B) a generally-straight line or edge connecting point 252 to point 253, such that point 253 is located at the bottom side of right sleeve 201, and is located at the top-third or top-quarter of the bottom side of right sleeve 201, or such that point 253 is located between point 254 that is located under the right armpit and point 255 that is the lowest point of right sleeve 201, and such that point 253 is closer to point 254 than to point 255; (C) a generally-straight line connecting point 253 and point 254; (D) a generally-straight line connecting point 254 downwardly to point 256 which is located along the right-side contour or edge of shirt 200, and such that the distance between points 254 and 256 is generally similar to (or is 1.5 or 2.0 or 2.5 times relative to; or is equal-or-greater than) the distance between points 253 and 254; (E) a generally-straight line, or a curved or concave or convex line, connecting point 256 to point 251. Intermediary left-shoulder region 212 may have a similar structure, but may be horizontally flipped or mirrored relative to the structure of intermediary right-shoulder region 211.

Figure 2D:
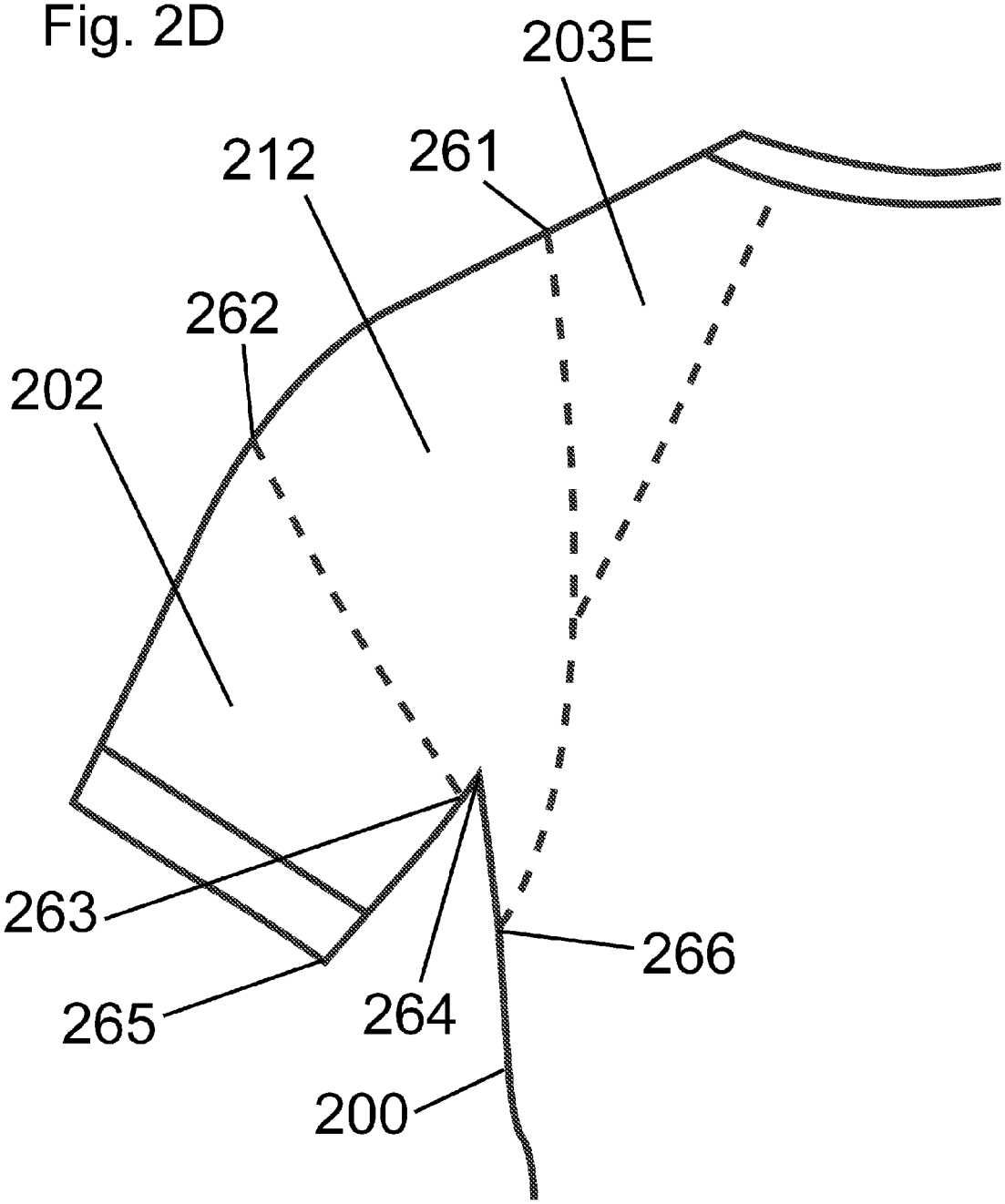
FIG. 2D is an enlarged view of a portion of the back side of the shirt of FIG. 2B.
Figure 3A:
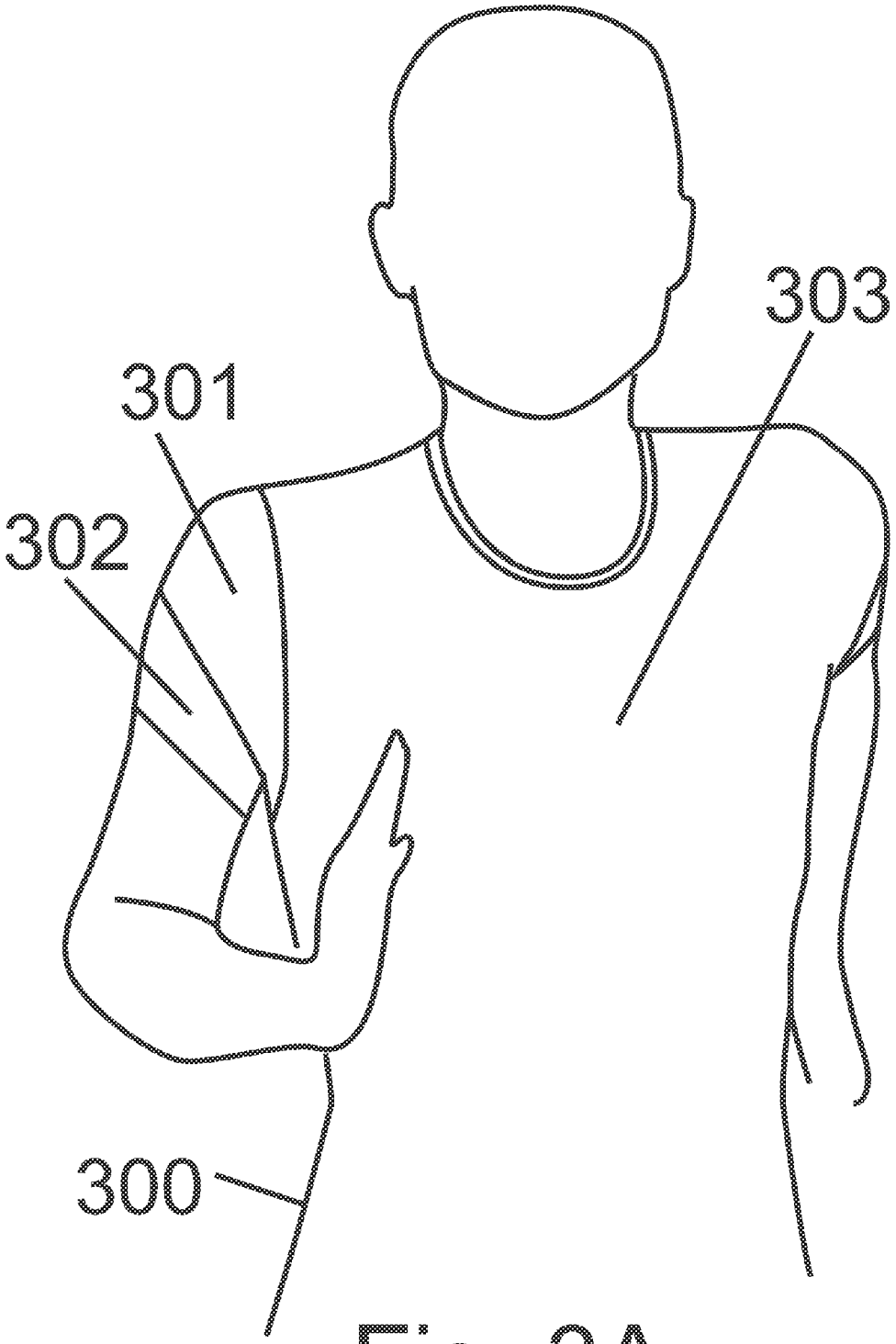
FIGS. 3A-3C, FIGS. 4A-4C, and FIGS. 5A-5C are schematic illustrations of a running shirt in accordance with some demonstrative embodiments of the present invention.
Figure 3B:
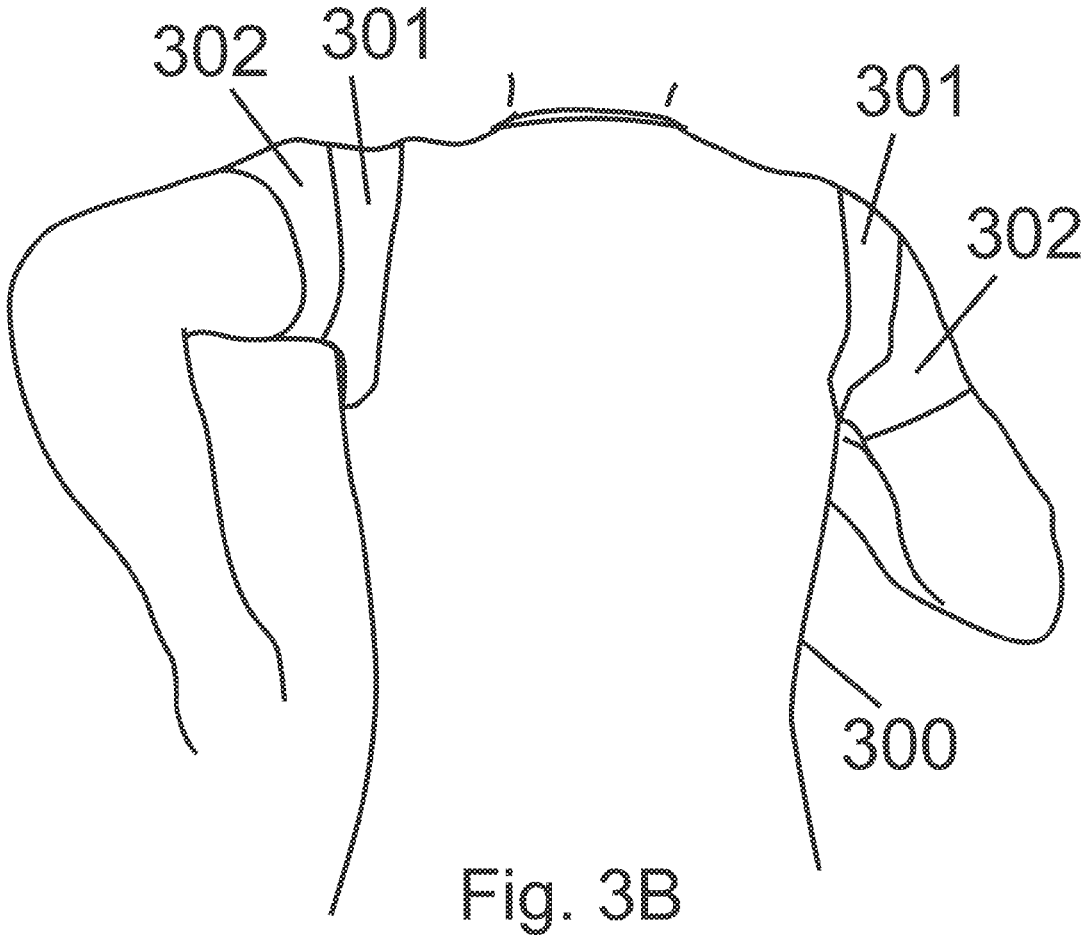
Figure 3C:
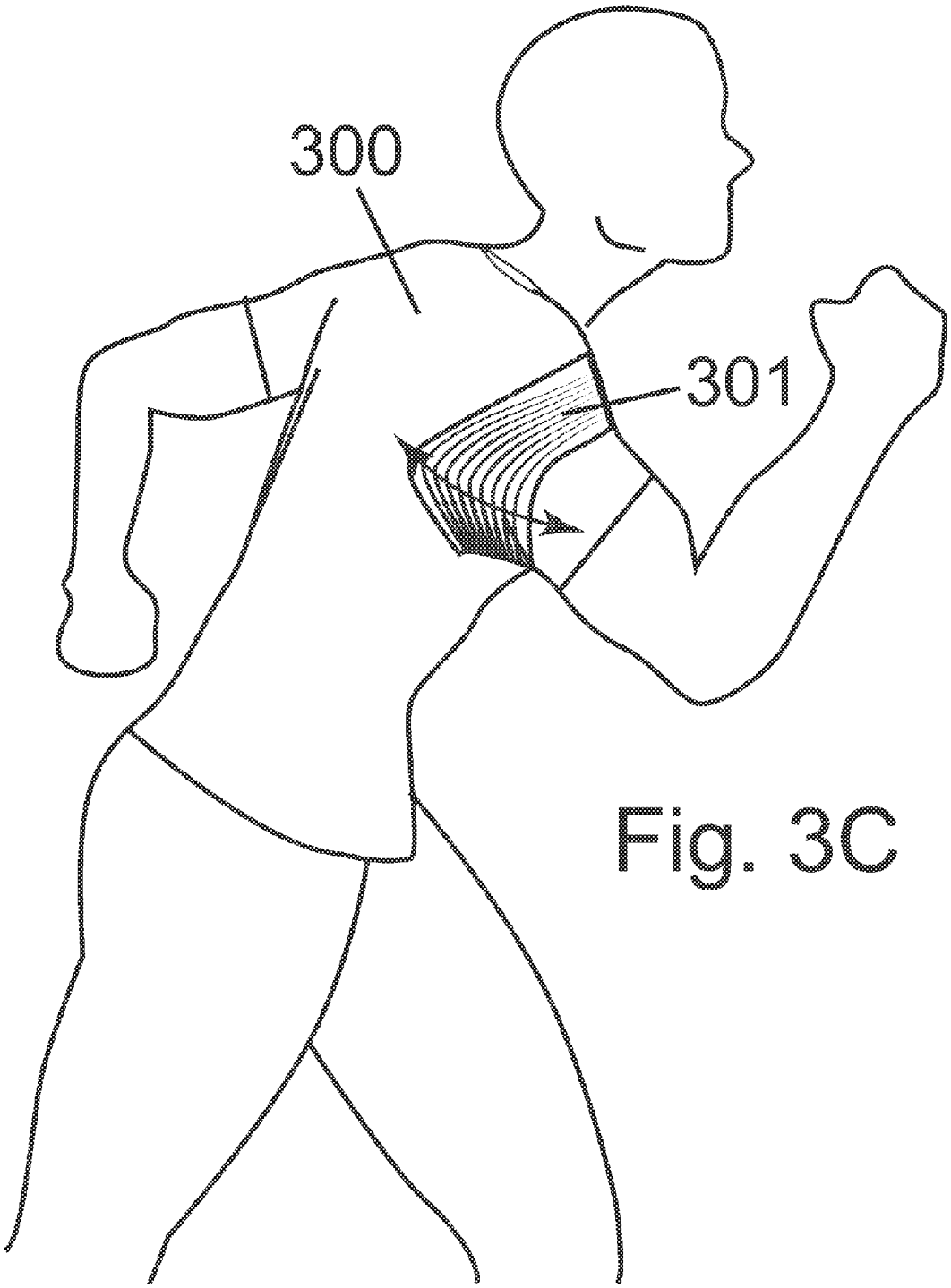
Figure 4A:
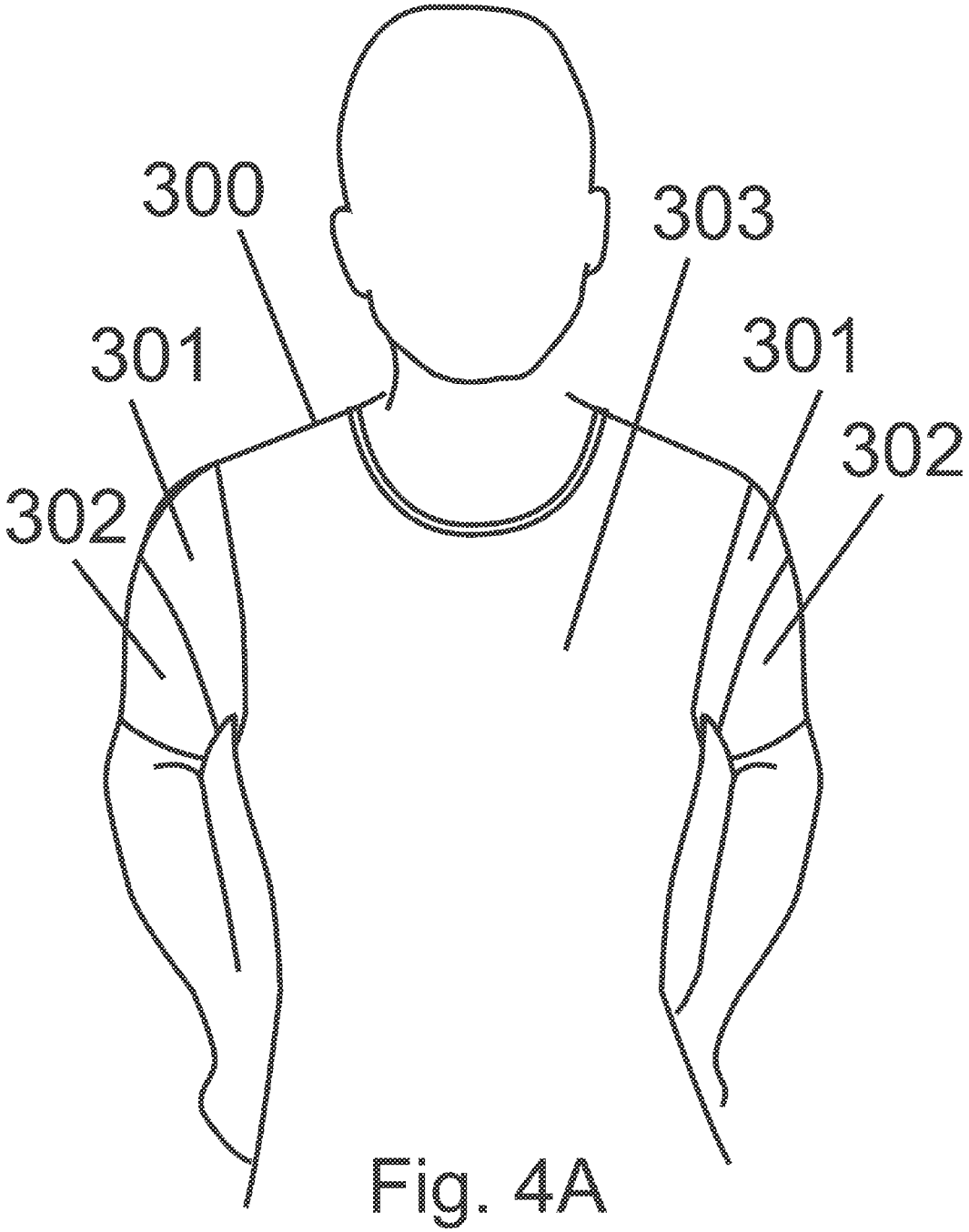
Figure 4B:
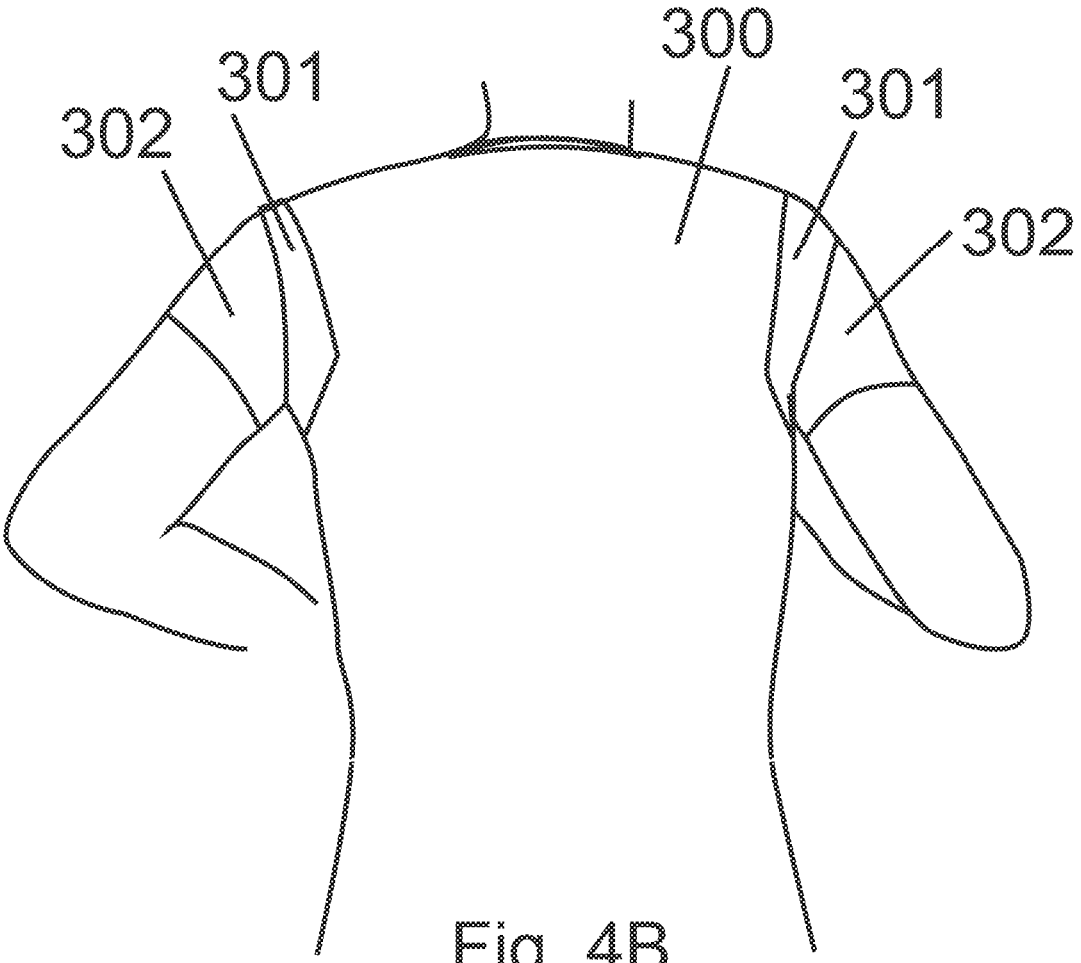
Figure 4C:
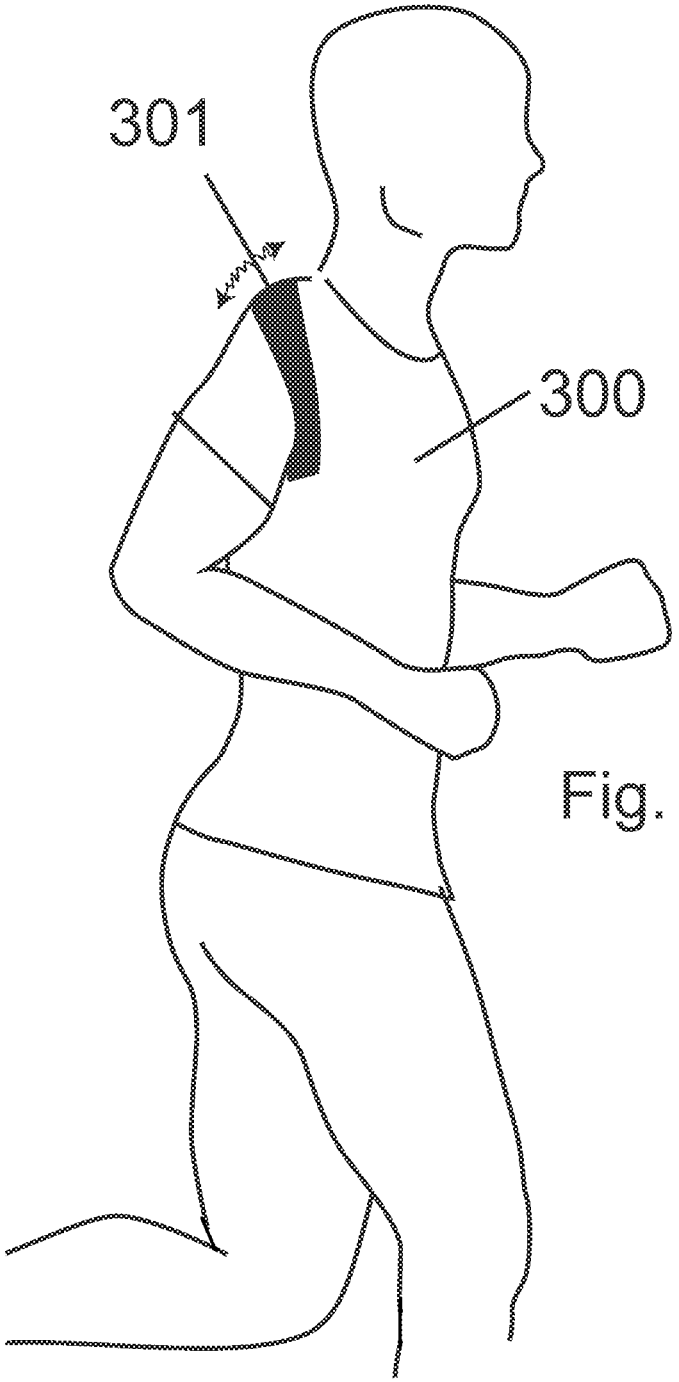
Figure 5A:
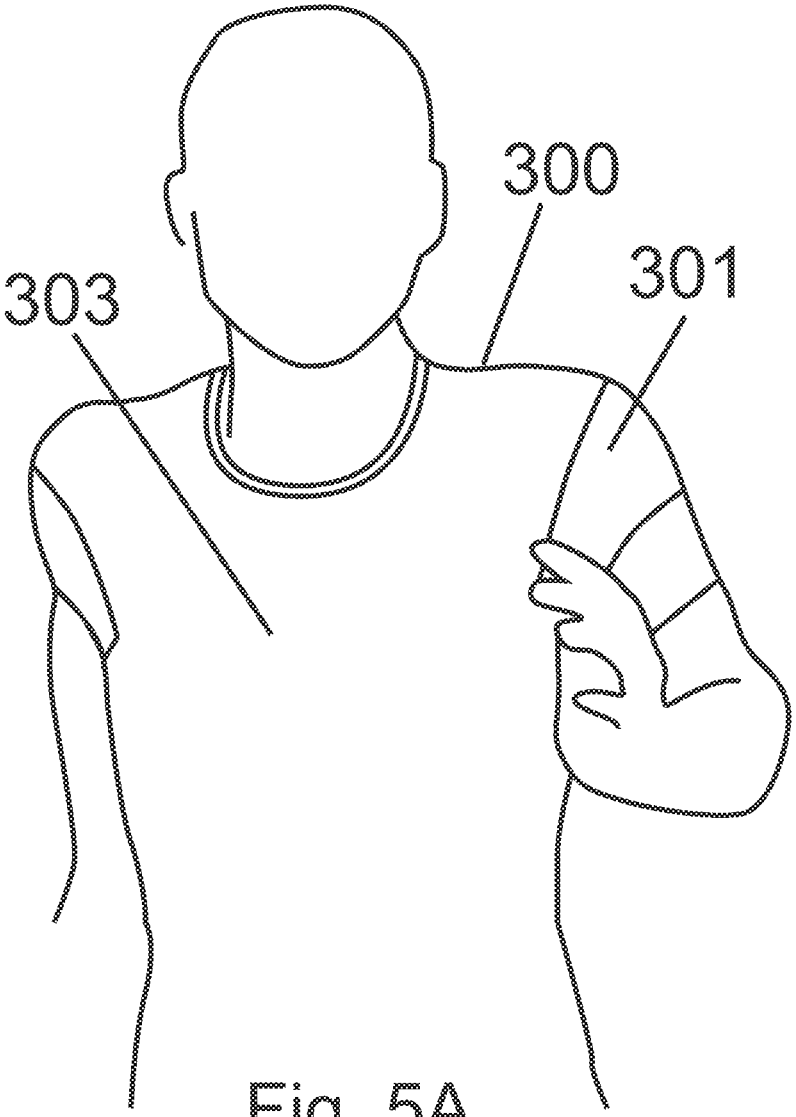
Figure 5B:
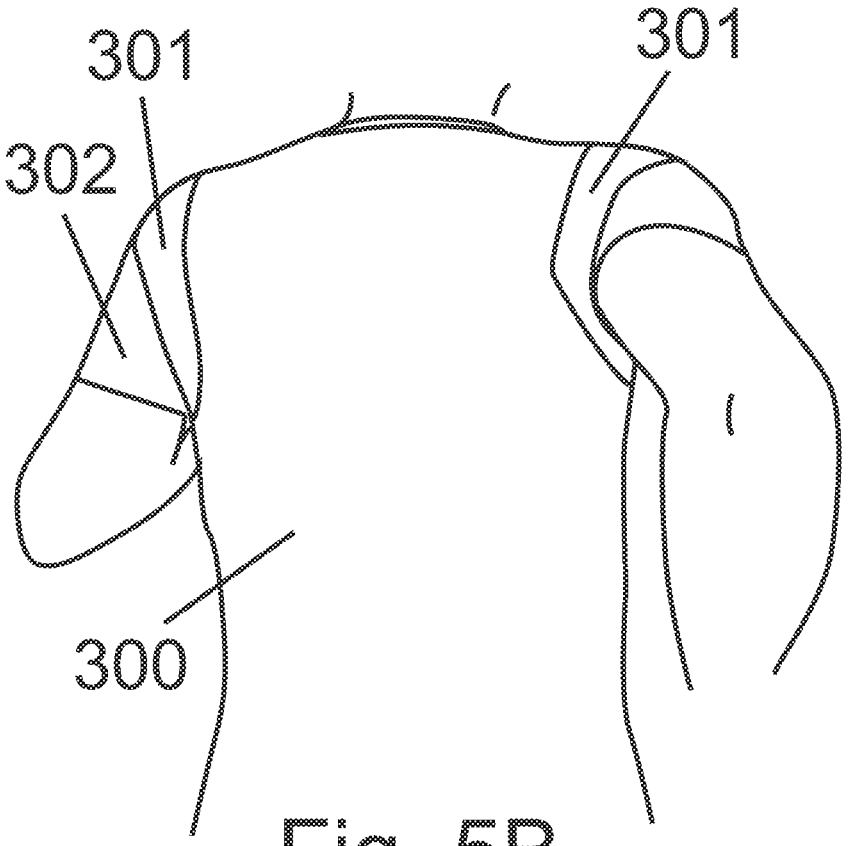
Figure 5C:
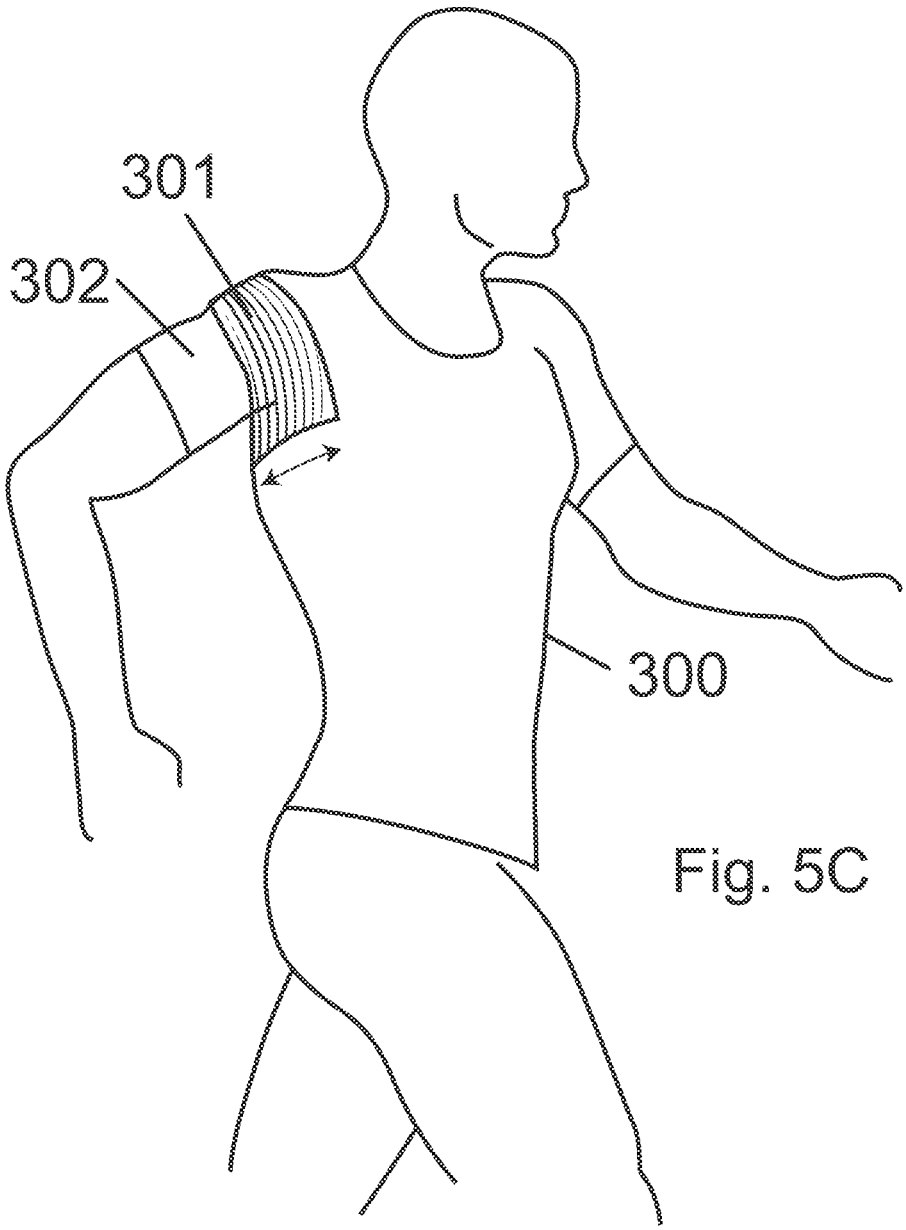

Reference is made to FIG. 2D, which is an enlarged view (or zoomed-in view) of a portion of the back side of shirt 200 of FIG. 2B. Intermediary left-shoulder region 212 may have a structure defined by points 261-266, as follows: (A) a curved top edge defined between point 261 and point 262, such that point 251 is between the neck and the shoulder-arm connection, and such that point 262 is between the shoulder-arm connection and the top portion of the arm (e.g., slightly below the shoulder-arm connection), or such that point 262 is located within the top-third or the top-quarter of left sleeve 202; (B) a generally-straight line or edge connecting point 262 to point 263, such that point 263 is located at the bottom side of left sleeve 202, and is located at the top-third or top-quarter of the bottom side of left sleeve 202, or such that point 263 is located between point 264 that is located under the left armpit and point 265 that is the lowest point of left sleeve 202, and such that point 263 is closer to point 264 than to point 265; (C) a generally-straight line connecting point 263 and point 264; (D) a generally-straight line connecting point 264 downwardly to point 266 which is located along the left-side contour or edge of shirt 200, and such that the distance between points 264 and 266 is generally similar to (or is 1.5 or 2.0 or 2.5 times relative to; or is equal-or-greater than) the distance between points 264 and 265; (E) a generally-straight line, or a curved or concave or convex line, connecting point 266 to point 261. Intermediary right-shoulder region 211 may have a similar structure, but may be horizontally flipped or mirrored relative to the structure of intermediary left-shoulder region 212.

Reference is made to FIGS. 3A-3C, FIGS. 4A-4C, and FIGS. 5A-5C, which are schematic illustrations of a shirt 300 in accordance with some demonstrative embodiments of the present invention. Shirt 300 may be a sports shirt or a running shirt, or a shirt specifically adapted or structured to accommodate runners. Shirt 300 may enable improved or easier or more efficient motion of the wearer during running, or during flexion and extension at the shoulders, or during back-and-forth movement of the arms. Particularly, intermediary-region 301 may be implemented in an "accordion-style" of fabric and/or knitting, thereby decoupling or disconnecting the movement of arm regions 302 from movement of chest region 303; and thereby allowing the arm regions 302 to move more freely, in a manner that does not cause at all (or causes very little, or reduced) motion or movement of the chest region 303.

In some embodiments of the present invention, shirt 300 may be a running shirt implemented as a tight shirt, and may have the following characteristics during running. Starting from an arm forward position (as demonstrated in FIGS. 3A-3C), the right arm is flexed at the shoulder joint (in a forward position with respect to the trunk or chest), whereas the left upper arm extends at the shoulder joint (backward position with respect to the trunk or chest). Then (as demonstrated in FIGS. 4A-4C), the right arm starts to extend at the shoulder joint (moving backwards) and reaches a neutral position; the fabric at intermediary-region 301 stretches and starts to open. Then (as demonstrated in FIGS. 5A-5C), the right arm is fully extended at the shoulder joint (backward position with respect to the trunk or chest), and intermediary-region 301 is fully open (fully stretched, or maximally stretched). Hence, the center portion of shirt 300 (for example, chest region 303) stays put and does not move (at all, or only moves very slightly), being decoupled from the movement of the arms; and furthermore, resistance at the intermediary-region 301 is reduced or minimized, and breathing is easier for the wearer (e.g., the runner).

In some embodiments of the present invention, shirt 300 may be a running shirt implemented as a tight shirt, and may have the following characteristics during running. Starting from an arm forward position (FIGS. 3A-3C), the right arm is flexed at the shoulder joint (in a forward position with respect to the trunk or chest), whereas the left upper arm extends at the shoulder joint (backward position with respect to the trunk or chest). As demonstrated in FIGS. 4A-4C, the right arm starts to extend at the shoulder joint (moving backwards) and reaches a neutral position. The fabric at the intermediary-region 301 stretches, and the intermediary-region 301 window starts to open. As demonstrated in FIGS. 5A-5C, the right arm is fully extended at the shoulder joint (backward poison with respect to the trunk or chest) and the intermediary-region 301 is fully open. Hence, the center portion of the shirt (for example, chest region 303) stays put and does not move (at all, or only moves very slightly), being decoupled from the movement of the arms; and furthermore, resistance at the intermediary-region 301 is reduced, and breathing is easier for the wearer (e.g., the runner; as lateral movement and/or chafing of the center portion of shirt 300 is reduced or minimized.

The intermediary-region 301 may be formed of fabric that may be knitted as shear and opaque. The opaque area may comprise two yarns: (a) a primary yarn which may be a high-count yarn having smaller (or reduced) elasticity, and (b) a secondary yarn which may be a finer (lower-count) yarn having greater (or increased) elasticity. In some embodiments, the high elasticity property of the secondary yarn may be achieved, for example, by utilizing covered spandex yarn, or other high-elasticity textile fiber(s). The primary and secondary yarns might be from any existing material, like Polyester, Nylon, Cotton, Spandex, Acrylic, Viscose, Modal, Tencel, Polypropylene, metallic, Wool, Silk, Milk, or any combination of blended fibers or yarns. The yarns might incorporated with any other ingredients, or treatments.

The shear and opaque combination may be achieved by one or more suitable production methods. For example, some embodiments may utilize an advanced 360-degree 3D seamless knitting technology. The knitting machine may be a circular single jersey or double jersey knitting machine, or a flat knitting machine. In the opaque area, the knitting machine may perform knitting by plated technique, knitting together both the primary (reduced-elasticity) yarn and the secondary (high-elasticity) yarn. The opaque area may be knitted by using a suitable knitting technique, for example, Jersey or double Jersey or Pique or Rib or Mesh knitting technique(s), or other suitable knitting technique(s). In the shear area, the seamless knitting machine may be dropping out the primary (reduced-elasticity) yarn and may be knitting only the secondary (high-elasticity) yarn. This process may be repeated for several rows of alternative opaque and shear, in equal widths and/or by utilizing differential widths (e.g., different variegated widths). In some implementations, the knitting machine may create sheer and opaque area, as columns and/or as rows. In accordance with the present invention, the knitting machine may thus create an "accordion" effect, selectively and only at the desired decoupling region or decoupling component; such that the fabric stretches and then rebounds back to its original length (or almost to its original length) in the same rows and/or columns. In other embodiments, the accordion-like effect of the decoupling-region or the intermediary-region may be obtained by other suitable production techniques, for example, sewing, bonding, stitching, hemming, printing, ultrasonic fusion, ultrasonic cutting, and/or other connecting or attaching techniques that may be suitable for attaching two or more textile materials, fabrics, shirt regions, or fabric structures. A suitable elasticity level me be used, from a wide possibility of elasticity values, ranging from zero to virtually infinity.

In some embodiments, the intermediary-region (301) construction may contain (or may consist of) only an accordion structure all over (e.g., exclusively), whereas both sides (e.g., right side and left side) of the accordion structure may be connected to the other garment component, by sewing and/or bonding and/or ultrasonic connection or other methods (e.g., attachment, gluing, stitching, using a seam or hem, or otherwise connecting). In other embodiments, the intermediary-region construction may contain in addition to the accordion structure also other knitted structure(s), for example, single jersey, and/or pique, and/or rib, and/or Jaquard, and/or mesh, and/or holes, and/or stripes, and/or lace knitting, and/or other suitable knitted structure. Such knitted structure(s) may be knitted at only one side of the accordion structure, or only at the left side thereof, or only at the right side thereof, or a both right and left sides of the accordion structure; and/or may be knitted within or in the center of or in the middle of the accordion structure, for one repetition or for multiple repetitions, or in any other mixed order. Each one of the above structures may thus provide different technical functions and/or visual characteristics, and may be knitted with different material and/or yarns, different colors, different density, different dimensions, and/or different other characteristics.

Figure 6A:
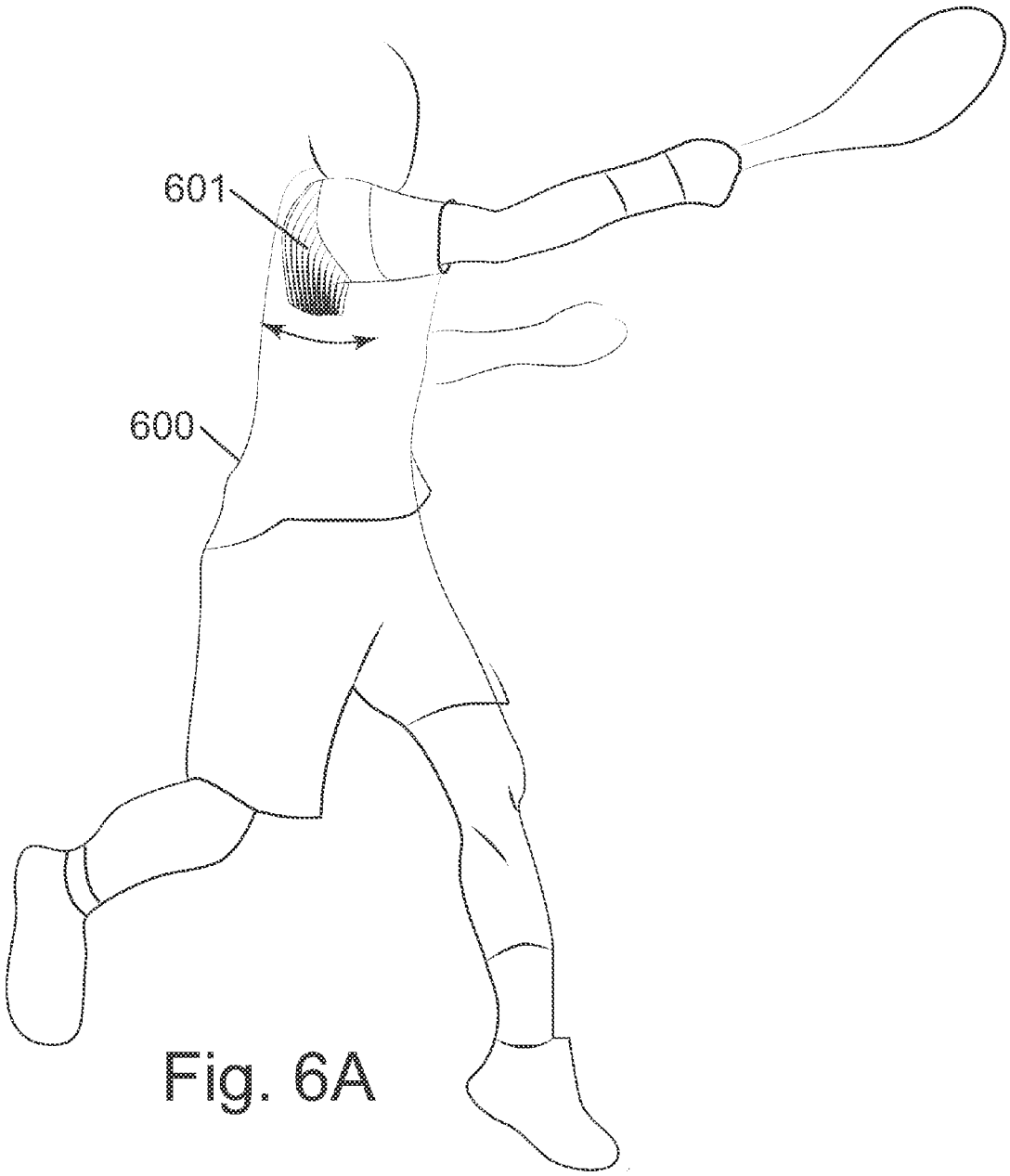
FIGS. 6A-6B are schematic illustrations of a tennis shirt, in accordance with some demonstrative embodiments of the present invention.
Figure 6B:
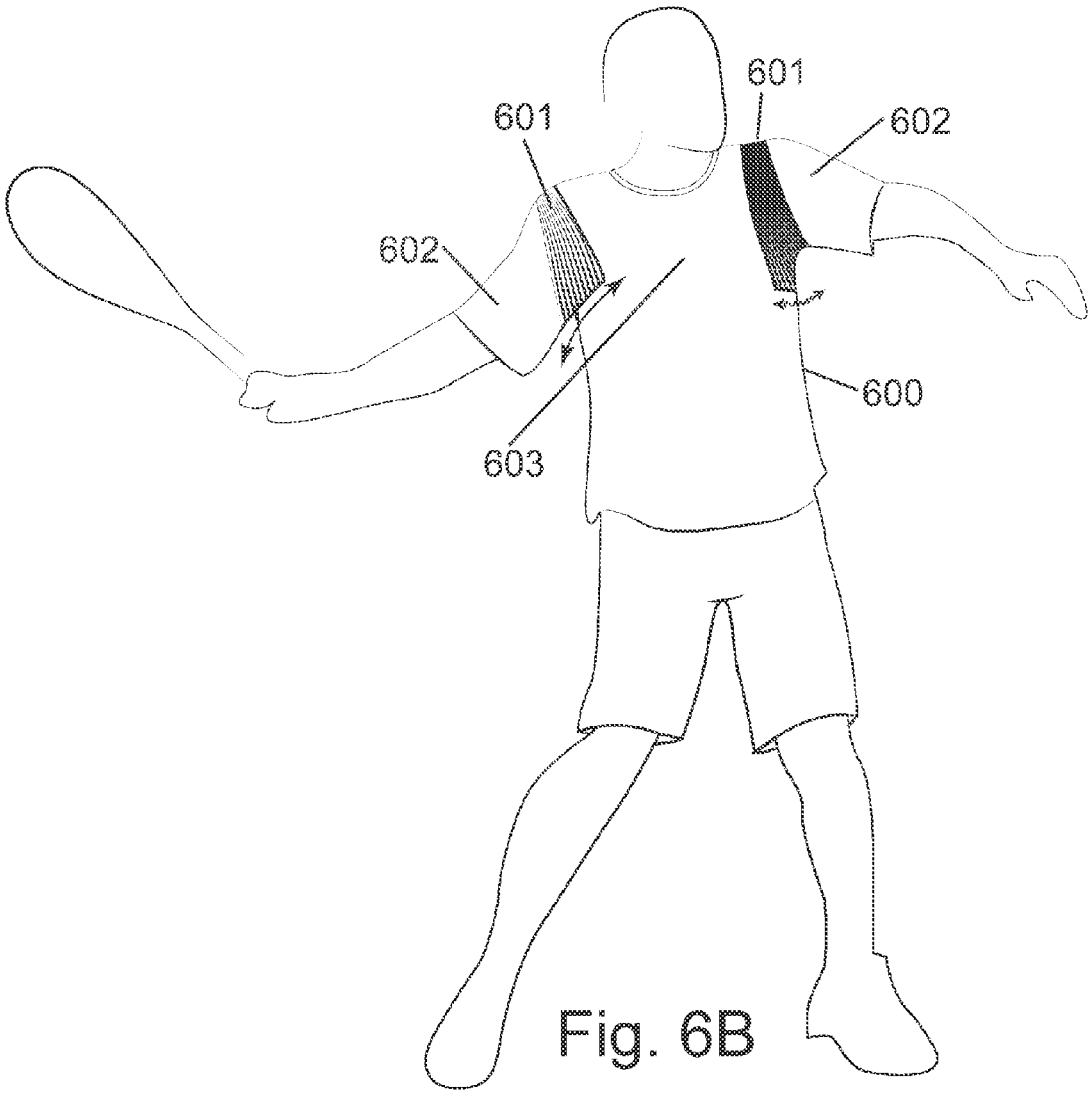
Figure 6C:
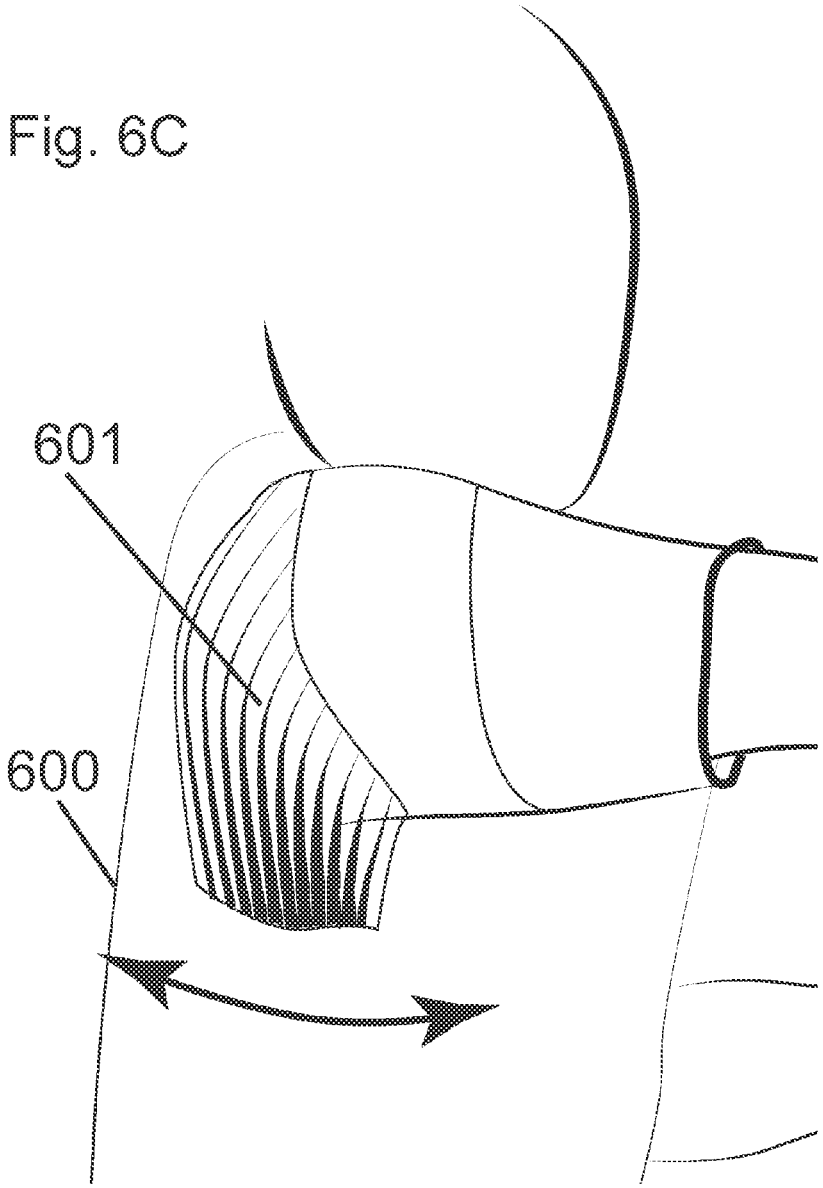
FIGS. 6C-6D are enlarged views of a portion of the shirt of FIGS. 6A-6B.
Figure 6D:
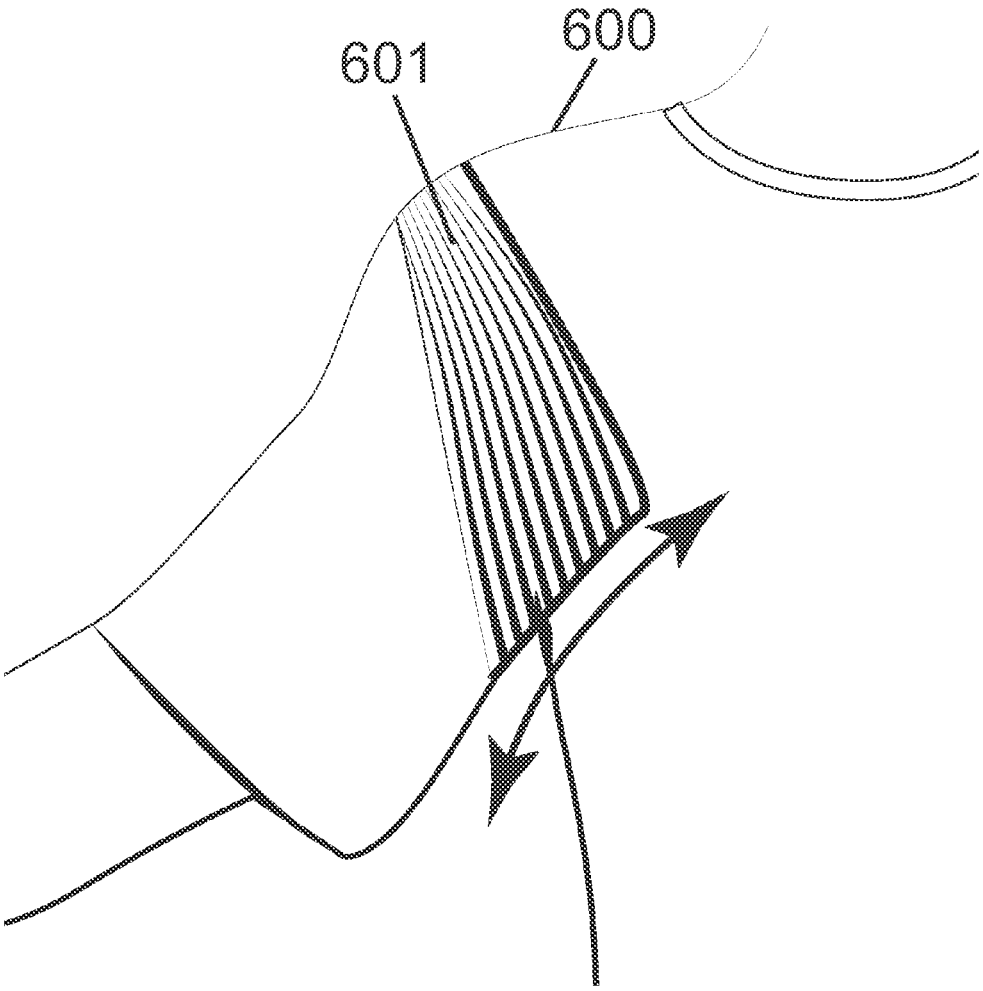

Reference is made to FIGS. 6A-6B, which are schematic illustrations of a shirt 600 in accordance with some demonstrative embodiments of the present invention; as well as to FIGS. 6C-6D, which are enlarged views (or zoomed-in views) of a portion of shirt 600. Shirt 600 may be a sports shirt, or a shirt specifically adapted or structured to accommodate persons that play certain sports (e.g., tennis, squash, racquetball, table tennis, ping pong, baseball, badminton, racquet sports, bat sports, sports that require a stick or bat or racquet or similar equipment, or the like). Shirt 600 may enable improved or easier or more efficient motion of the wearer during such sports, particularly improved or easier or more efficient motion during extension and abduction at the shoulders (e.g., as the wearer prepares for a stroke or performs a stroke with a racquet). Particularly, intermediary-region 601 may be implemented in an "accordion-style" of fabric and/or knitting, thereby decoupling or disconnecting the movement of arm regions 602 from movement of chest region 603; and thereby allowing the arm regions 602 to move more freely, in a manner that does not cause at all (or causes very little, or reduced) motion or movement of the chest region 603.

Figure 7A:
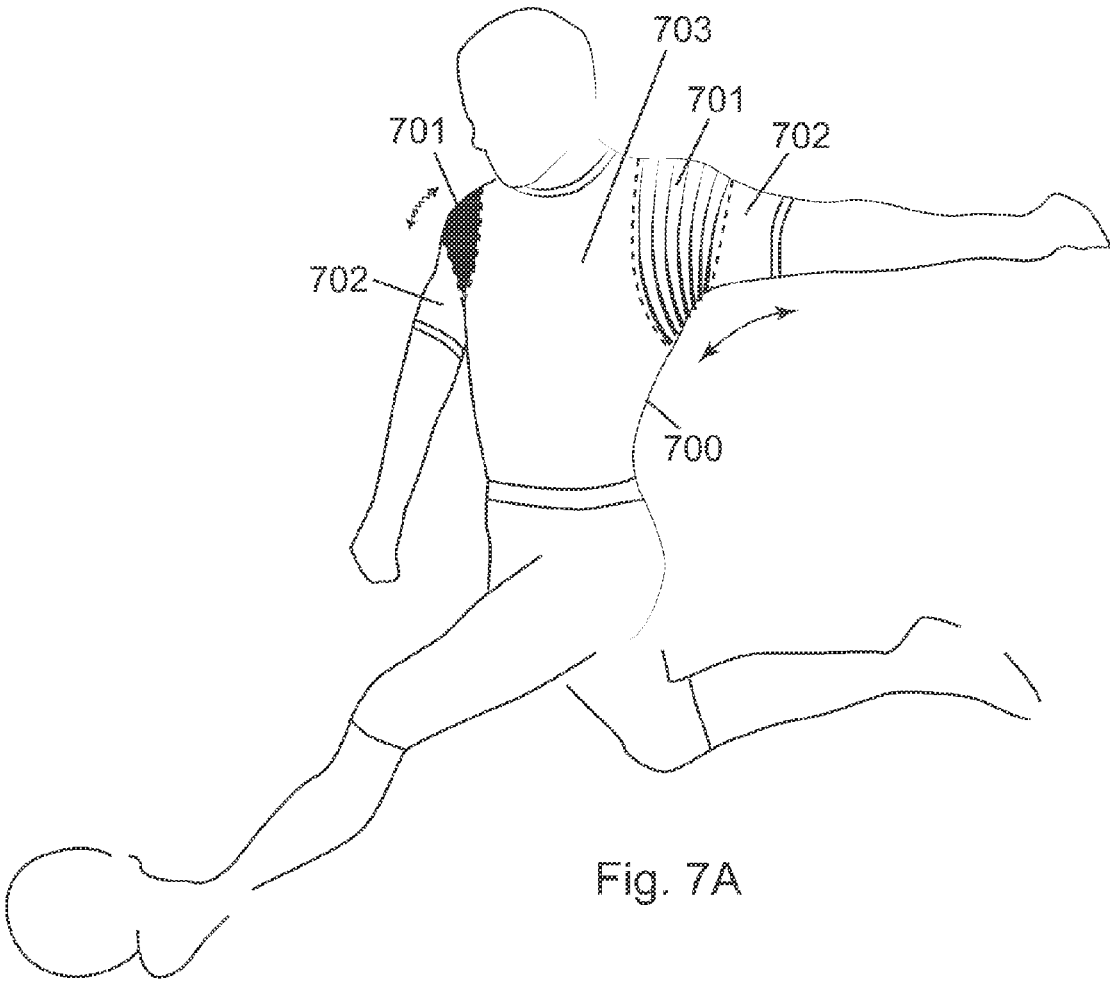
FIG. 7A is a schematic illustration of a soccer shirt, in accordance with some demonstrative embodiments of the present invention.
Figure 7B:
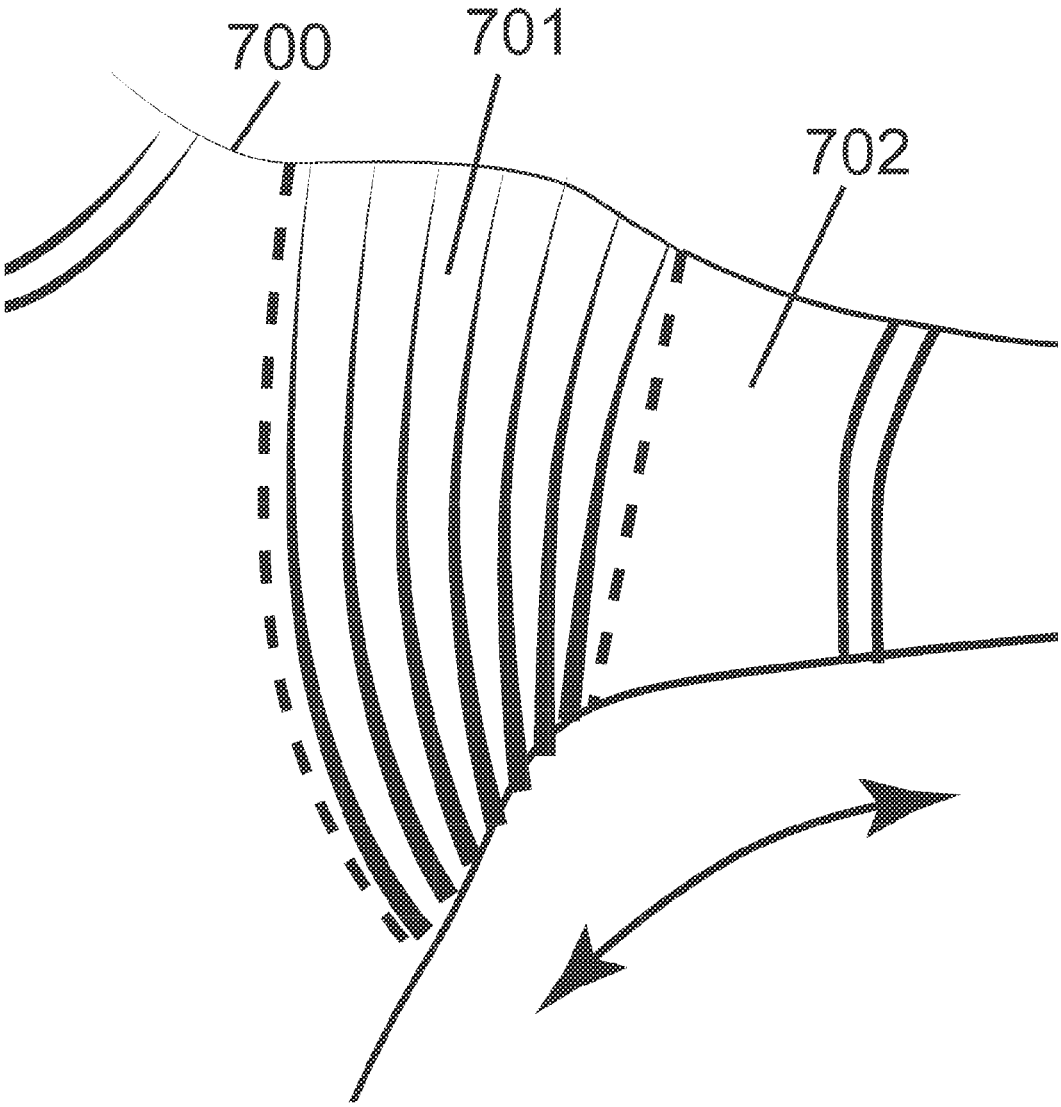
FIG. 7B is an enlarged view of a portion of the shirt of FIG. 7A.

Reference is made to FIG. 7A, which is a schematic illustration of a shirt 700 in accordance with some demonstrative embodiments of the present invention; as well as to FIG. 7B, which is an enlarged view of a portion of the shirt 700 of FIG. 7A. Shirt 700 may be a sports shirt, or a shirt specifically adapted or structured to accommodate persons that play certain sports (e.g., soccer, global football, or the like). Shirt 700 may enable improved or easier or more efficient motion of the wearer during such sports, particularly improved or easier or more efficient motion during extension and abduction at the shoulders (e.g., as the wearer prepares for kicking a ball with his foot, and moves his opposite arm sideways and/or backwards). Particularly, intermediary-region 701 may be implemented in an "accordion-style" of fabric and/or knitting, thereby decoupling or disconnecting the movement of arm regions 702 from movement of chest region 703; and thereby allowing the arm regions 702 to move more freely, in a manner that does not cause at all (or causes very little, or reduced) motion or movement of the chest region 703.

Figure 8A:
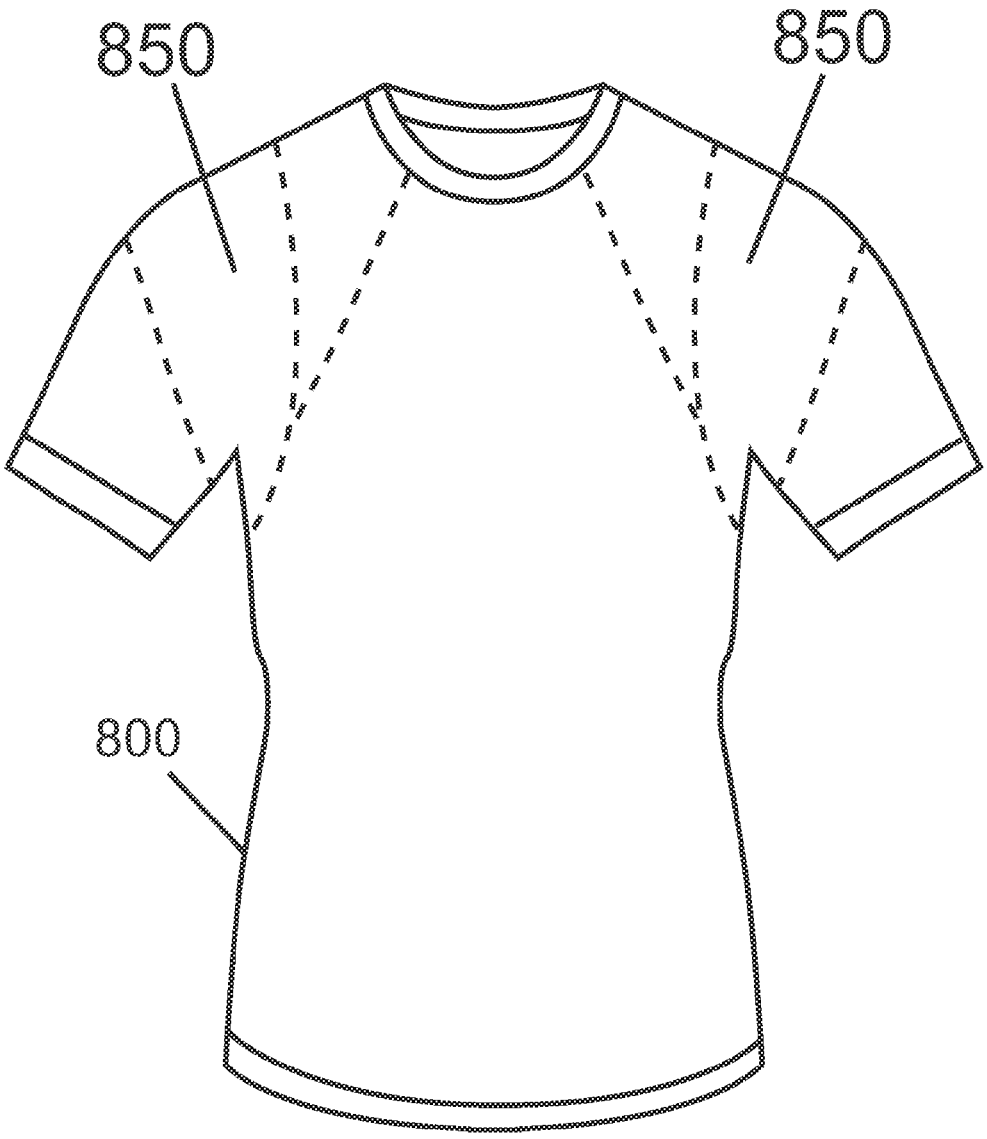
FIG. 8A is a schematic illustration of a front view of a sports shirt, in accordance some demonstrative embodiments of the present invention.
Figure 8B:
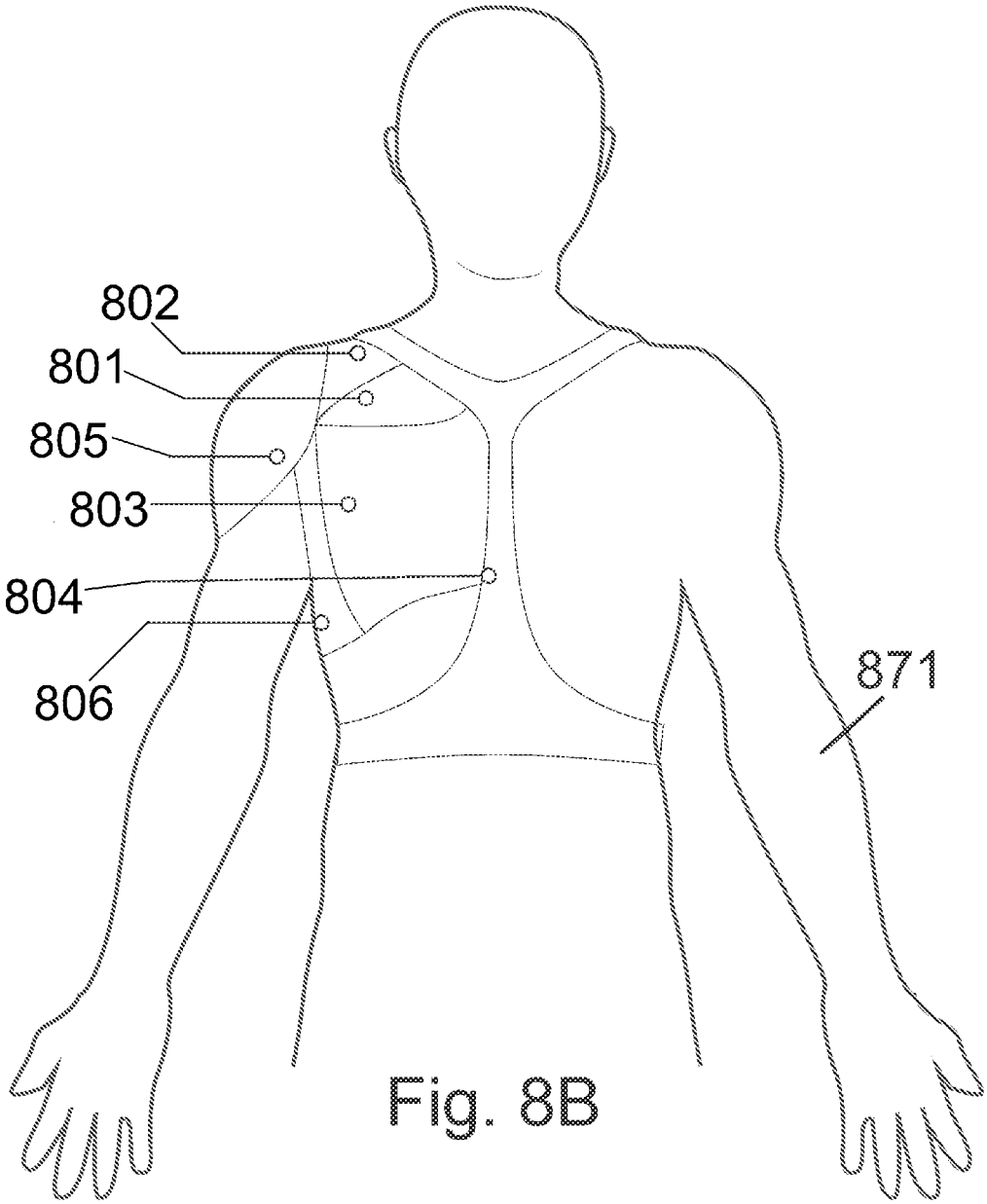
FIG. 8B is a schematic illustration of a front side of a human body and its regions.
Figure 8C:
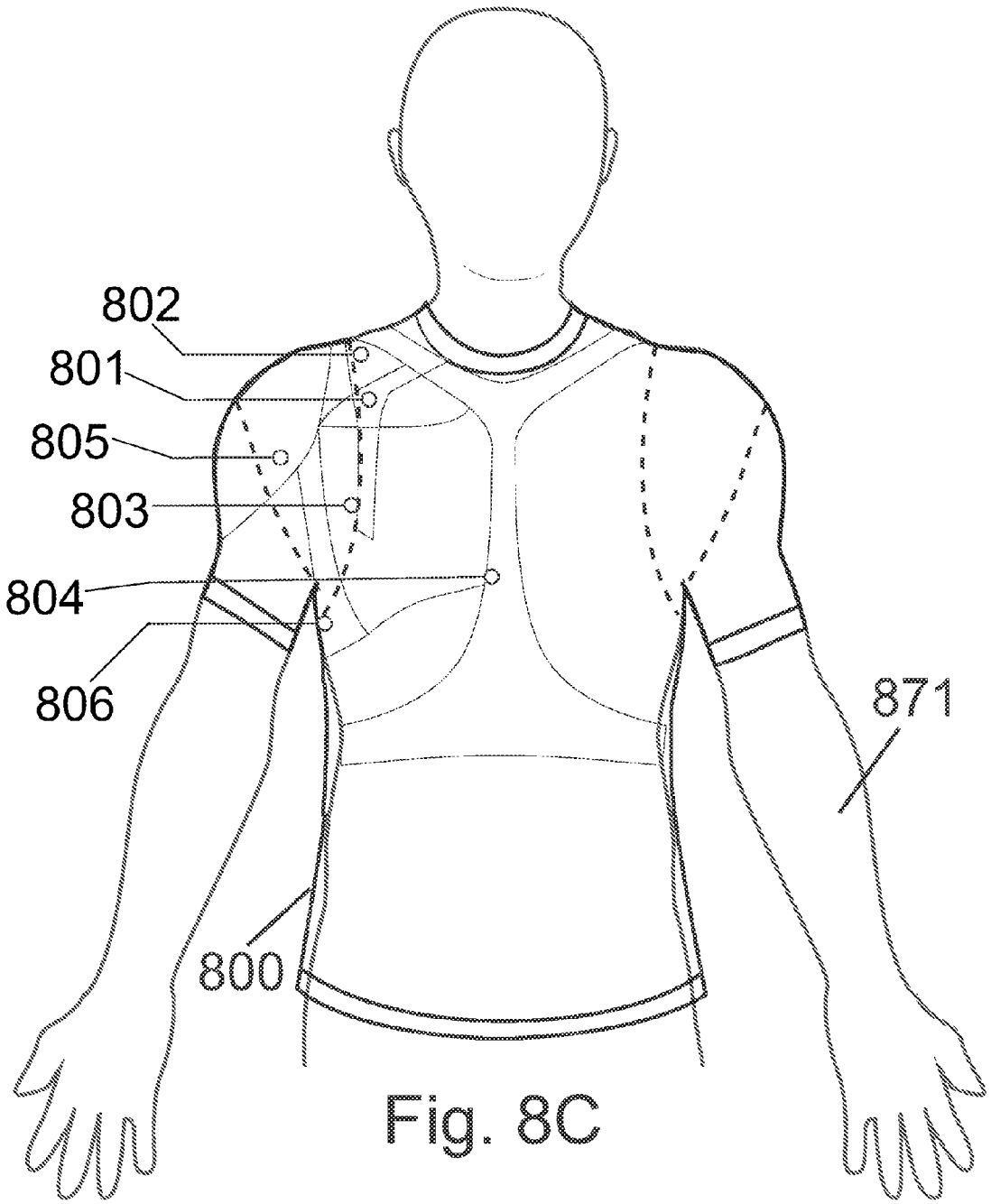
FIG. 8C is a schematic illustration of the sports shirt of FIG. 8A superimposed on the front side of the human body of FIG. 8B.

Reference is made to FIGS. 8A-8C, in which, FIG. 8A is a schematic illustration of a front view of a sports shirt 800 in accordance with the present invention; FIG. 8B is a schematic illustration of a front side 871 of a human body with various body regions (denoted 801-806); and FIG. 8C is a schematic illustration of the sports shirt 800 superimposed on the front side 871 of the human body. Regions 801-806 may comprise, for example: Infrascapular region 801; Deltopectorial triangle 802; Pectoral region 803; Sternal region 804; Deltoid region 805; and Axillary region 806.

Figure 9A:
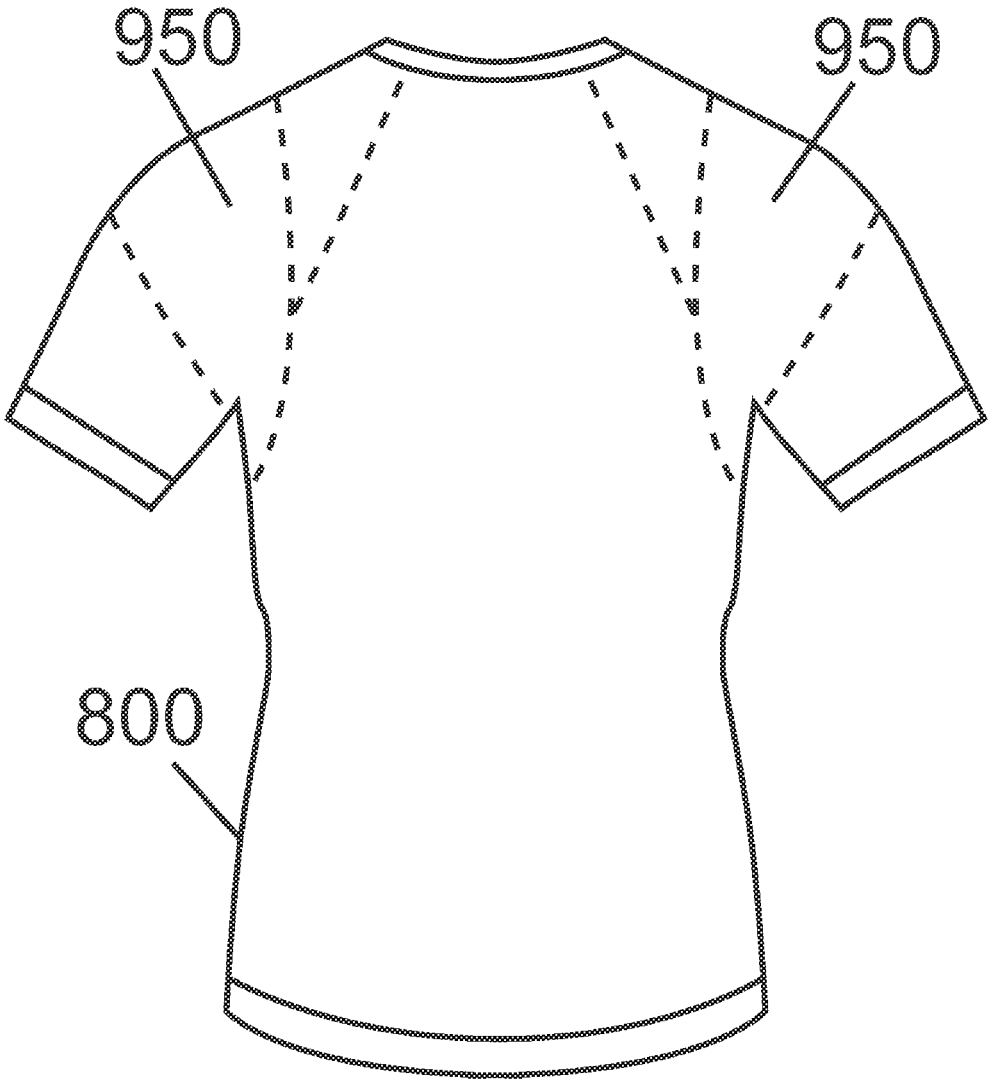
FIG. 9A is a schematic illustration of a back view of a sports shirt, in accordance some demonstrative embodiments of the present invention.
Figure 9B:
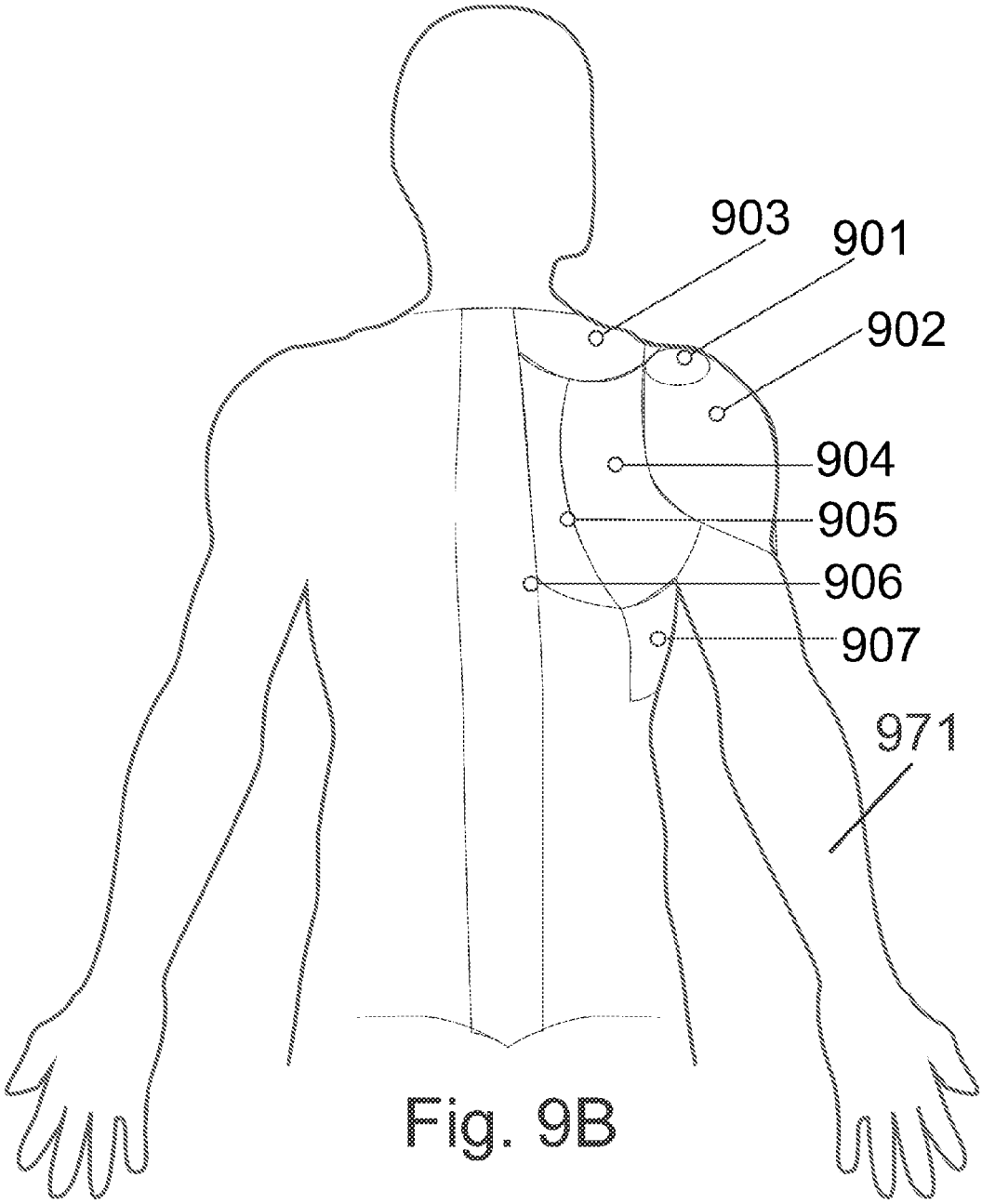
FIG. 9B is a schematic illustration of a back side of a human body and its regions.
Figure 9C:
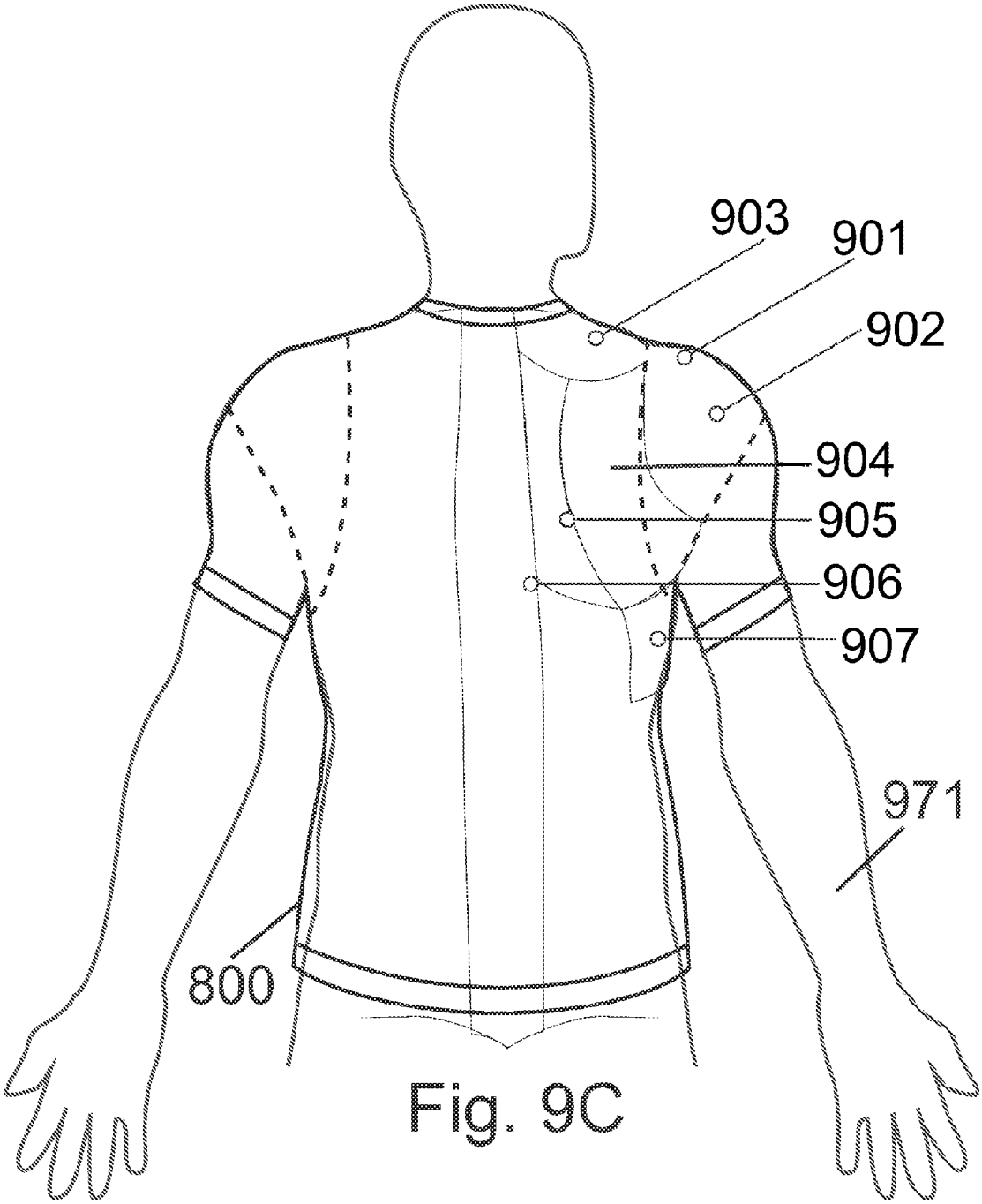
FIG. 9C is a schematic illustration of the sports shirt of FIG. 9A superimposed on the back side of the human body of FIG. 9B.

Reference is also made to FIGS. 9A-9C, in which, FIG. 9A is a schematic illustration of a back view of sports shirt 800; FIG. 9B is a schematic illustration of a back side 971 of a human body with various body regions (denoted 901-907); and FIG. 9C is a schematic illustration of the sports shirt 800 superimposed on the back side 971 of the human body. Regions 901-907 may comprise, for example: Acrominal region 901; Deltoid region 902; Suprascapular region 903; Scapular region 904; Interscapular region 905; Vertebral region 906; and Lateral pectoral region 907.

As demonstrated in FIGS. 8A-8C showing the front view, the front-side of a decoupling component 850 of shirt 800 may extend from the tip of the deltopectoral triangle 802 along the line bordering the pectoral region 803 and the axillary region 806; and then the decoupling component 850 cuts towards the auxiliary fossa (lateral side of the auxiliary region 806), and moves up to the upper portion of the lower third of the deltoid region 805.

As demonstrated in FIGS. 9A-9C showing the back view, the back-side of the decoupling component (denoted 950) extends from the tip of the acrominal region 901 (at its bottom) down to the center of the scapular region 904 (at its bottom); then cuts to the side of the body into the back portion of the axillary region; then moves up into the upper portion of the lower third of the deltoid region 902 (at its bottom).

Figure 10A:
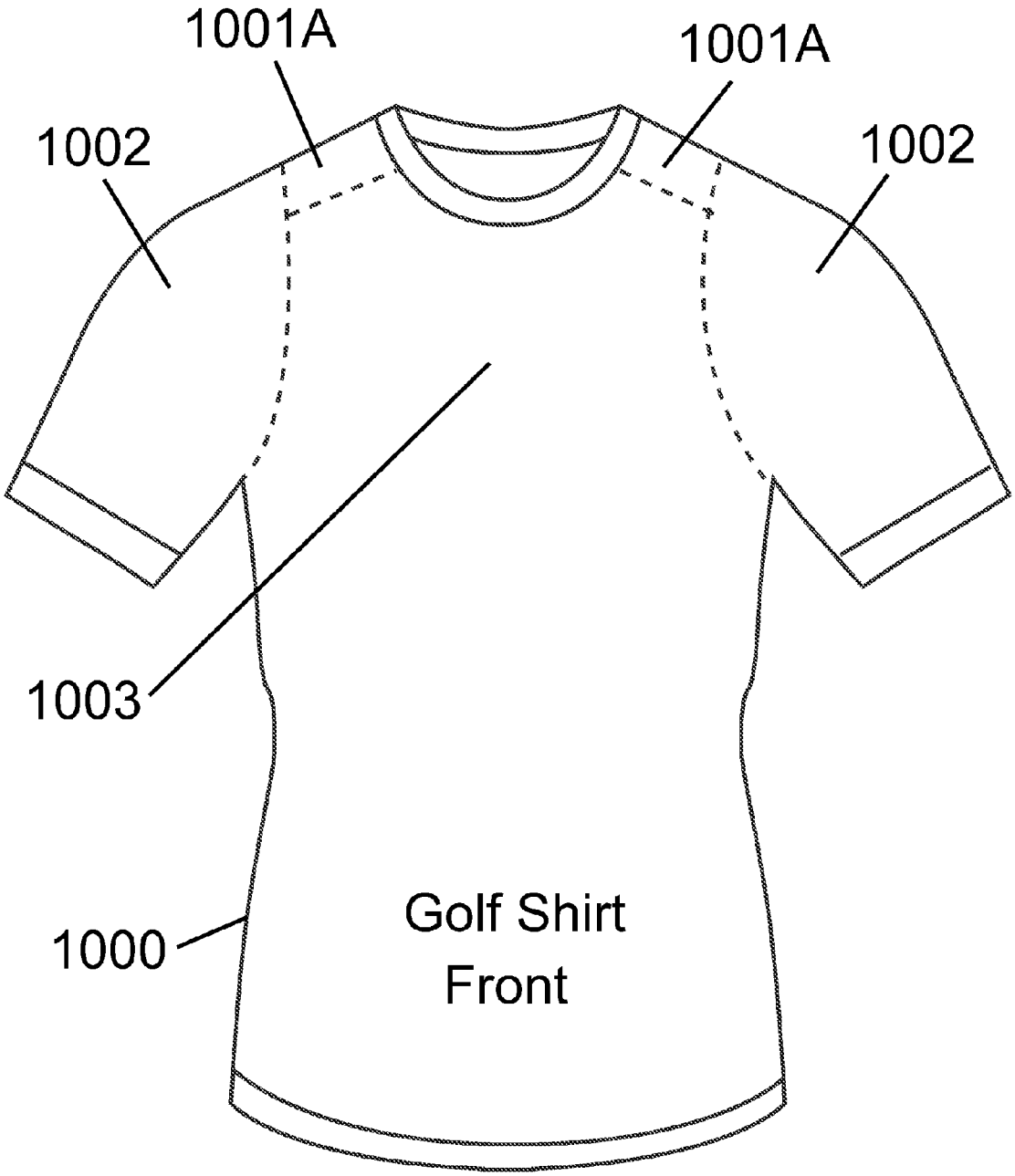
FIG. 10A is a schematic illustration of a front side of a golf shirt in accordance with some demonstrative embodiments of the present invention.
Figure 10B:
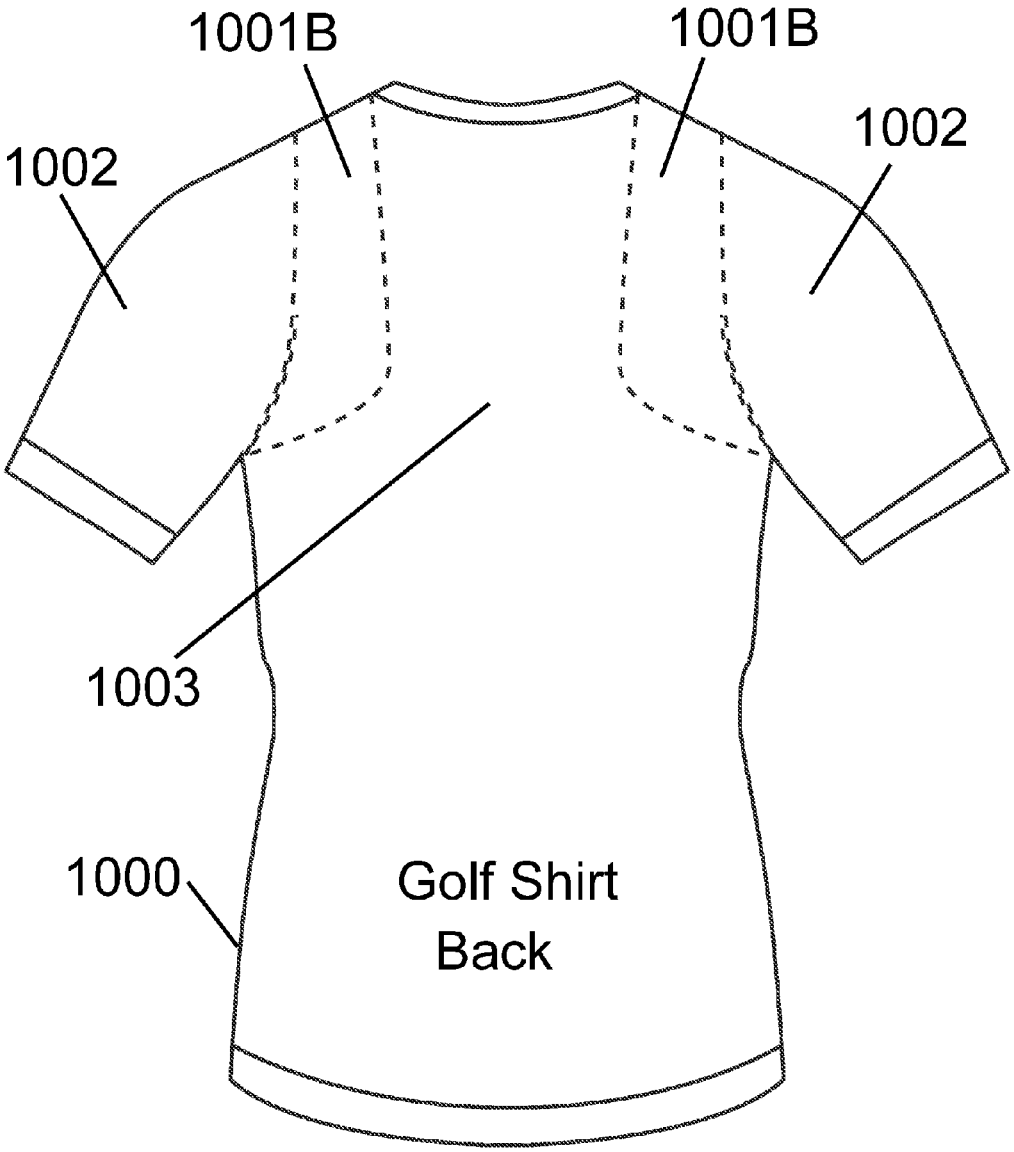
FIG. 10B is a schematic illustration of a back side of the golf shirt of FIG. 10A.

Reference is made to FIG. 10A, which is a schematic illustration of a front side of a shirt 1000 in accordance with some demonstrative embodiments of the present invention; as well as to FIG. 10B, which is a schematic illustration of a back side of shirt 1000. Shirt 1000 may be a sports shirt, or a shirt particular suitable for persons engaging in a particular sporting activity; for example, for golfers or for persons playing golf or similar sport. Shirt 1000 may comprise a decoupling region, denoted 1001A (front side) and 1001B (back side), which may decouple or detach the movement of chest area 1003 from movement of arm areas 1002 (or vice versa).

Figure 10C:
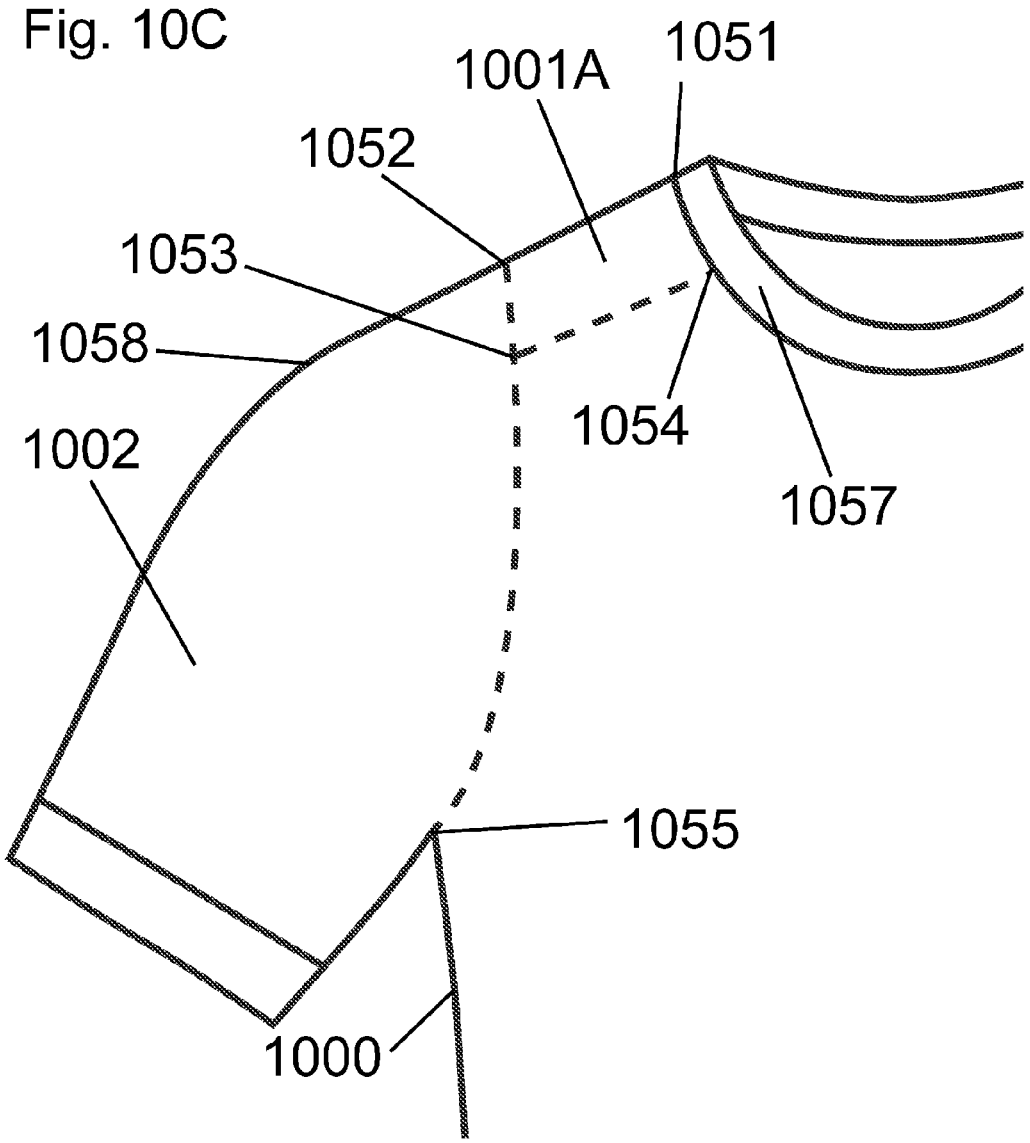
FIG. 10C is an enlarged view of a portion of the front side of the shirt of FIG. 10A.

Reference is made to FIG. 10C, which is an enlarged view (or zoomed-in view) of a portion of the front side of shirt 1000 of FIG. 10A. The front side of decoupling region 1001A may have a structure defined by points 1051-1054, as follows: (A) a curved or straight top edge defined between point 1051 and point 1052, such that line 1051-1052 sits on the shoulder of the wearer, or such that point 1051 is located at the left-most corner of the front side of the collar 1057, or such that point 1051 is located at the front upper-left corner of the shoulder area (or the shoulder-neck connection area); and such that point 1052 is located on the right shoulder, approximately 40% or 50% or 60% (or, in the range of 40 to 60 percent) of the distance between point 1051 and point 1058 (which is the point at which the shoulder area connects with the arm area, or which is the shoulder-arm connection point, or which is the top-most point of right-sleeve 1002); (B) line 1052-1053, which may be straight or slightly-curved, such that point 1053 is located along a slightly-curved line that connects point 1052 with point 1055 (which is located immediately under the right armpit; or which is the lowest connection point of the right-side sleeve 1002 with the chest area or trunk area of the shirt 1000), and such that the length of line 1052-1053 may be approximately 10 or 15 or 20 or 25 or 30 percent of the length of line 1052-1055, or such that the length of line 1052-1053 may be in the range of 10 to 30 percent relative to the length of line 1052-1055; (C) a generally straight line from point 1053 to point 1054, extending diagonally and generally parallel to line 1051-1052, or at a slanting of 2 or 5 or 7 or 10 degrees relative to line 1051-1052, and such that point 1054 is located on the border of collar 1057; (D) a slightly-curved line 1054-1051 that connect point 1054 to point 1051 along the border of collar 1057. A similar decoupling region 1001A may be located at the front side of shirt 1000 near or at the connection of the left shoulder with the left arm, and may have a similar structure, but may be horizontally flipped or mirrored relative to the structure of the decoupling region 1001A that is shown in FIG. 10C.

Figure 10D:
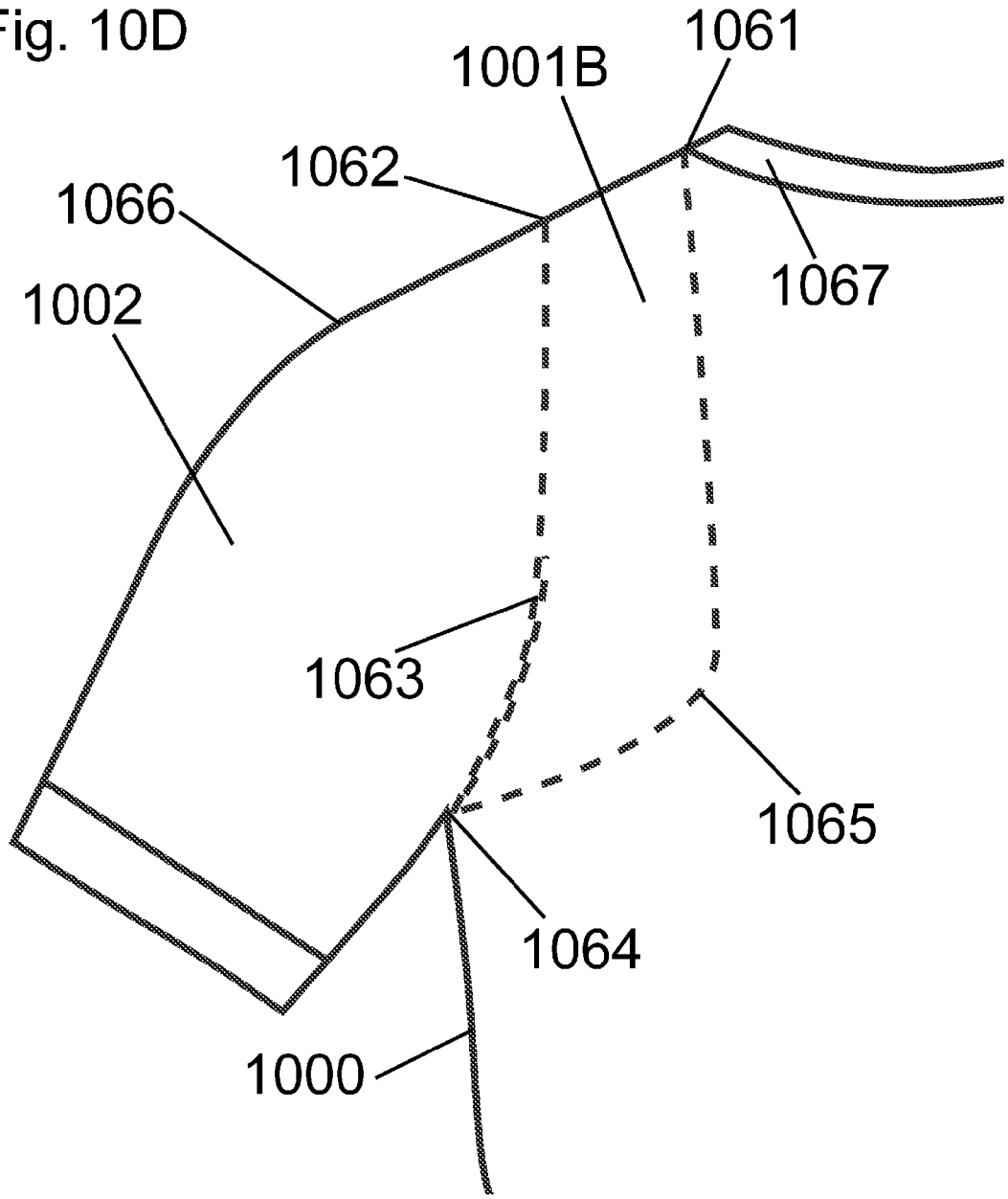
FIG. 10D is an enlarged view of a portion of the back side of the shirt of FIG. 10B.

Reference is made to FIG. 10D, which is an enlarged view (or zoomed-in view) of a portion of the back side of shirt 1000 of FIG. 10B. The back side of decoupling region 1001B may have a structure defined by points 1061-1065, as follows: (A) a curved or straight top edge defined between point 1061 and point 1062, such that line 1061-1062 sits on the shoulder of the wearer, or such that point 1061 is located at the left-most corner of the back side of the collar 1067, or such that point 1061 is located at the back upper-left corner of the shoulder area (or the shoulder-neck connection area); and such that point 1062 is located on the left shoulder, approximately 40% or 50% or 60% (or, in the range of 40 to 60 percent) of the distance between point 1061 and point 1066 (which is the point at which the shoulder area connects with the arm area, or which is the shoulder-arm connection point, or which is the top-most point of left-sleeve 1002); (B) line or curved-line 1062-1063-1064, which may be straight or slightly-curved, such that point 1063 is located along a slightly-curved line that connects point 1062 through point 1063 with point 1064 (which is located immediately under the left armpit; or which is the lowest connection point of the left-side sleeve 1002 with the chest area or trunk area of shirt 1000), and such that the length of line 1062-1063 may be approximately 40 or 45 or 50 or 55 or 60 or 65 or 66 or 70 or 75 percent of the length of line 1062-1063-1064, or such that the length of line 1062-1063 may be in the range of 40 to 75 percent relative to the entire length of line 1062-1063-1064; (C) an L-shaped or J-shaped line from point 1064 through point 1065 to point 1061, firstly extending diagonally at line 1064-1065 which is generally parallel to line 1061-1062, or at a slanting of 2 or 5 or 7 or 10 degrees relative to line 1061-1062, and then continuing with line 1061-1065 which may be at an angel of approximately 95 or 100 or 110 or 120 or 130 or 135 or 140 or 150 degrees (or in the range of 95 to 125 degrees, or in the range of 100 to 150 degrees) relative to line 1064-1065; and such that the angel between line 1061-1062 and line 1061-1065 is smaller than 90 degrees, or is approximately 85 or 80 or 75 or 70 or 65 or 60 degrees, or is in the range of 60 to 85 degrees, or is in the range of 65 to 80 degrees; and such that line 1061-1065 is generally parallel to line 1062-1063, or such that line 1061-1065 is slanted at approximately 0 or 1 or 2 or 5 or 7 or 10 degrees (or in the range of 2 to 10 degrees) relative to line 1062-1063. A similar decoupling region 1001B may be located at the back side of shirt 1000 near or at the connection of the right shoulder with the right arm, and may have a similar structure, but may be horizontally flipped or mirrored relative to the structure of the decoupling region 1001B that is shown in FIG. 10D.

In some embodiments, the area of the front-side of the decoupling region 1001A may be smaller than the area of the back-side of the decoupling region 1001B. For example, the general height or the average height (south-to-north) of the front side of the decoupling region 1201A may be approximately 10 or 15 or 20 or 25 or 30 or 33 percent (or may be in the range of 10 to 33 percent), relative to the height or the average height the back side of the decoupling region 1001B. In some embodiments, for example, the area of the front side of the decoupling region 1001A, may be approximately 10 or 15 or 20 or 25 or 30 or 33 percent (or may be in the range of 10 to 33 percent), relative to the area of the back side of the decoupling region 1001B.

Figure 11A:
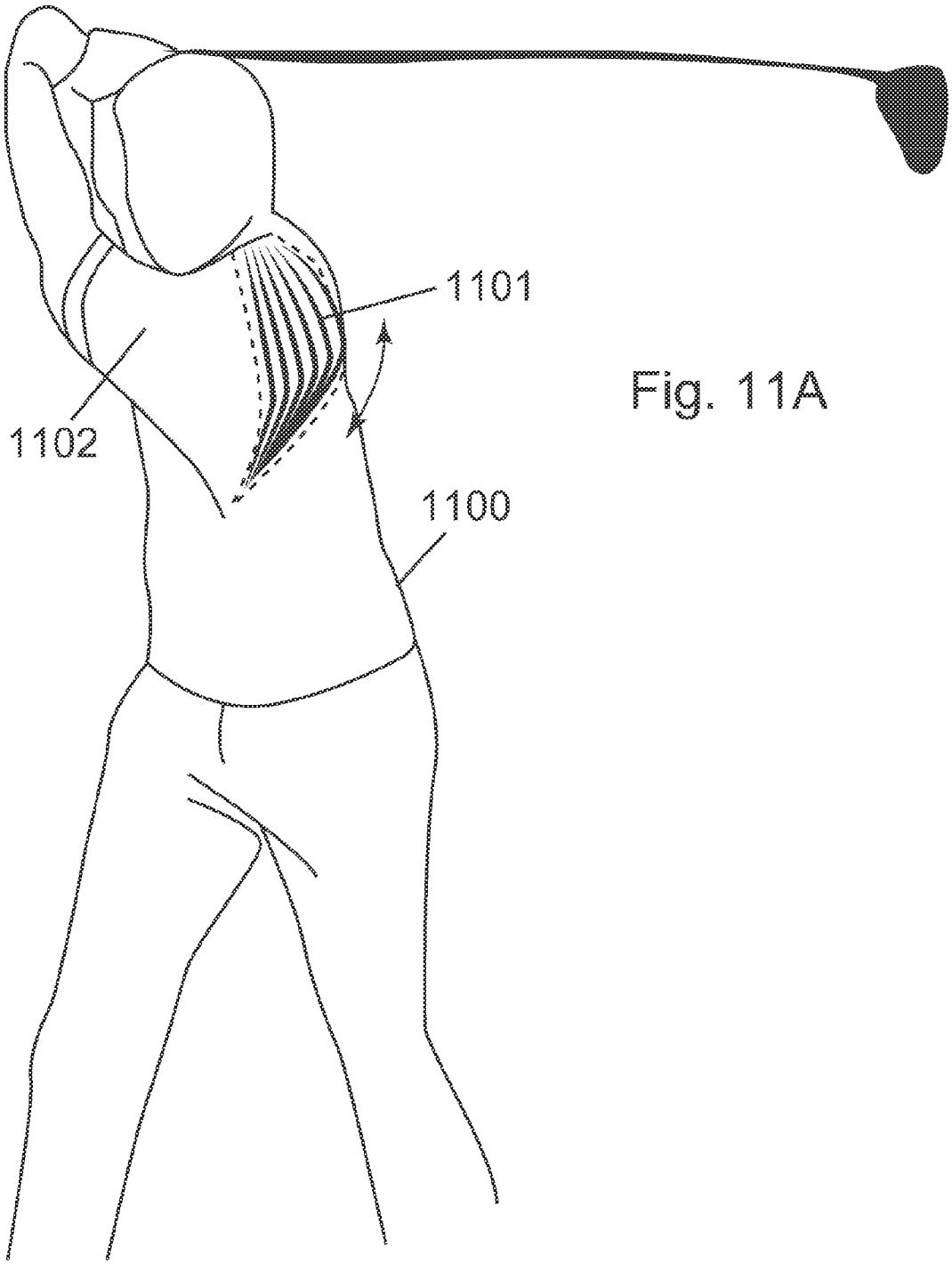
FIGS. 11A-11B are schematic illustrations of a golf shirt in accordance with some demonstrative embodiments of the present invention.
Figure 11B:
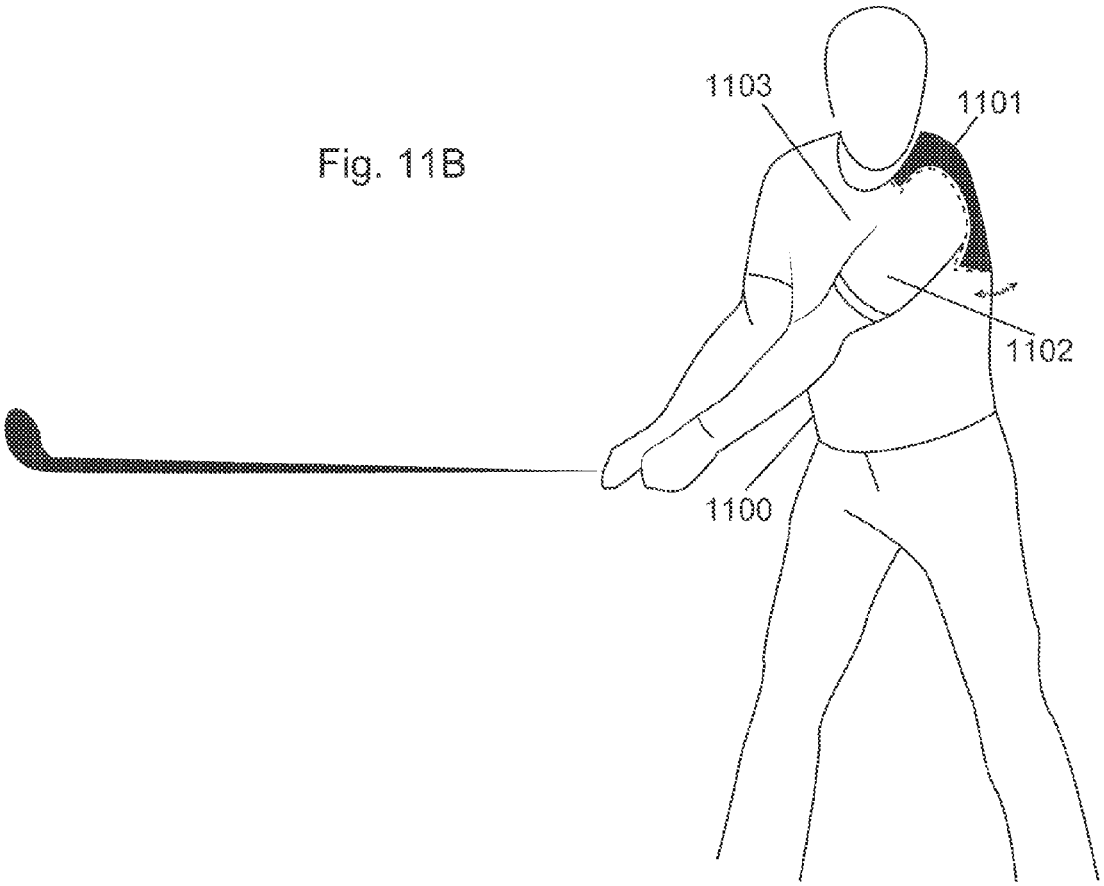

Reference is made to FIGS. 11A-11B, which are schematic illustrations of a shirt 1100 in accordance with some demonstrative embodiments of the present invention. Shirt 1100 may be a sports shirt, or a shirt specifically adapted or structured to accommodate persons that play certain sports (e.g., golf, or sports that require similar equipment or similar motions). Shirt 1100 may enable improved or easier or more efficient motion of the wearer during such sports, particularly improved or easier or more efficient motion during one or more stages (e.g., the earlier stages or the initial stages) or a golf swing, which may require abduction-adduction at the shoulders (e.g., as the wearer performs initial stages of a golf swing). Particularly, intermediary-region 1101 may be implemented in an "accordion-style" of fabric and/or knitting, thereby decoupling or disconnecting the movement of arm regions 1102 from movement of chest region 1103; and thereby allowing the arm regions 1102 to move more freely, in a manner that does not cause at all (or causes very little, or reduced) motion or movement of the chest region 1103.

In some implementations of shirt 1100 as a shirt that is particularly suitable and efficient for golf players, the decoupling intermediary-region 1101 may be situated mostly or dominantly at the back side of shirt 1100, rather than at the front side of shirt 1100; and only a small or minimal portion (e.g., up to 10 or 15 or 20 or 25 percent) of the decoupling intermediary-region 1101 may be comprised in the front side of shirt 1100.

Figure 12A:
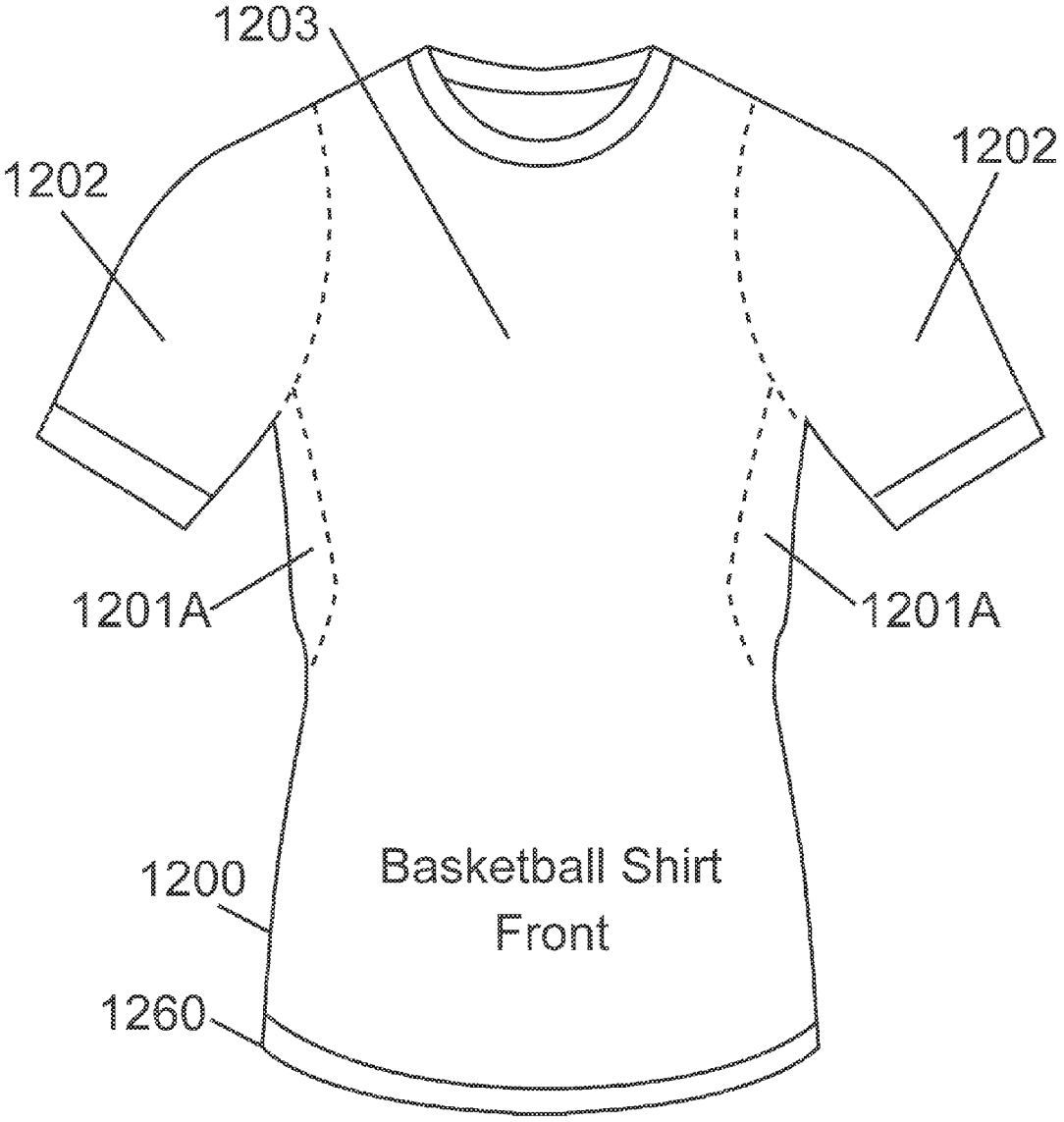
FIG. 12A is a schematic illustration of a front side of a basketball shirt, in accordance with some demonstrative embodiments of the present invention.
Figure 12B:
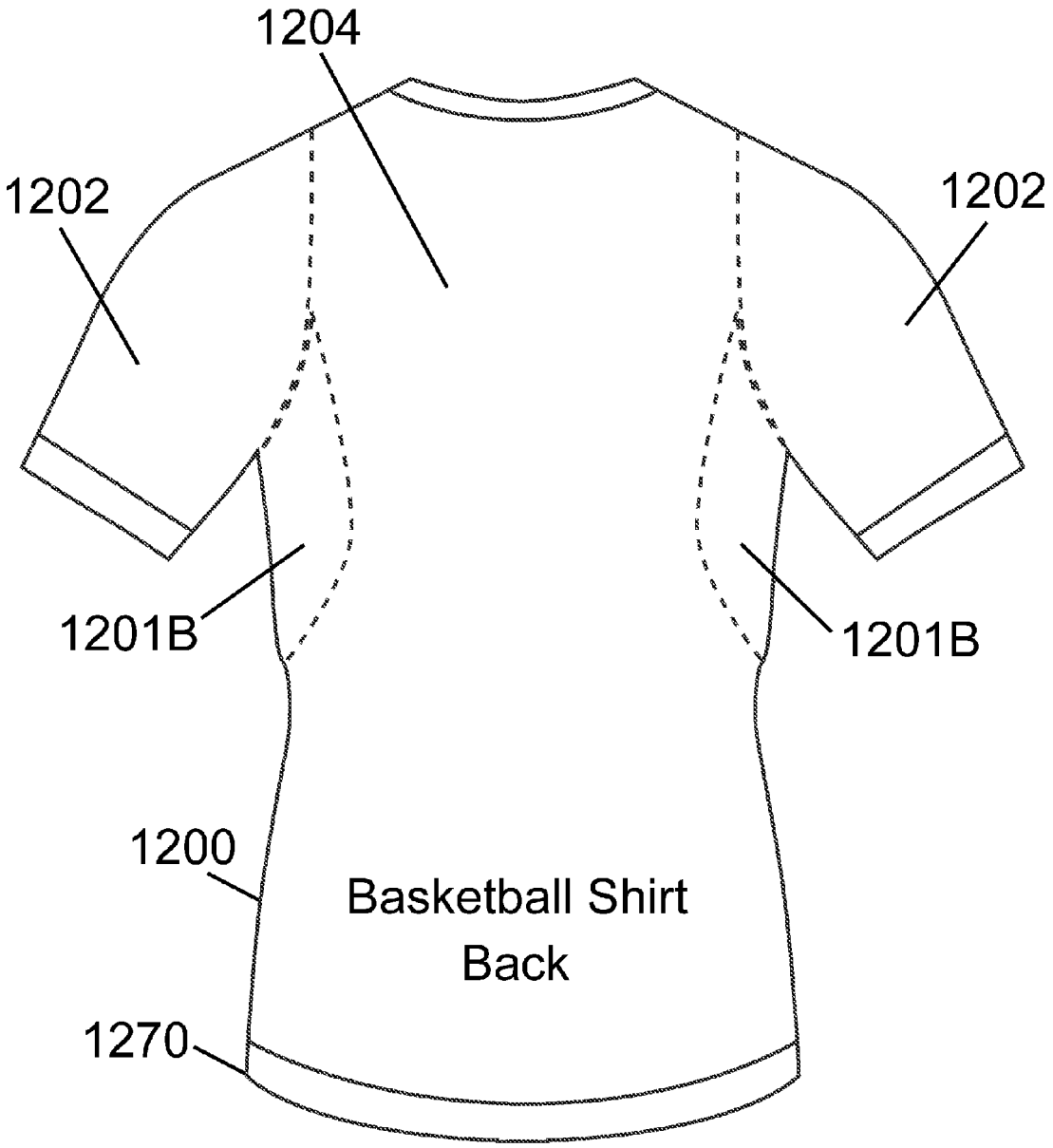
FIG. 12B is a schematic illustration of a back side of the basketball shirt of FIG. 12A.

Reference is made to FIG. 12A, which is a schematic illustration of a front side of a shirt 1100 in accordance with some demonstrative embodiments of the present invention; as well as to FIG. 12B, which is a schematic illustration of a back side of shirt 1200. Shirt 1200 may be a sports shirt, or a shirt particularly suitable for persons engaging in a particular sporting activity; for example, for basketball players or for persons playing basketball or similar sport. Shirt 1200 may comprise a decoupling region, denoted 1201A (front side) and 1201B (back side), which may decouple or detach the movement of: (a) the chest area 1203 (or the trunk area), and/or the back area 1204; from (b) movement of the arm areas 1202 (or vice versa).

Figure 12C:
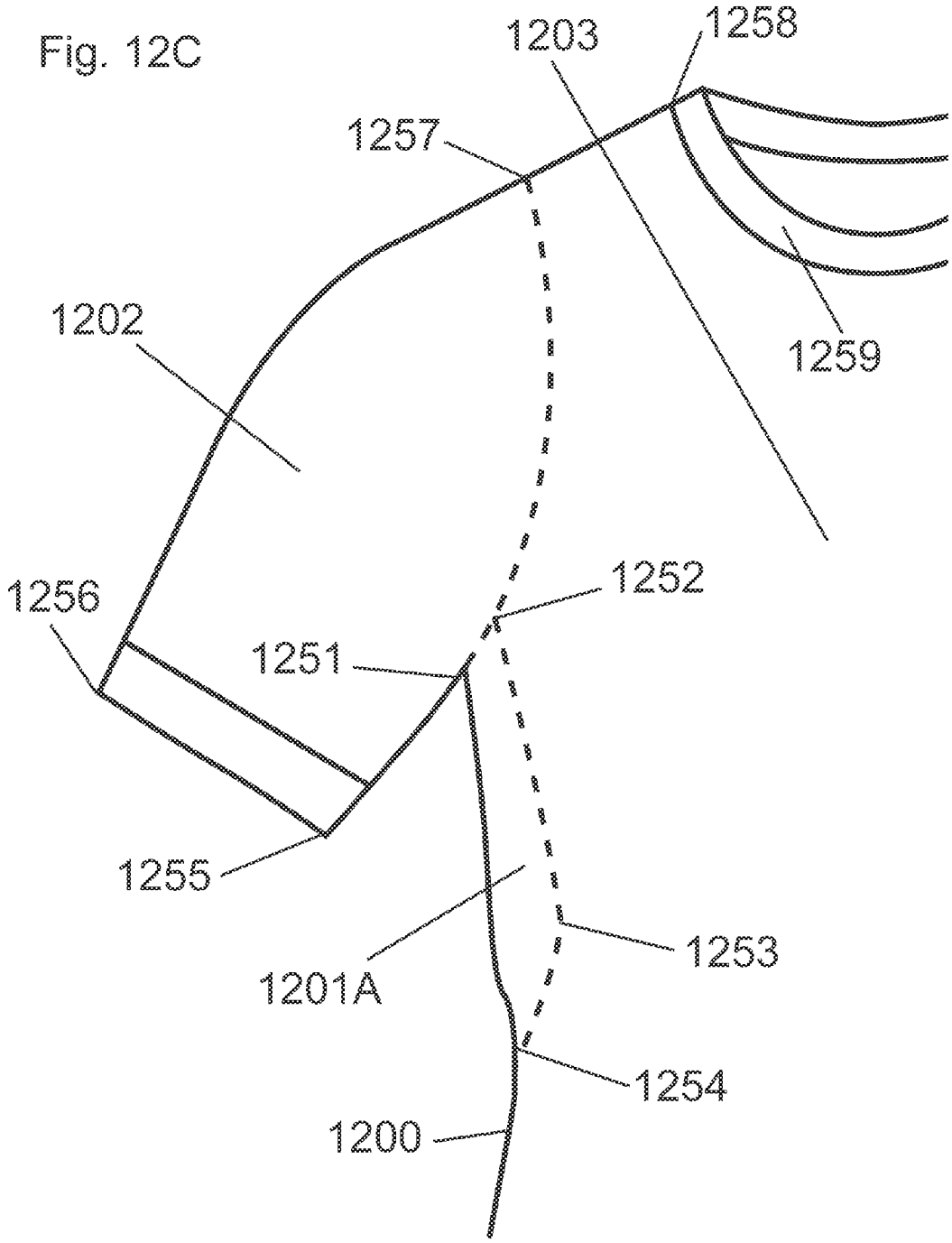
FIG. 12C is an enlarged view of a portion of the front side of the shirt of FIG. 12A.

Reference is made to FIG. 12C, which is an enlarged view (or zoomed-in view) of a portion of the front side of shirt 1200 of FIG. 12A. The front side of decoupling region 1201A may have a structure defined by points 1251-1254, as follows: (A) a first line 1251-1252, defined by point 1251 which is located immediately below the right armpit, and defined by point 1252 which is located north-east relative to point 1251; such that point 1252 is located along an imaginary line that continues the lower edge line 1251-1255 of right-sleeve 1202 towards the right-most corner 1258 of the collar 1259; or such that line 1251-1252 is approximately 15 or 20 or 25 or 30 or 33 percent relative to the length of the lower edge 1251-1255 of sleeve 1202; (B) a line 1251-1254 which is part of the right-side contour or edge of shirt 1200, extending downwardly or southwardly and having a length of approximately 100 or 150 or 200 or 250 percent relative to the length of the lower edge line 1251-1255 of the right sleeve 1202; (C) a curved line 1252-1253-1254, or a structure of two lines 1252-1253 connected to 1253-1254, forming a curved or wide-angled line 1252-1253-1254; such that point 1253 is located at a distance from line 1251-1254, the distance being approximately 100 or 120 or 150 or 170 or 200 percent relative to the length of line 1251-1252; and such that line 1253-1254 extends north-east from point 1254, whereas line 1252-1253 continues north-west from point 1253; and such that the length of line 1254-1251, or the length of line 1252-1253-1254, or the general height (north to south) of the front side of the decoupling region 1201A (e.g., the distance between point 1252 and point 1254), is approximately 25 or 30 or 33 or 35 or 40 or 45 percent of the total length (north to south) of shirt 1200, or of the right-side contour of shirt 1200 that extends from point 1251 (immediately under the right armpit) downwardly towards point 1260 (which is shown in FIG. 12A, as the bottom corner or lowest corner of shirt 1200). A similar decoupling region 1201A may be located at the front side of shirt 1200 near or at the connection of the left shoulder with the left arm, and may have a similar structure, but may be horizontally flipped or mirrored relative to the structure of the decoupling region 1201A that is shown in FIG. 12C.

Figure 12D:
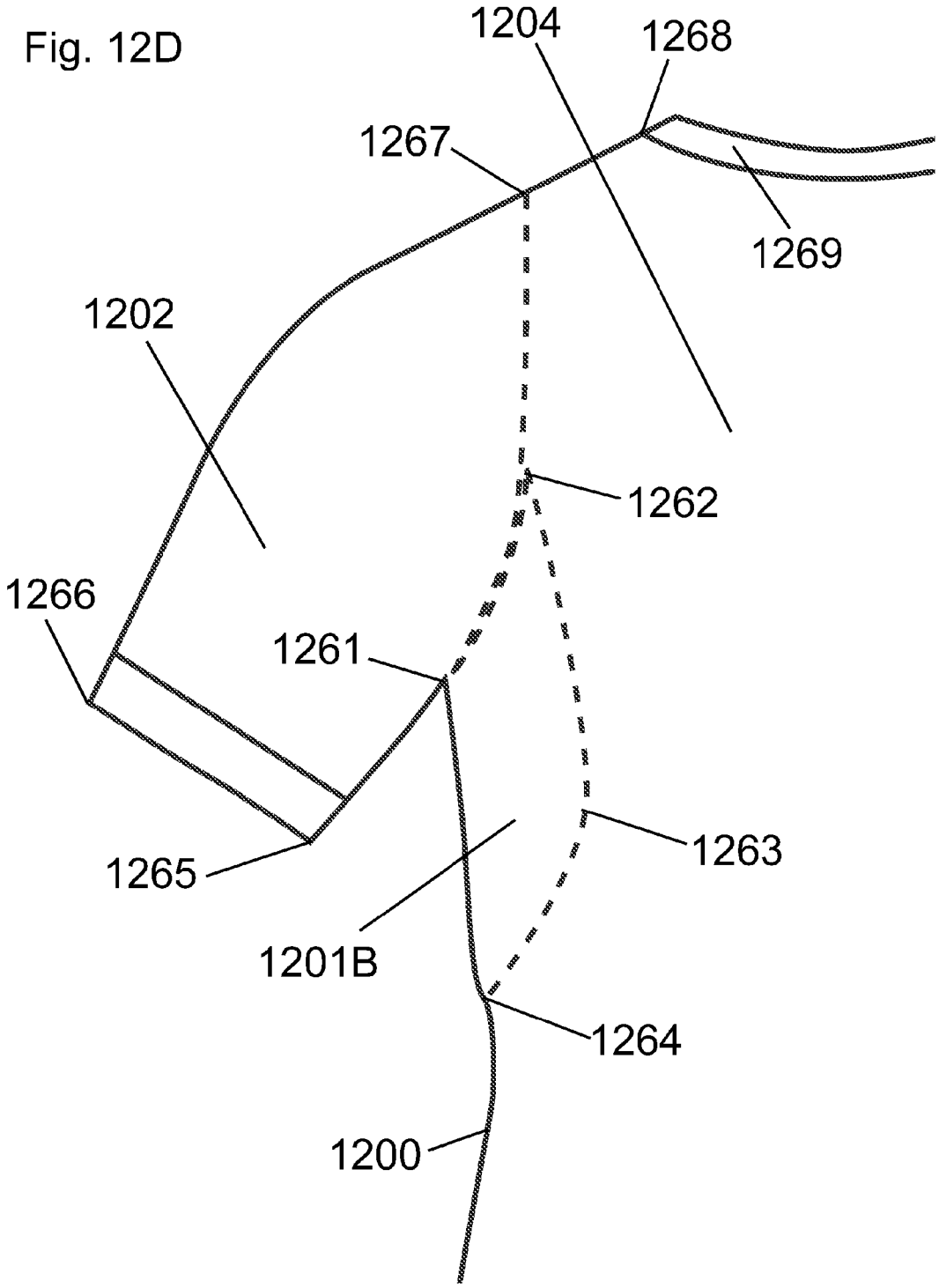
FIG. 12D is an enlarged view of a portion of the back side of the shirt of FIG. 12B.

Reference is made to FIG. 12D, which is an enlarged view (or zoomed-in view) of a portion of the back side of shirt 1200 of FIG. 12B. The back side of decoupling region 1201B may have a structure defined by points 1261-1264, as follows: (A) a first line 1261-1262, defined by point 1261 which is located immediately below the left armpit, and defined by point 1262 which is located north-east relative to point 1261; such that point 1262 is located along an imaginary line that continues the lower edge line 1261-1265 of sleeve 1202 towards the left-most corner 1268 of the collar 1269; or such that the length of line 1261-1262 is approximately 80 or 90 or 100 or 110 or 120 or 125 or 130 or 133 percent relative to the length of the lower edge line 1261-1265 of sleeve 1202; (B) a line 1261-1264 which is part of the left-side contour or edge of shirt 1200, extending downwardly or southwardly and having a length of approximately 100 or 150 or 200 or 250 percent relative to the length of the lower edge line 1261-1265 of the sleeve 1202; (C) a curved line 1262-1263-1264, or a structure of two lines 1262-1263 connected to 1263-1264, forming a curved or wide-angled line 1262-1263-1264; such that point 1263 is located at a distance from line 1261-1264, the distance being approximately 90 or 100 or 110 or 120 or 133 or 140 percent relative to the length of line 1261-1262; and such that line 1263-1264 extends north-east from point 1264, whereas line 1262-1263 continues north-west from point 1263; and such that the length of line 1264-1261, or the length of line 1262-1263-1264, or the general height (north to south) of the back side of the decoupling region 1201B (e.g., the distance between point 1262 and point 1264), is approximately 25 or 30 or 33 or 35 or 40 or 45 percent of the total length (north to south) of shirt 1200, or of the left-side contour of shirt 1200 that extends from point 1261 (immediately under the left armpit) downwardly towards point 1270 (which is shown in FIG. 12B, as the bottom corner or lowest corner of shirt 1200). A similar decoupling region 1201B may be located at the back side of shirt 1200 near or at the connection of the right shoulder with the right arm, and may have a similar structure, but may be horizontally flipped or mirrored relative to the structure of the decoupling region 1201B that is shown in FIG. 12D.

In some embodiments, the front-side of the decoupling region 1201A may be smaller and/or narrower than the back-side of the decoupling region 1201B. For example, the width or the average width (e.g., east-to-west) of the front side of the decoupling region 1201A may be approximately 25 or 30 or 33 or 40 or 45 or 50 percent, relative to the width or the average width (e.g., east-to-west) of the back side of the decoupling region 1201B; while at the same time, the general height or the average height (south-to-north) of the front side of the decoupling region 1201A may be approximately 75 or 80 or 90 or 100 percent, relative to the height or the average height the back side of the decoupling region 1201B. In some embodiments, for example, the area of the front side of the decoupling region 1201, may be approximately 20 or 25 or 30 or 33 or 35 or 40 or 50 percent, relative to the area of the back side of the decoupling region 1201B.

Figure 13A:
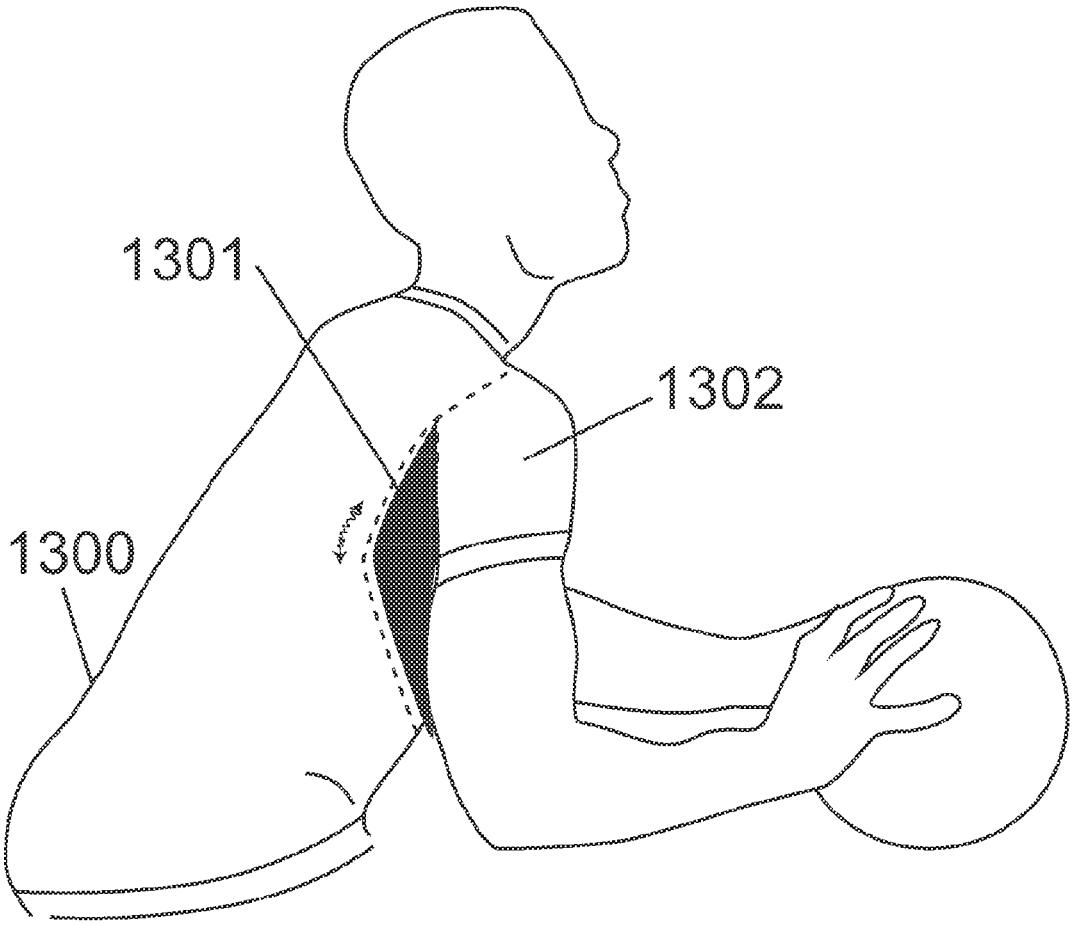
FIGS. 13A-13C are schematic illustrations of a basketball shirt, in accordance with some demonstrative embodiments of the present invention.
Figure 13B:
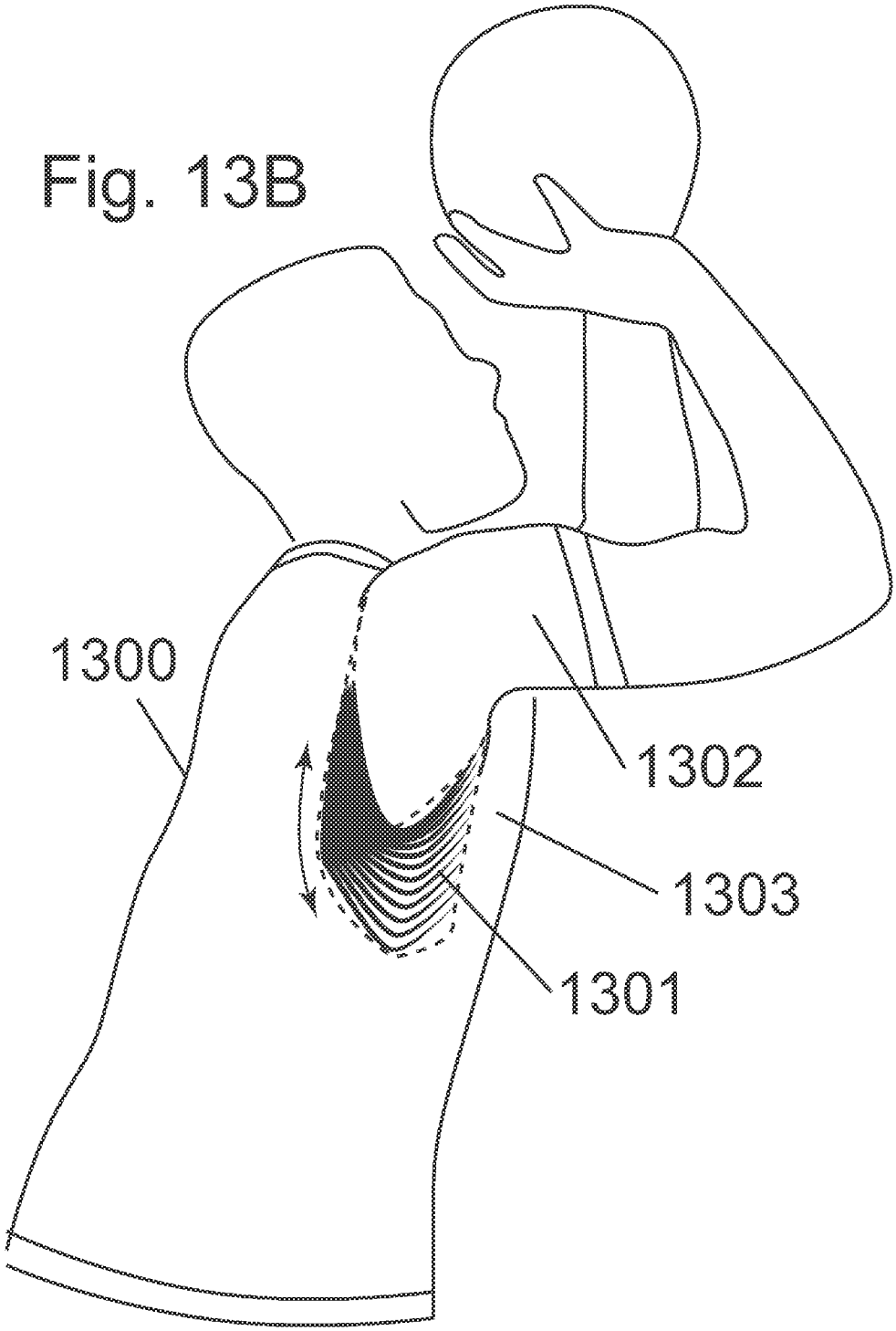
Figure 13C:
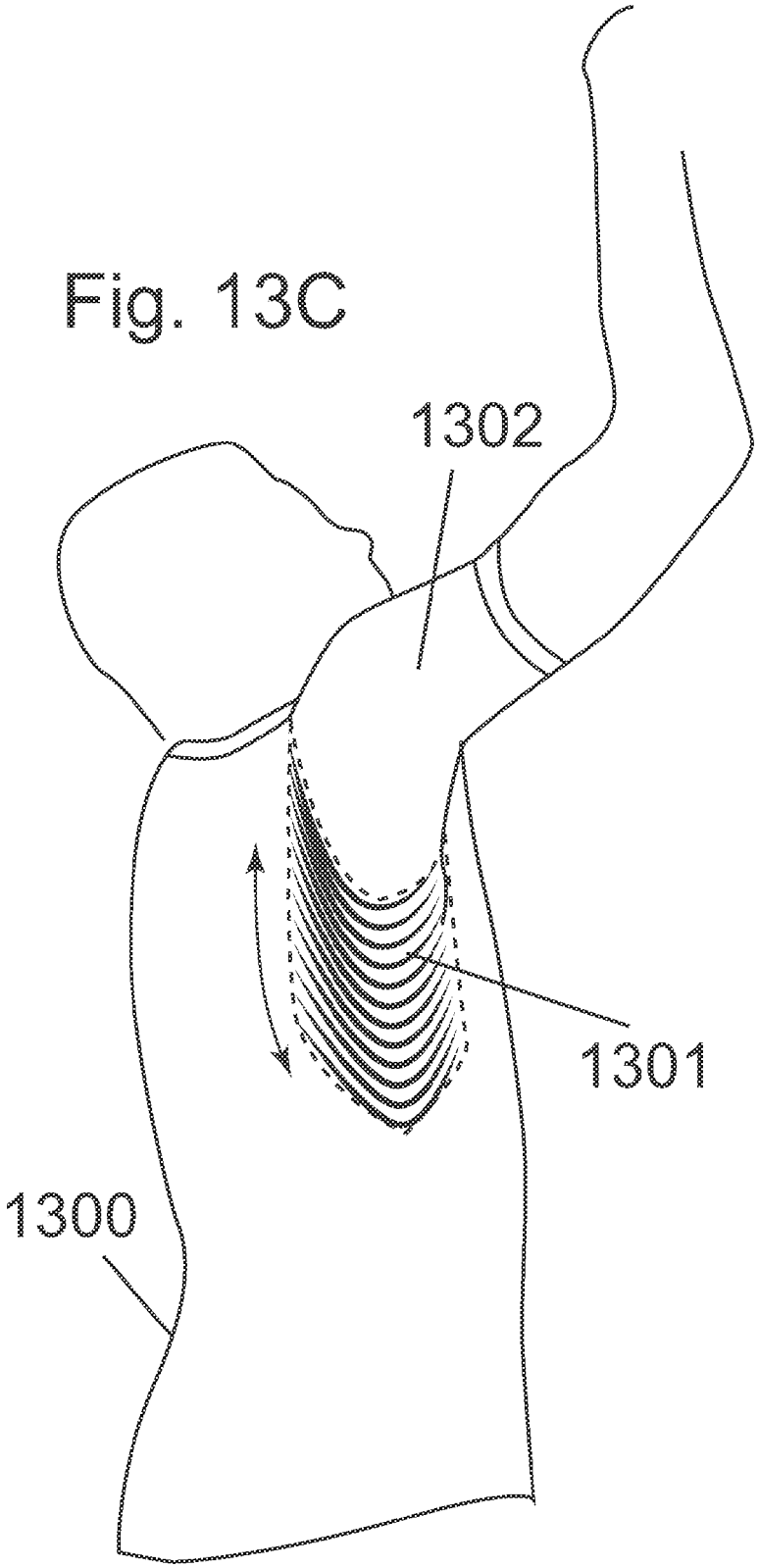

Reference is made to FIGS. 13A-13C, which are schematic illustrations of a shirt 1300 in accordance with some demonstrative embodiments of the present invention. Shirt 1300 may be a sports shirt, or a shirt specifically adapted or structured to accommodate persons that play certain sports (e.g., basketball, or sports that require or involve similar equipment or similar motions). Shirt 1300 may enable improved or easier or more efficient motion of the wearer during such sports, particularly improved or easier or more efficient motion during shooting or throwing of a basketball towards a hoop or towards another player or another target, which may require flexion at (or of) the shoulders (e.g., as the wearer performs a basketball shooting motion). Particularly, intermediary-region 1301 may be implemented in an "accordion-style" of fabric and/or knitting, thereby decoupling or disconnecting the movement of arm regions 1302 from movement of chest region 1303; and thereby allowing the arm regions 1302 to move more freely, in a manner that does not cause at all (or causes very little, or reduced) motion or movement of the chest region 1303. In some implementations of shirt 1300 as a shirt that is particularly suitable and efficient for golf players, the decoupling intermediary-region 1301 may be situated mostly or dominantly at or under the armpit region of shirt 1300, at the side (e.g., right side, left side) of shirt 1300, rather than at the front side or back side of shirt 1300; and only a small or minimal portion (e.g., up to 10 or 15 or 20 or 25 percent) of the decoupling intermediary-region 1301 may be comprised in the front side and/or the back side of shirt 1300.

Figure 14A:
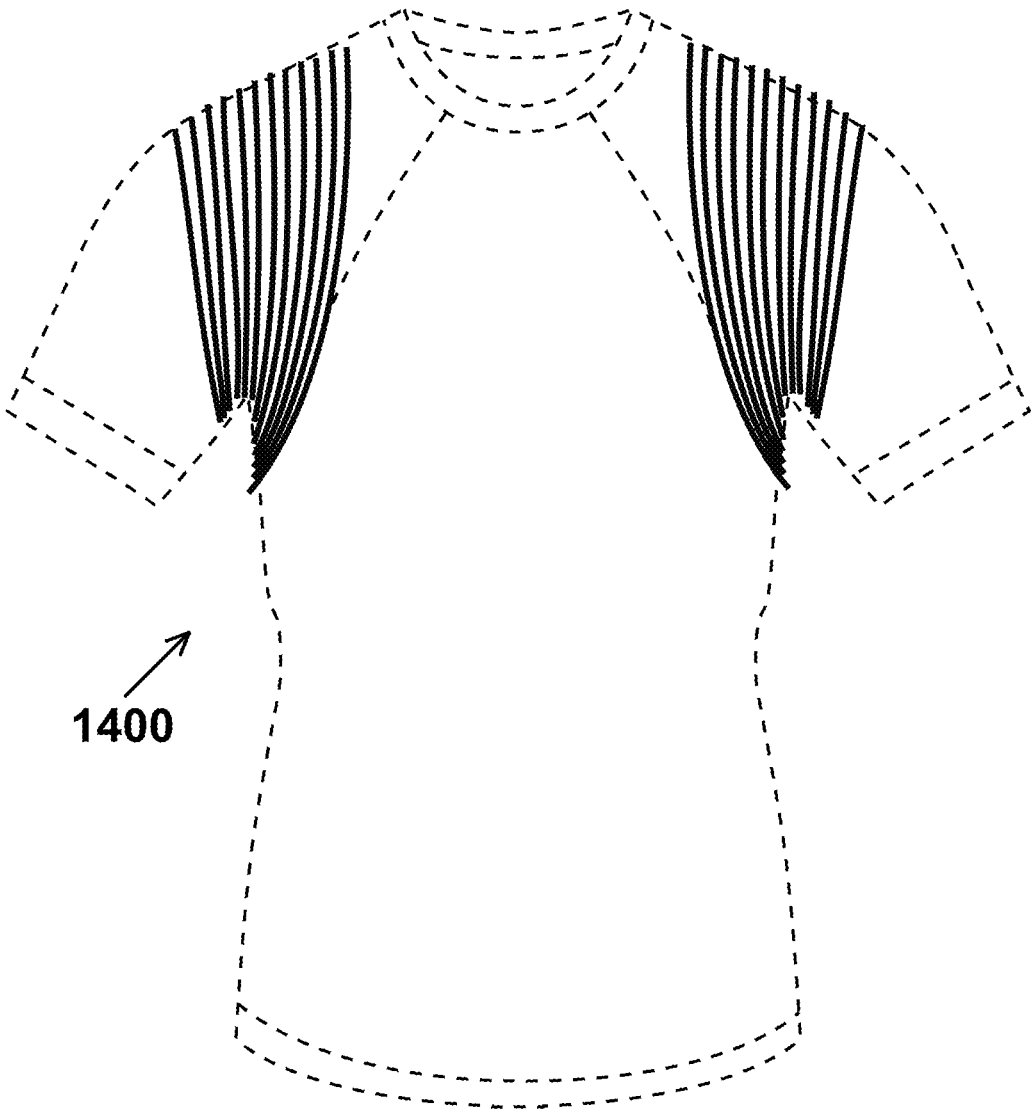
FIGS. 14A-14I are schematic illustrations of various views of a shirt, in accordance with some demonstrative embodiments of the present invention.
Figure 14B:
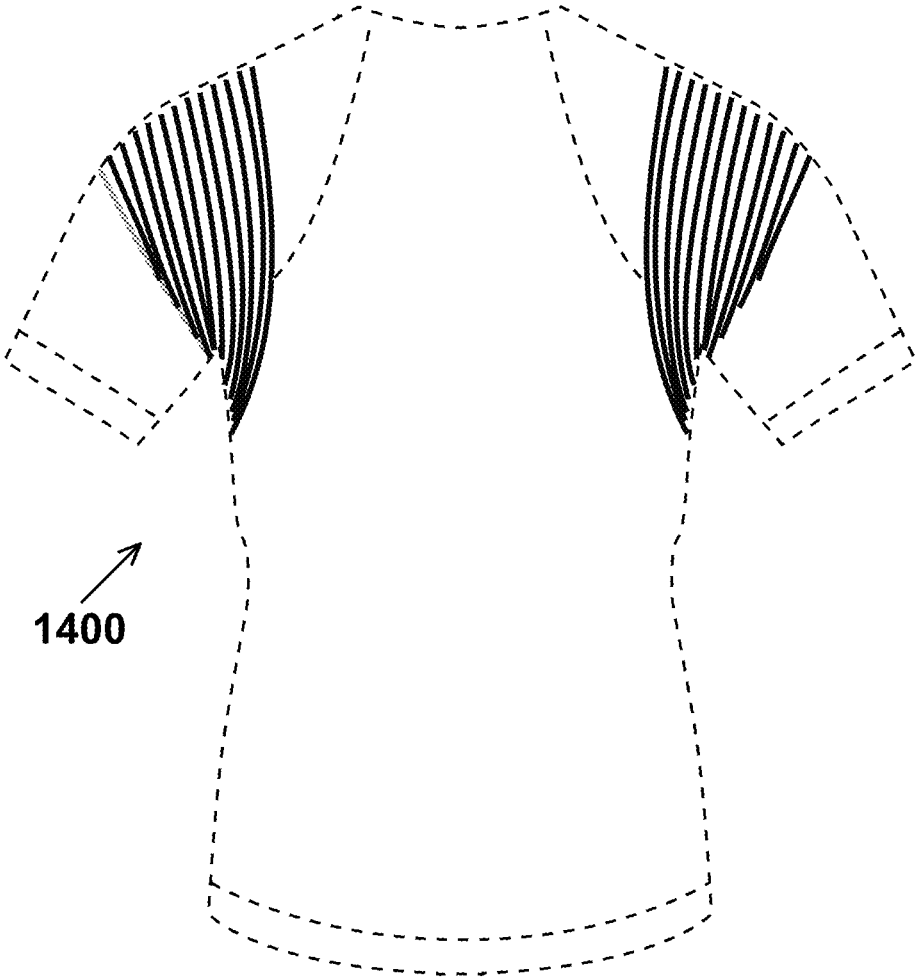
Figure 14C:
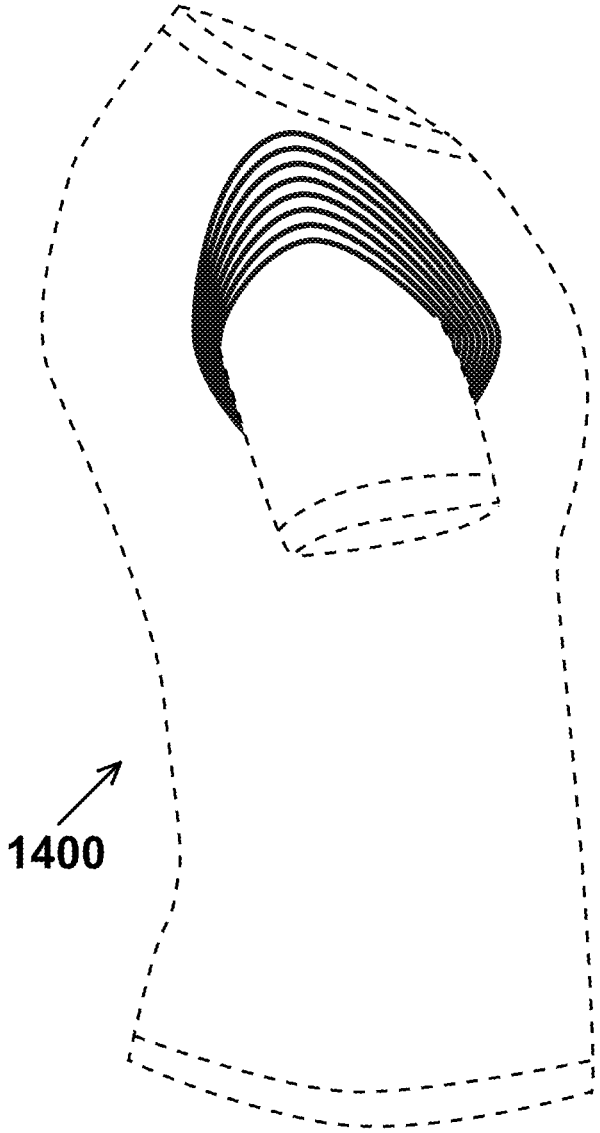
Figure 14D:
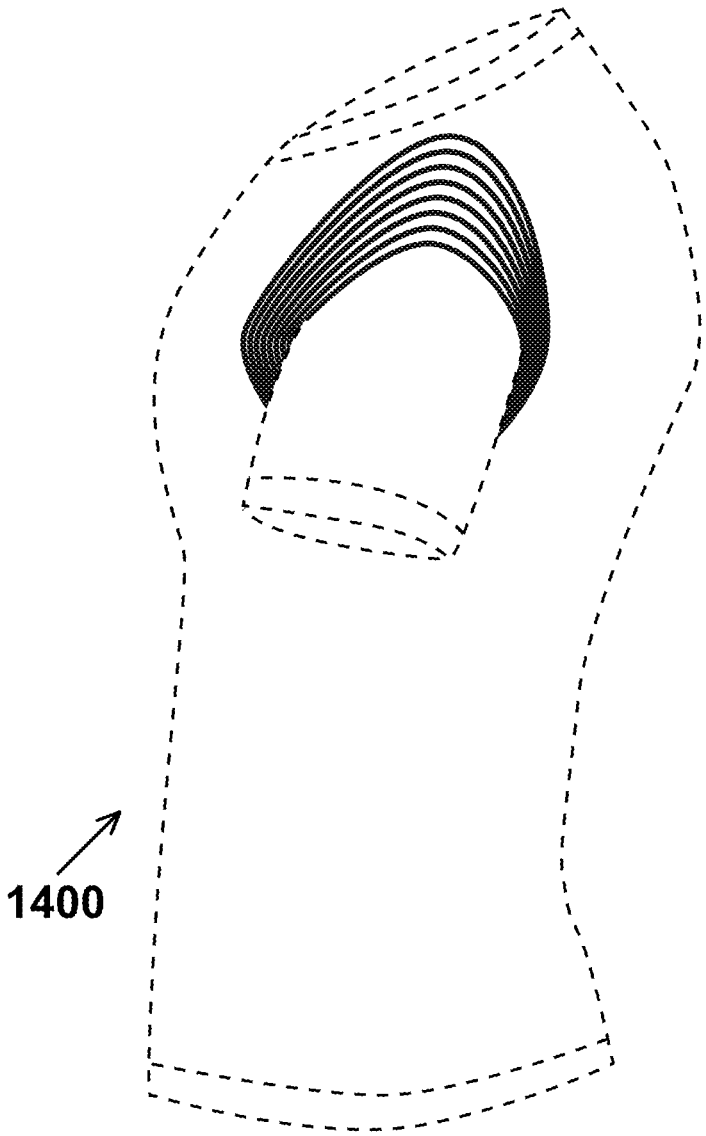
Figure 14E:
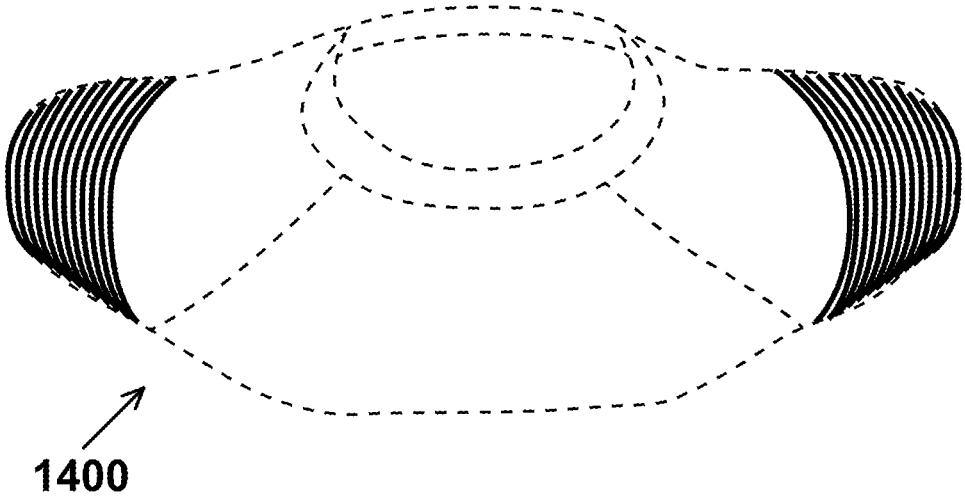
Figure 14F:
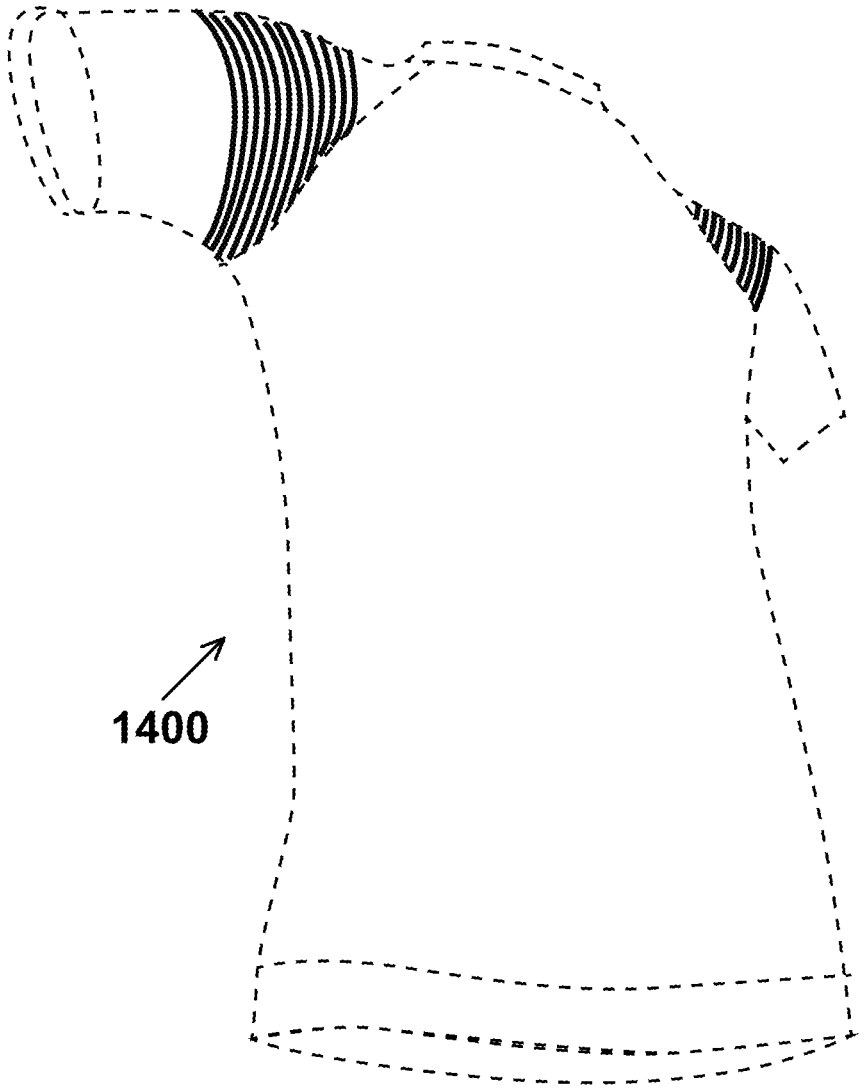
Figure 14G:
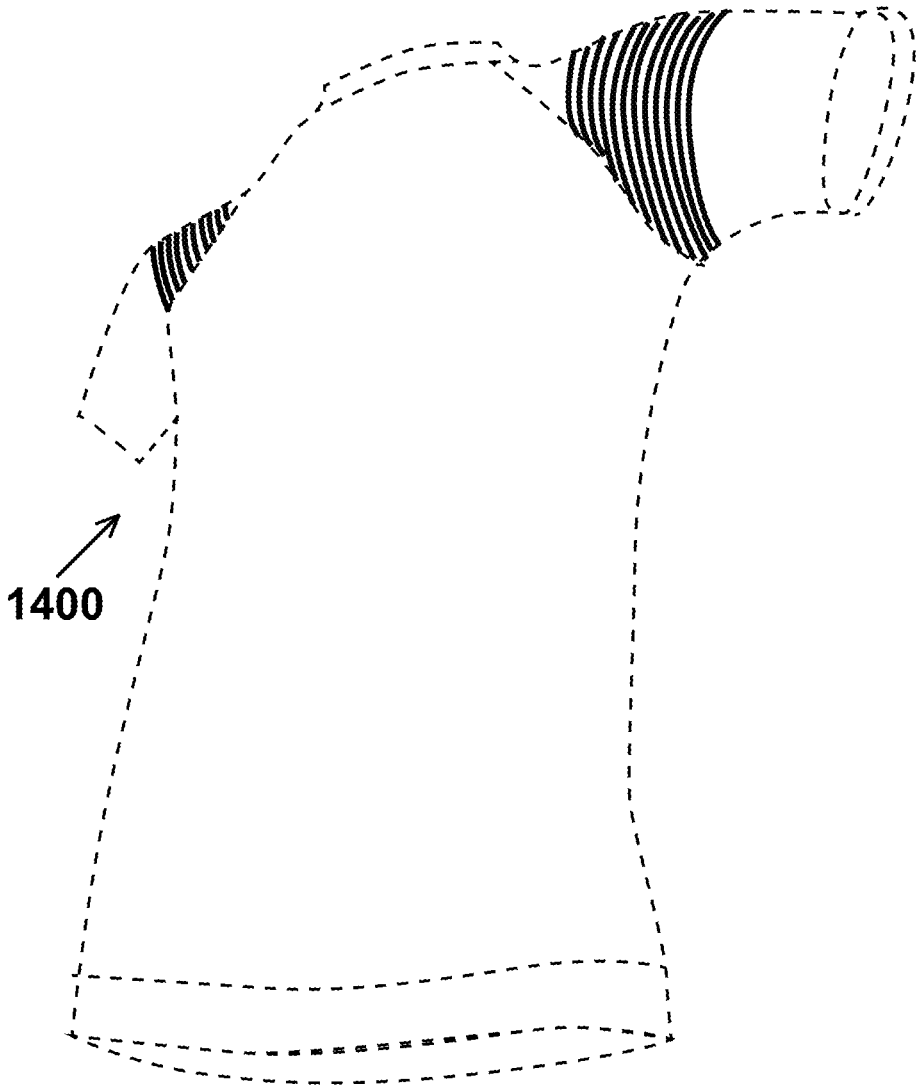
Figure 14H:
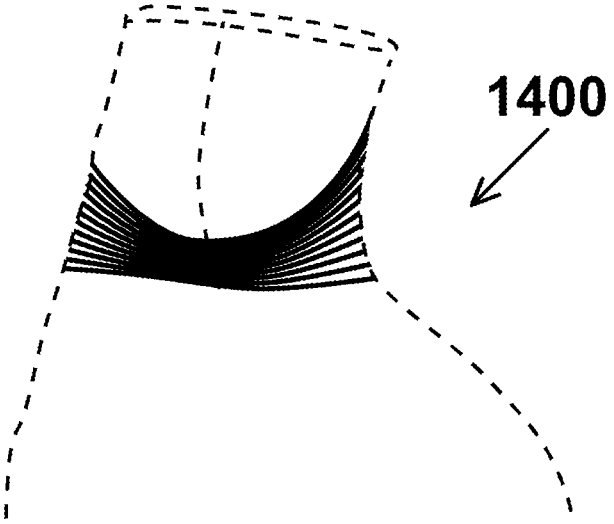
Figure 14I:
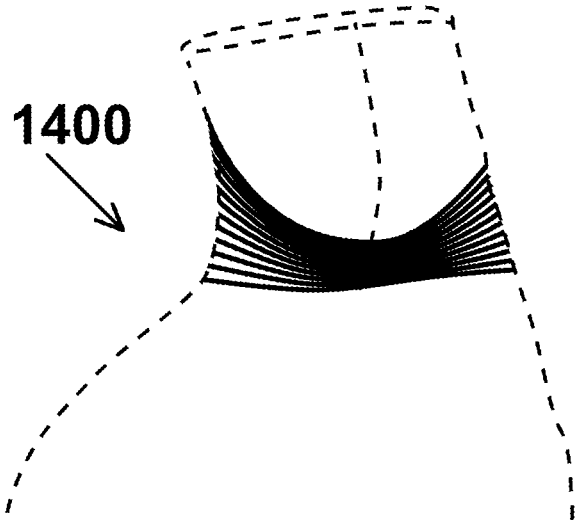

Reference is made to FIGS. 14A-14I, which are schematic illustrations of various views of a shirt 1400, in accordance with some demonstrative embodiments of the present invention. Shirt 1400 may be, for example, a sports shirt, a running shirt, a soccer shirt, a tennis shirt, or the like. In particular, FIG. 14A shows a front view of shirt 1400; FIG. 14B shows a rear view thereof; FIG. 14C shows a right side view thereof; FIG. 14D shows a left side view thereof; FIG. 14E shows a top perspective view thereof; FIG. 14F shows a first perspective view thereof; FIG. 14G shows a second perspective view thereof; FIG. 14H shows a view from under the right side armpit thereof; and FIG. 14I shows a view from under the left side armpit thereof.

Figure 15A:
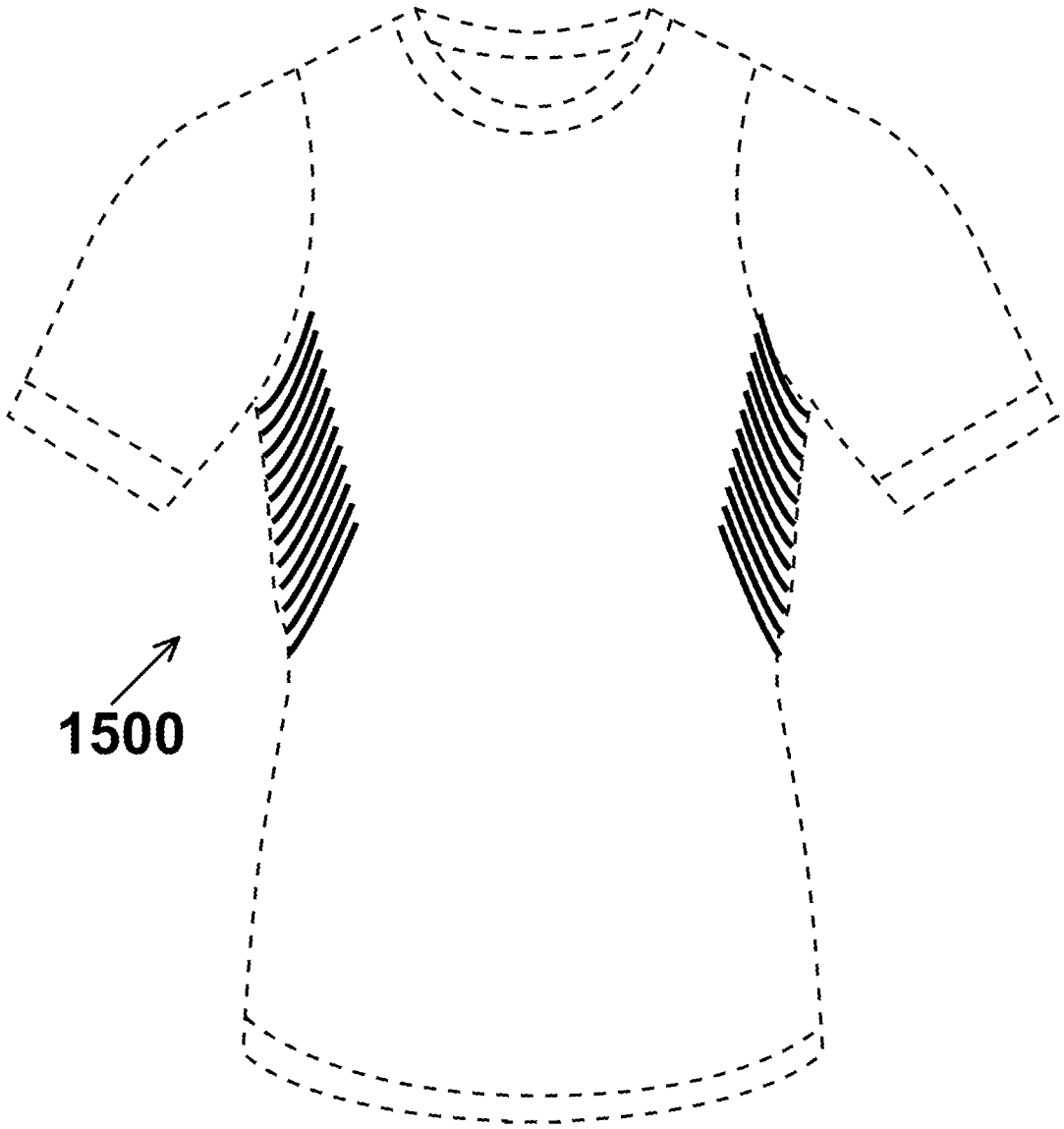
FIGS. 15A-15I are schematic illustrations of various views of another shirt, in accordance with some demonstrative embodiments of the present invention.
Figure 15B:
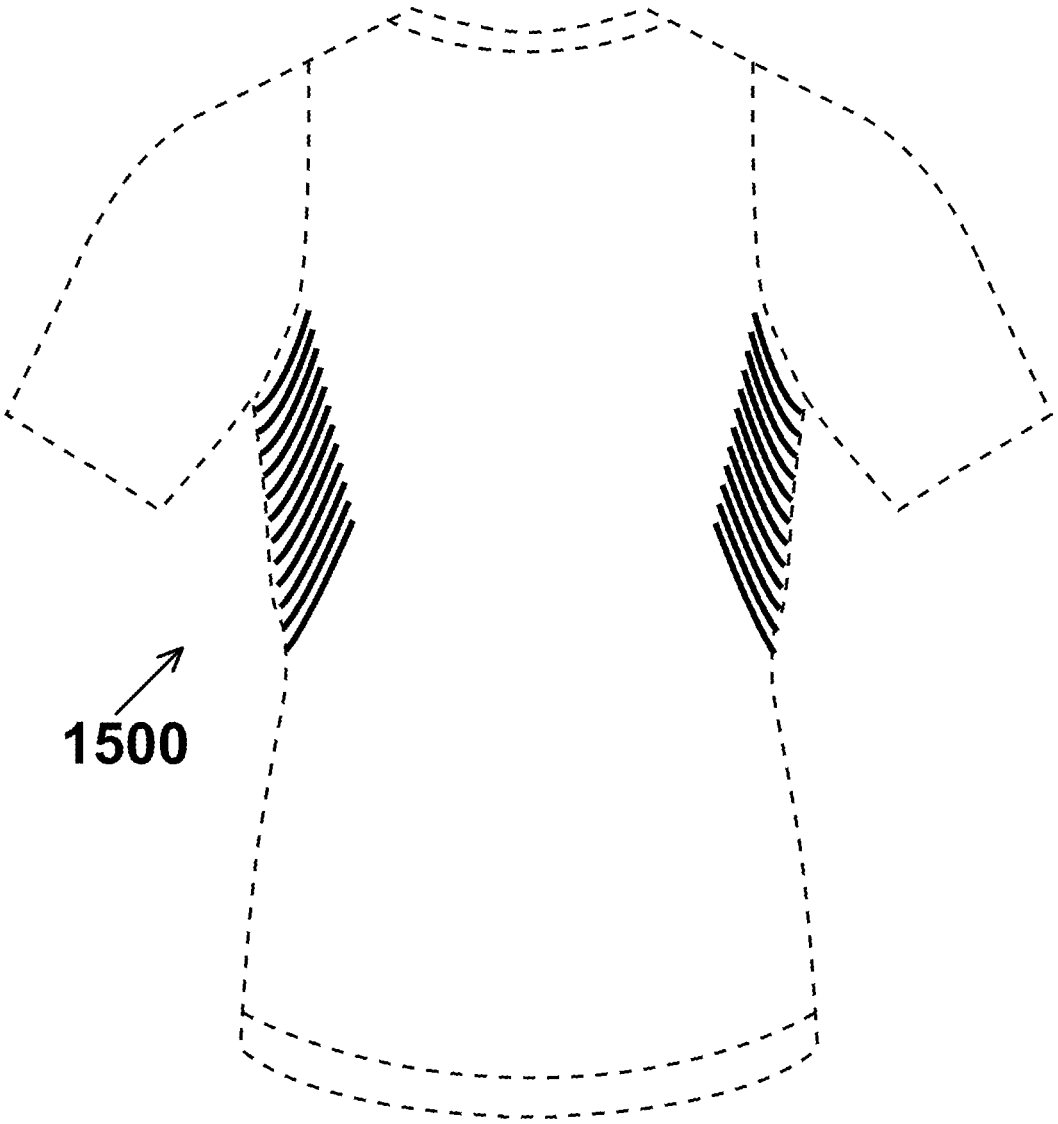
Figure 15C:
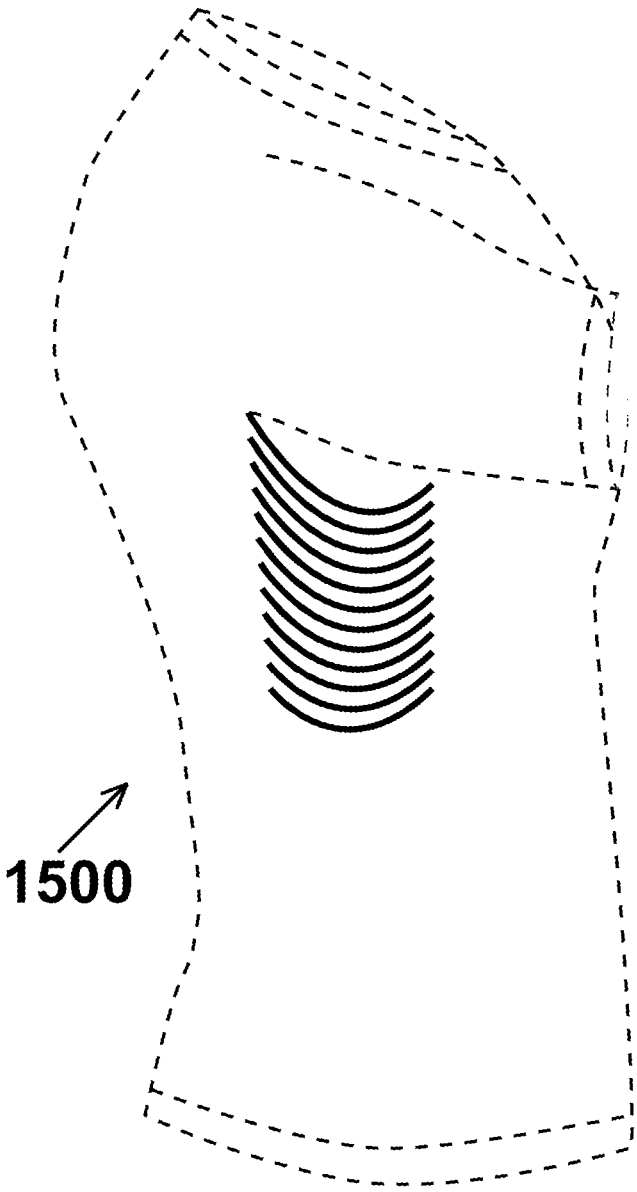
Figure 15D:
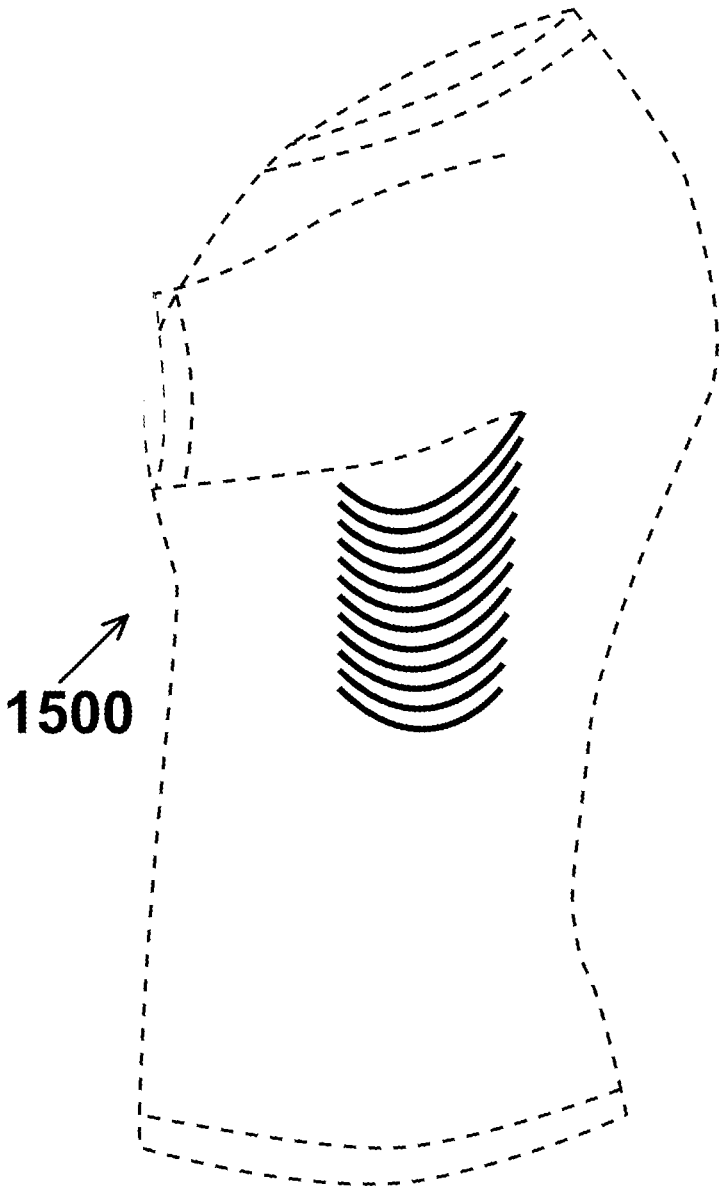
Figure 15E:
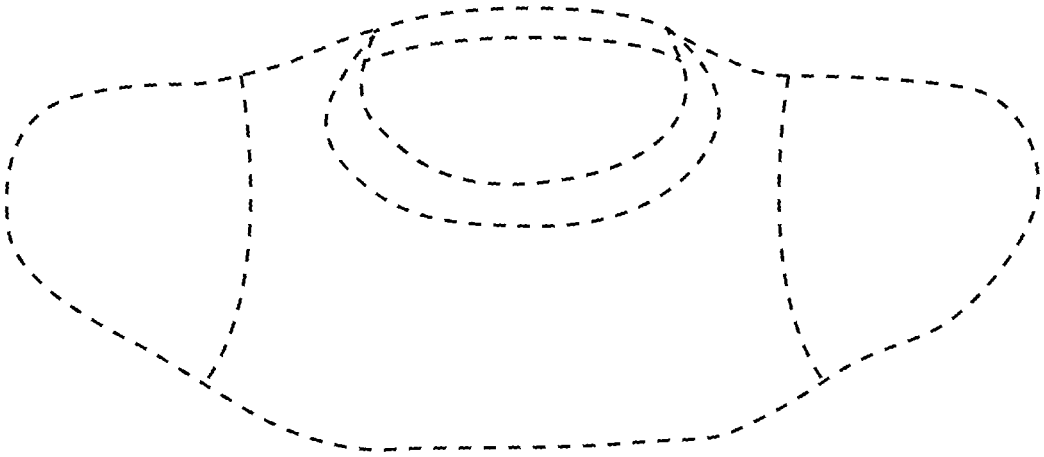
Figure 15F:
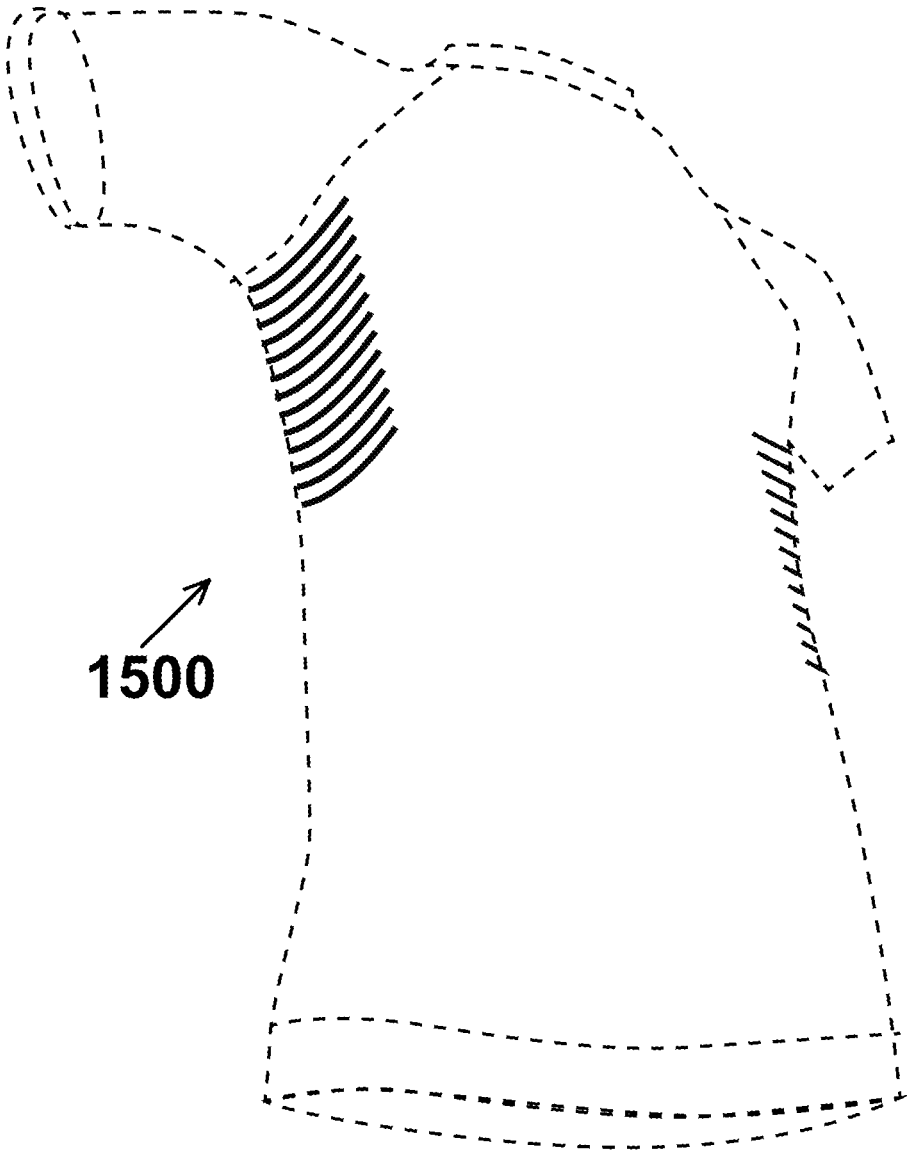
Figure 15G:
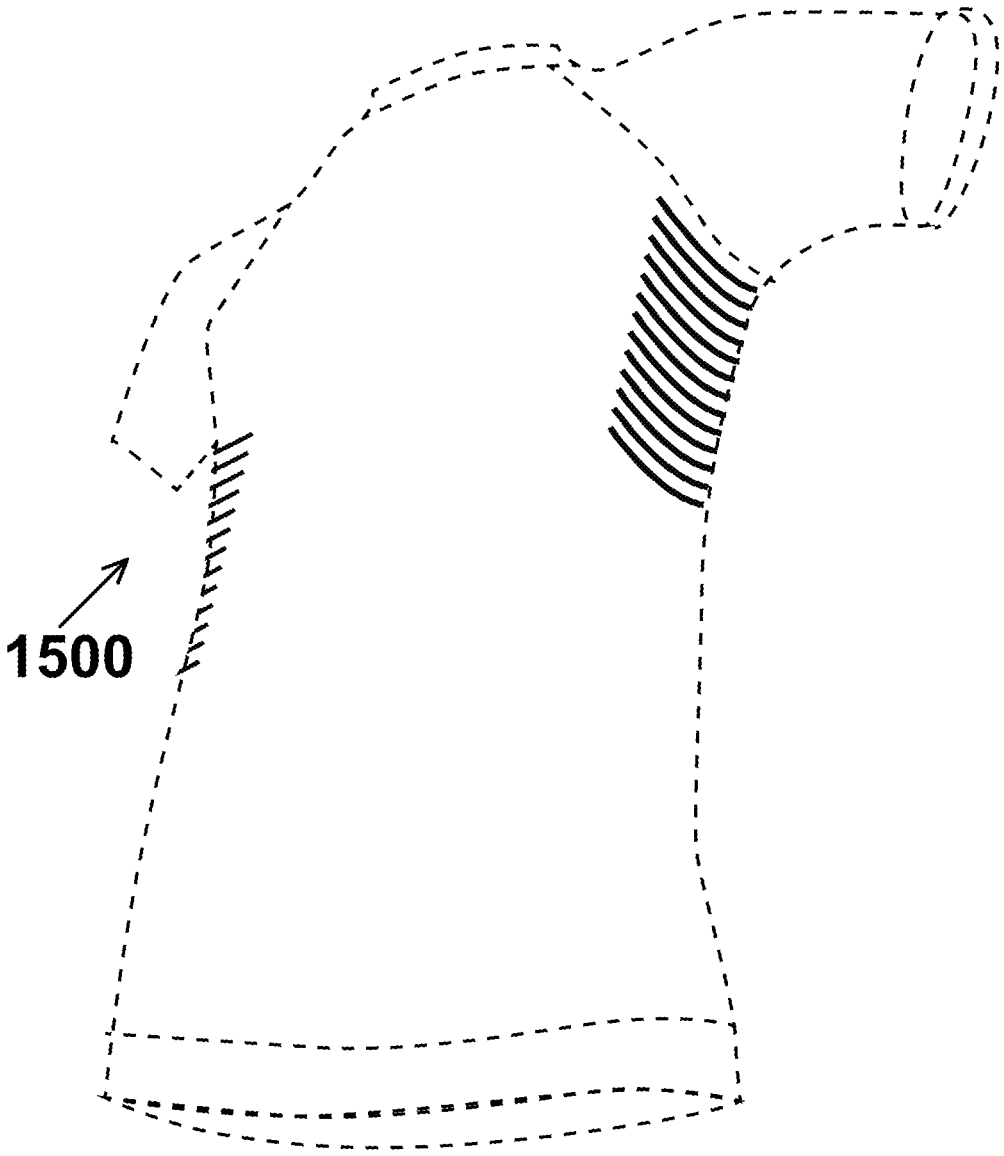
Figure 15H:
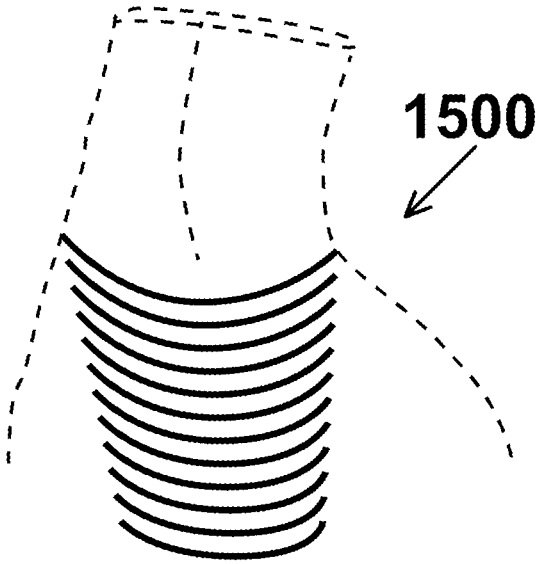
Figure 15I:
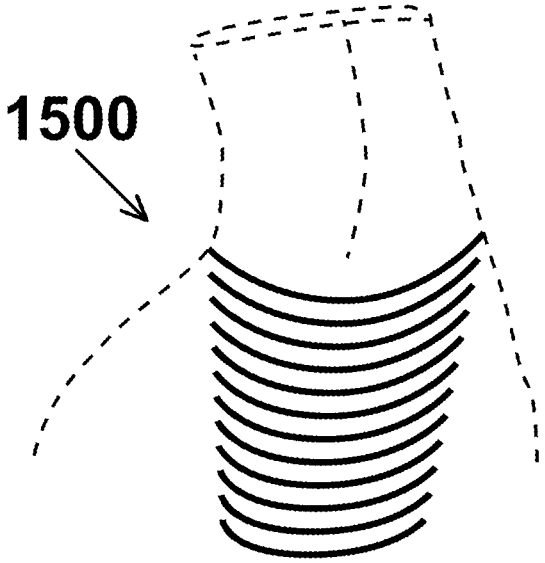

Reference is made to FIGS. 15A-15I, which are schematic illustrations of various views of a shirt 1500, in accordance with some demonstrative embodiments of the present invention. Shirt 1500 may be, for example, a sports shirt, a basketball shirt, or the like. In particular, FIG. 15A shows a front view of shirt 1500; FIG. 15B shows a rear view thereof; FIG. 15C shows a right side view thereof; FIG. 15D shows a left side view thereof; FIG. 15E shows a top perspective view thereof; FIG. 15F shows a first perspective view thereof; FIG. 15G shows a second perspective view thereof; FIG. 15H shows a view from under the right side armpit thereof; and FIG. 15I shows a view from under the left side armpit thereof.

Figure 16A:
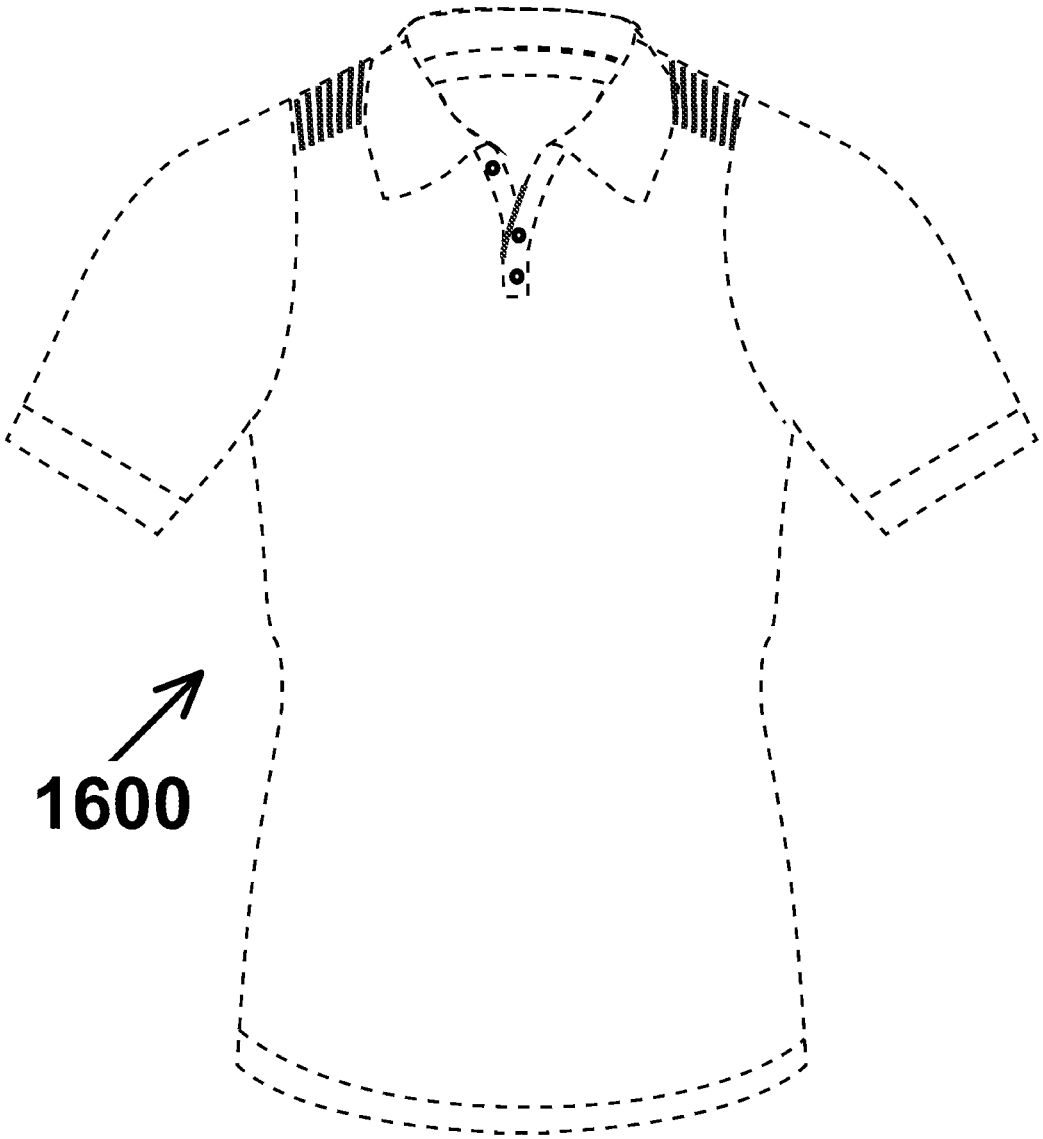
FIGS. 16A-16I are schematic illustrations of various views of still another shirt, in accordance with some demonstrative embodiments of the present invention.
Figure 16B:
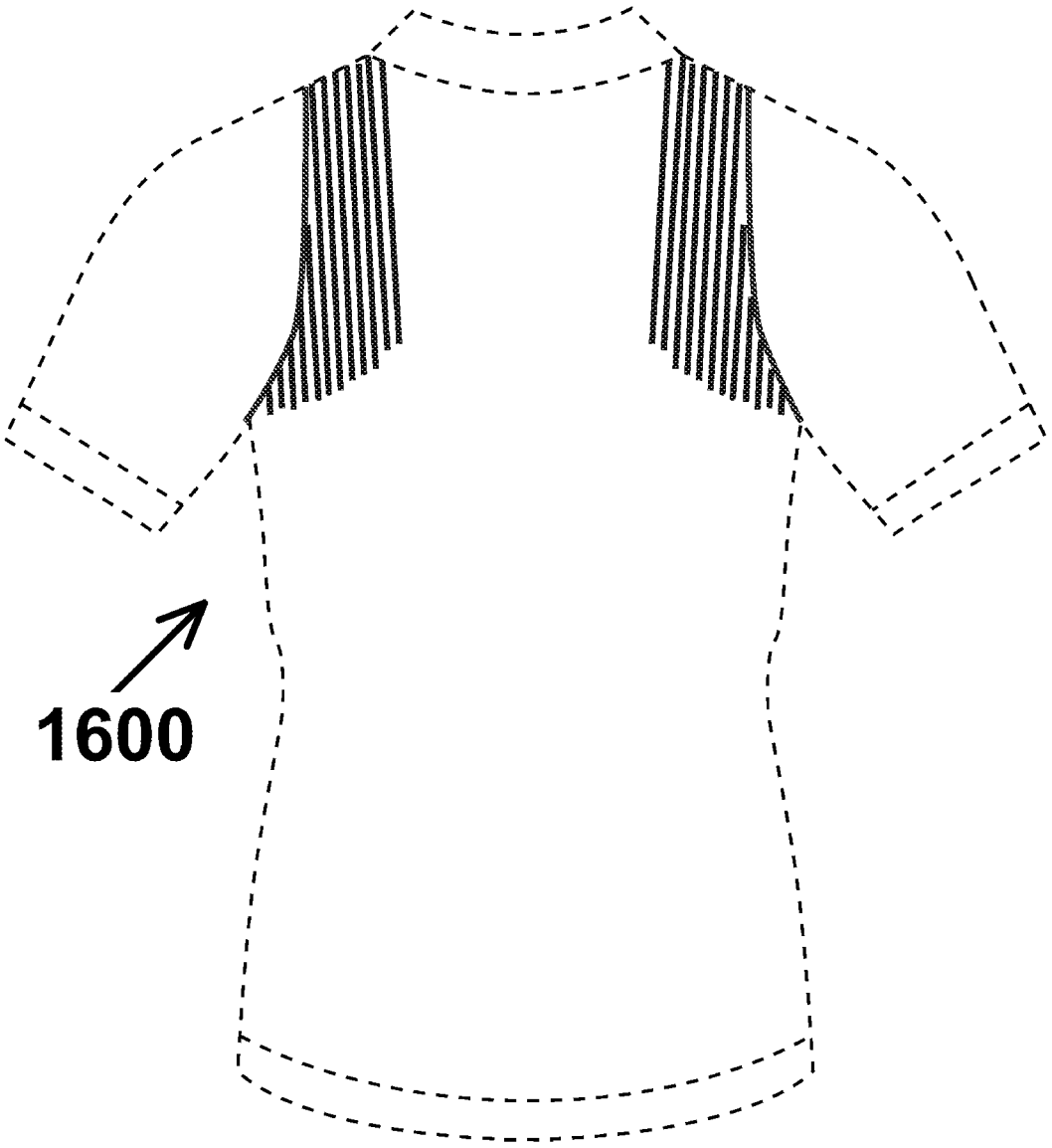
Figure 16C:
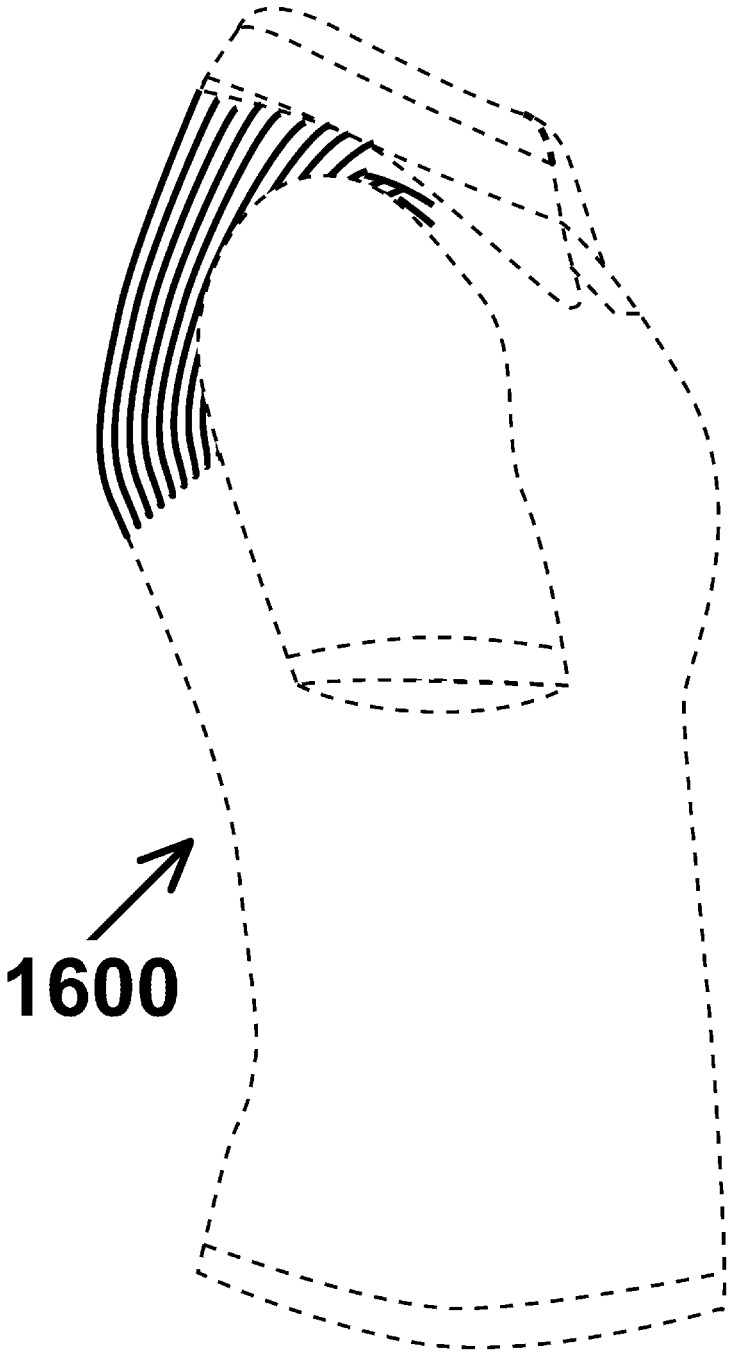
Figure 16D:
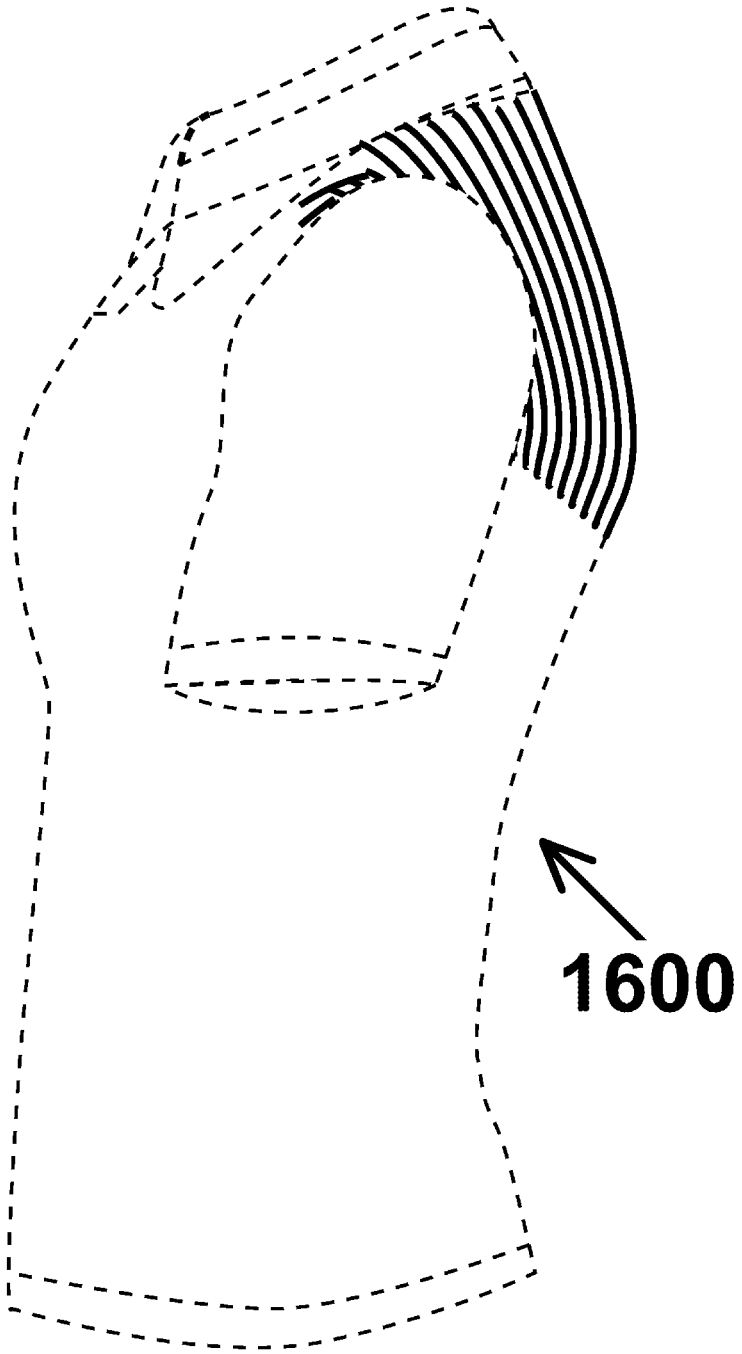
Figure 16E:
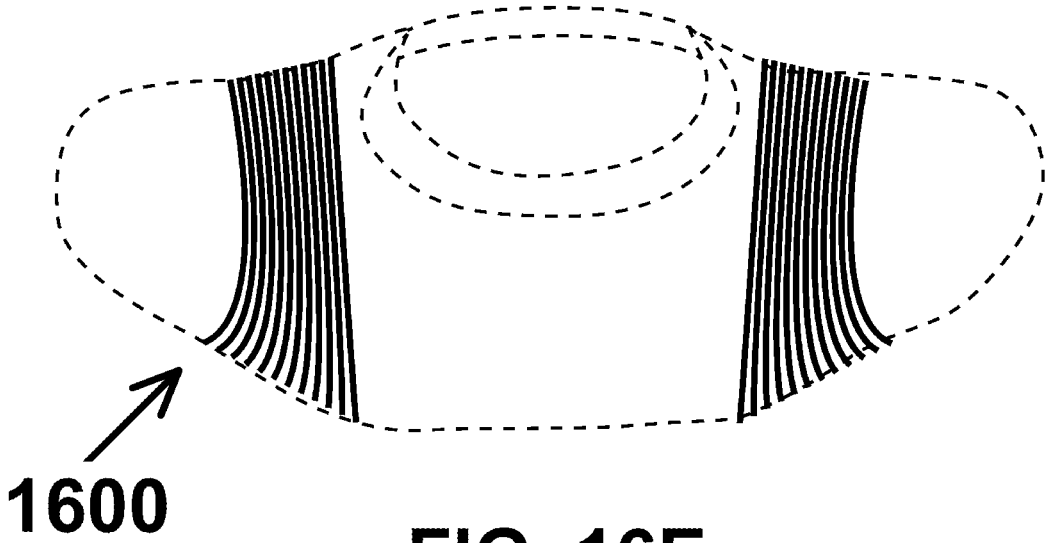
Figure 16F:
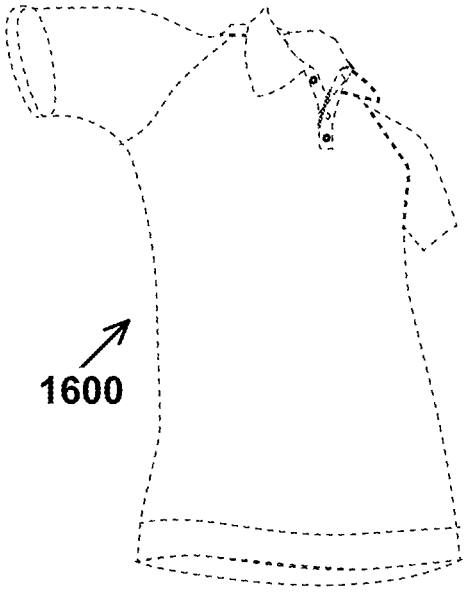
Figure 16G:
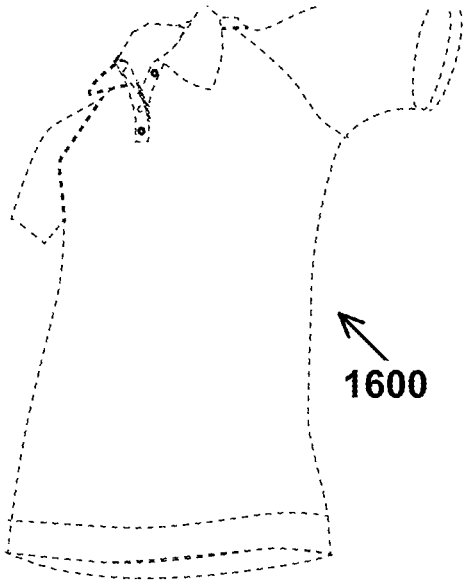
Figure 16H:
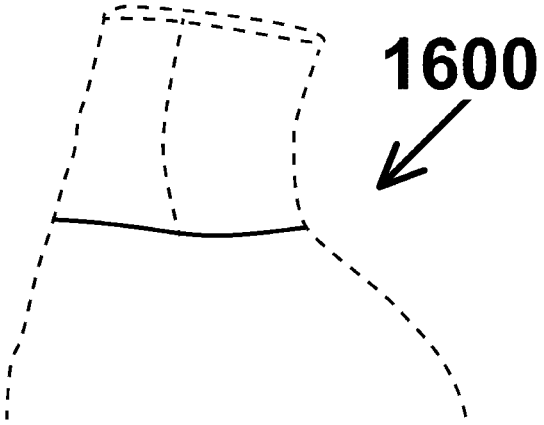
Figure 16I:
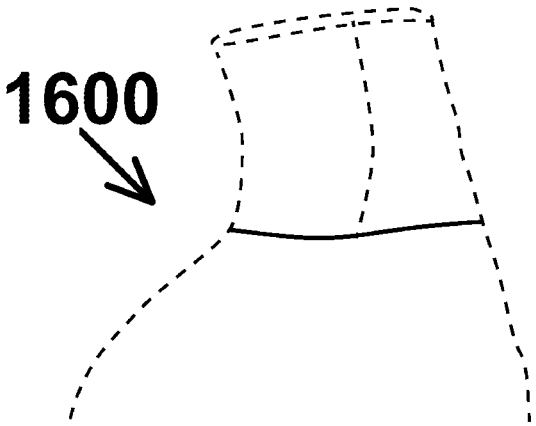

Reference is made to FIGS. 16A-16I, which are schematic illustrations of various views of a shirt 1600, in accordance with some demonstrative embodiments of the present invention. Shirt 1600 may be, for example, a sports shirt, a golf shirt (e.g., for golf players), or the like. In particular, FIG. 16A shows a front view of shirt 1600; FIG. 16B shows a rear view thereof; FIG. 16C shows a right side view thereof; FIG. 16D shows a left side view thereof; FIG. 16E shows a top perspective view thereof; FIG. 16F shows a first perspective view thereof; FIG. 16G shows a second perspective view thereof; FIG. 16H shows a view from under the right side armpit thereof; and FIG. 16I shows a view from under the left side armpit thereof.

Although portions of the discussion herein and/or portions of the drawings, may relate to (or may depict), for demonstrative purposes, a short-sleeve shirt or a sports shirt, the present invention is not limited in this regard; and embodiments of the present invention may comprise, and may be used in conjunction with, other types of garments or articles of clothing, for example, long-sleeve shirt, medium-sleeve shirt, sleeveless or sleeve-less shirts, sweatshirts, vests, dresses, form-fitting shirts or clothes, loose shirts or clothes, T-shirts or Tee-shirts, sport shirts, sports shirts, performance shirts, athletic shirts, polo shirt, rugby shirt, Henley shirt, Jersey shirt, baseball shirt, a shirt having a collar, a collared shirt, a shirt without a collar, a collar-less shirt, a shirt having a hood, a "hoodie" garment or "hoody" garment or hooded shirt or hooded sweatshirt, camp shirt, dress shirt, A-shirt, singlet, camisole, tunic, a night shirt, a night gown, a pajama shirt, a "onesie" garment or a "diaper shirt" for babies or toddlers or infants, a jacket, a coat, outwear, and/or other suitable garments.

In accordance with some embodiments of the present invention, a shirt comprises: a right-side sleeve; a left-side sleeve; a front area to cover a chest of a wearer; a back area to cover a back of the wearer; a right-side decoupling region to decouple movement of the right-side sleeve from movement of the front area and the back area; a left-side decoupling region to decouple movement of the left-side sleeve from movement of the front area and the back area.

In some embodiments, the right-side decoupling region and the left-side decoupling region are formed of fabric having a first type of thread knitting; and the right-side sleeve, the left-side sleeve, the front area and the back area are formed of fabric having a second, different, type of thread knitting.

In some embodiments, the right-side decoupling region and the left-side decoupling region are formed of fabric that is knitted as shear-and-opaque; and the right-side sleeve, the left-side sleeve, the front area and the back area are formed of fabric knitted as non shear-and-opaque.

In some embodiments, the right-side decoupling region and the left-side decoupling region are formed of fabric that is knitted as shear-and-opaque and comprises: a primary yarn having a first thread-count and a first elasticity value; and a secondary yarn that has a second, increased thread-count and a second, increased elasticity value.

In some embodiments, the right-side decoupling region comprises: a front side and a back side, wherein the area of the front side of the right-side decoupling region is generally identical to the area of the back side of the right-side decoupling region; wherein the left-side decoupling region comprises: a front side and a back side, wherein the area of the front side of the left-side decoupling region is generally identical to the area of the back side of the left-side decoupling region.

In some embodiments, the right-side decoupling region comprises: a front side and a back side, wherein the area of the front side of the right-side decoupling region is smaller than the area of the back side of the right-side decoupling region; wherein the left-side decoupling region comprises: a front side and a back side, wherein the area of the front side of the left-side decoupling region is smaller than the area of the back side of the left-side decoupling region;

In some embodiments, the right-side decoupling region comprises: a front side and a back side, wherein the area of the front side of the right-side decoupling region is greater than the area of the back side of the right-side decoupling region; wherein the left-side decoupling region comprises: a front side and a back side, wherein the area of the front side of the left-side decoupling region is greater than the area of the back side of the left-side decoupling region;

In some embodiments, the right-side decoupling region and the left-side decoupling region are formed of fabric that is knitted as accordion component which expands or shrinks in response to movement of the wearer.

In some embodiments, the right-side decoupling region is formed of fabric that is knitted as accordion component such that the area of the right-side decoupling region expands or shrinks in response to movement of the wearer; wherein the left-side decoupling region is formed of fabric that is knitted as accordion component such that the area of the left-side decoupling region expands or shrinks in response to movement of the wearer.

In some embodiments, the right-side decoupling region is formed of fabric that is knitted as a folded accordion component which has a plurality of folding fabric panels that protrude outwardly relative to a plane that comprises the chest area, wherein the area of the right-side decoupling region expands or shrinks in response to movement of the wearer; wherein the left-side decoupling region is formed of fabric that is knitted as a folded accordion component which has a plurality of folding fabric panels that protrude outwardly relative to the plane that comprises the chest area, wherein the area of the left-side decoupling region expands or shrinks in response to movement of the wearer.

In some embodiments, the right-side decoupling region comprises a front side and a back side; wherein each one of the front side and the back side of the right-side decoupling region comprises fabric knitted as expanding/shrinking accordion component that is confined by the following borders: (A) a first line (251-252) defined between a first point (251) and a second point (252); wherein the first point (251) is located between a neck area of the shirt and a shoulder-arm connection area of the shirt; wherein the second point (252) is located (i) between said shoulder-arm connection area and a top portion of an arm region of the shirt, and (ii) below said shoulder-arm connection area of the shirt; (B) a second line (252-253) connecting the second point (252) to a third point (253), wherein the third point (253) is located at the bottom side of the right-side sleeve 201, wherein the third point (253) is located at the top-third of the bottom side of the right-side sleeve; wherein the third point (253) is located between: (a) a fourth point (254) that is located under a right armpit region of the shirt, and (b) a fifth point (255) that is the lowest point of the right-side sleeve; wherein the third point (253) is closer to the fourth point (254) than to the fifth point (255); (C) a third line connecting the third point (253) and the fourth point (254); (D) a fourth line (254-256) connecting the fourth point (254) downwardly to a sixth point (256), wherein the sixth point (256) is located along the right-side contour or the shirt, wherein a distance between the fourth point (254) and the sixth point (256) is equal-or-greater than a distance between the second point (252) and the third point (253); (E) a fifth, curved line (256-251) connecting the sixth point (256) and the first point (251).

In some embodiments, the right-side decoupling region comprises a front side and a back side; wherein the front side of the right-side decoupling region comprises fabric knitted as expanding/shrinking accordion component that is confined by the following borders: (A) a first line (1051-1052) defined between a first point (1051) and a second point (1052), wherein the first line (1051-1052) sits on a right shoulder-area of the shirt, wherein the first point (1051) is located at the left-most corner of the front side of a collar area (1057) of the shirt, wherein the second point (1052) is located on the right shoulder-area of the shirt at approximately 40 to 60 percent of the distance between (i) the first point (1051) and (ii) another point (1058) at which the shoulder-area of the shirt connects with an arm-area of the shirt; (B) a second line (1052-1053) defined between the second point (1052) and a third point (1053), wherein the third point (1053) is located along a curved line that connects (a) the second point (1052) with (b) an armpit point (1055) which is located immediately under the right armpit; wherein a length of the second line (1052-1053) is in a range of 10 to 30 percent of the length of another line (1052-1055) that connects the second point (1052) with the armpit point (1055), (C) a third line (1053-1054) that connects the third point (1053) and a fourth point (1054), wherein the third line (1053-1054) extends diagonally and at a slanting in the range of 0 to 10 degrees relative to the first line (1051-1052) which connects the first point (1051) and the second point (1052), wherein the fourth point (1054) is located on a border of the collar area (1057); (D) a fourth line (1054-1051) that connect the fourth point (1054) and the first point (1051) along the border of the collar area (1057).

In some embodiments, the right-side decoupling region comprises a front side and a back side; wherein the back side of the right-side decoupling region comprises fabric knitted as expanding/shrinking accordion component that is confined by the following borders: (A) a first line (1061-1062) defined between a first point (1061) and a second point (1062), wherein the first line (1061-1062) sits on a shoulder of the wearer, wherein the first point (1061) is located at the left-most corner of a back side of a collar area (1067) of the shirt, wherein the first point (1061) is located at a back upper-left corner of a shoulder-neck connection area of the shirt, wherein the second point (1052) is located on the right shoulder-area of the shirt at approximately 40 to 60 percent of the distance between (i) the first point (1051) and (ii) another point (1058) at which the shoulder-area of the shirt connects with an arm-area of the shirt; (B) an elongated line (1062-1063-1064) defined by the second point (1062) and a third point (1063) and a fourth point (1064), wherein the elongated line (1062-1063-1064) comprises a second line (1062-1063) that is connected to a third line (1063-1064) at an angle in a range of 0 to 20 degrees; wherein the third point (1063) is located along a curved line that connects the second point (1062) with the fourth point (1064) which is located under an armpit area of the shirt; wherein the fourth point (1064) is the lowest connection point of the right-side sleeve with the chest area of the shirt; wherein a length of the second line (1062-1063) is in a range of 40 to 75 percent of the length of the elongated line (1062-1063-1064); (C) a J-shaped line (1064-1065-1061) that extends from the fourth point (1064) through a fifth point (1065) to the first point (1061), firstly extending diagonally via a first line-segment (1064-1065) which is slanted at an angel in a range of 0 to 10 degrees relative to the first line (1061-1062), and then continuing via a second line-segment (1061-1065) which is at an angel in a range of 100 to 150 degrees relative to the first line-segment (1064-1065); wherein an angel between the first line (1061-1062) and the second line-segment (1061-1065) is in a range of 60 to 85 degrees, wherein the second line-segment (1061-1065) is slanted at an angle in a range of 0 to 10 degrees relative to the second line (1062-1063).

In some embodiments, the right-side decoupling region comprises a front side and a back side; wherein the area of the front side of the right-side decoupling region is in a range of 10 to 33 percent relative to the area of the back side of the right-side decoupling region.

In some embodiments, the right-side decoupling region comprises a front side and a back side; wherein the height north-to-south of the front side of the right-side decoupling region is in a range of 10 to 33 percent relative to the height north-to-south of the back side of the right-side decoupling region.

In some embodiments, the right-side decoupling region comprises a front side and a back side; wherein the front side of the right-side decoupling region comprises fabric knitted as expanding/shrinking accordion component that is confined by the following borders: (A) a first line (1251-1252) that connects (i) a first point (1251) which is located immediately below a right armpit, and (ii) a second point (1252) which is located north-east relative to the first point (1251), wherein the second point (1252) is located along a line that continues a lower edge line (1251-1255) of the right-side sleeve towards a right-most corner (1258) of a collar area (1259) of the shirt, wherein the first line (1251-1252) is in a range of 15 to 33 percent relative to the length of a lower edge (1251-1255) of the right-side sleeve 1202; (B) a second line (1251-1254) which is part of a right-side contour of the shirt, wherein the second line (1251-1254) extends southwardly and has a length in a range of 100 to 250 percent relative to the length of the lower edge line (1251-1255) of the right-side sleeve; (C) an elongated line (1252-1253-1254) comprising a first segment (1252-1253) and a second segment (1253-1254), wherein the first segment (1252-1253) connects a second point (1252) and a third point (1253), wherein the second segment (1253-1254) connects the third point (1253) and a fourth point (1254), wherein the third point (1253) is located at a distance from the second line (1251-1254), the distance being in a range of 100 to 200 percent relative to the length of the first line (1251-1252); wherein the second segment (1253-1254) extends north-east from the fourth point (1254), whereas the first segment (1252-1253) continues north-west from the third point (1253); wherein the length of the second line (1251-1254) is in a range of 20 to 50 percent of the total height north-to-south of the right-side contour of the shirt.

In some embodiments, the right-side decoupling region comprises a front side and a back side; wherein the back side of the right-side decoupling region comprises fabric knitted as expanding/shrinking accordion component that is confined by the following borders: (A) a first line (1261-1262) which connects (a) a first point (1261) that is located immediately below a left armpit of the shirt, and (b) a second point (1262) which is located north-east relative to the first point (1261), wherein the second point (1262) is located along a line that continues a lower edge line (1261-1265) of the right-side sleeve towards the left-most corner (1268) of a collar area (1269) of the shirt, wherein a length of the first line (1261-1262) is in a range of 80 to 133 percent relative to a length of the lower edge line (1261-1265) of sleeve 1202; (B) a second line (1261-1264) which is part of a right-side contour of the shirt, wherein the second line (1261-1264) extends southwardly and has a length in a range of 100 to 250 percent relative to the length of the lower edge line (1261-1265) of the right-side sleeve; (C) an elongated line (1262-1263-1264) comprising a first segment (1262-1263) and a second segment (1263-1264), wherein the first segment (1262-1263) connects a second point (1262) and a third point (1263), wherein the second segment (1263-1264) connects the third point (1263) and a fourth point (1264), wherein the third point (1263) is located at a distance from the second line (1261-1264), the distance being in a range of 90 to 140 percent relative to the length of the first line (1251-1252); wherein the second segment (1263-1264) extends north-east from the fourth point (1264), whereas the first segment (1262-1263) continues north-west from the third point (1263); wherein the length of the second line (1261-1264) is in a range of 20 to 50 percent of the total height north-to-south of the right-side contour of the shirt.

In some embodiments, the right-side decoupling region comprises a front side and a back side; wherein the area of the front side of the right-side decoupling region is in a range of 25 to 50 percent relative to the area of the back side of the right-side decoupling region.

In some embodiments, the right-side decoupling region comprises a front side and a back side; wherein the width east-to-west of the front side of the right-side decoupling region is in a range of 25 to 50 percent relative to the width east-to-west of the back side of the right-side decoupling region.

Applicants have realized that in accordance with some embodiments of the present invention, the particular ratios, percentage ratios, sizes, slanting, edges and/or borders, as well as their relative position and/or location and/or connections, may enable the shirt(s) of the present invention to be advantageous and to provide the desired de-coupling of arm-regions from chest-region (or trunk-region or torso-region) of the shirt. Other suitable dimensions or ratios may be utilized, in conjunction with the present invention.

Some embodiments of the present invention may comprise, or may utilize, an automated or semi-automated or partially-automated process or system, or a machine-implemented process or system, or a computerized process or system, in order to produce the shirt or garment described herein and/or any particular component(s) or region(s) of such shirts or garments. Such system or process may utilize for example, a programmable knitting machine, a computerized knitting machine, a computer, a processor, a controller, an Integrated Circuit (IC), logic units, memory units, storage units, input units (e.g., keyboard, touch-screen, mouse, touch-pen, stylus), output units (e.g., monitor, screen, touch-screen), a power source, wired communication links, wireless communication links, an Operating System (OS), drivers, applications, as well as other suitable hardware components and/or software modules; which may be general-purpose components, or may be specific components that may be particularly tailored to achieve the particular goals or to perform the particular operations described herein. In some embodiments, the system or method may utilize a non-generic computer or a non-general-purpose computer, or may use a dedicated non-computer device (e.g., a dedicated programmable knitting machine or knitting system).

Some or all of the operations of such method(s) may be performed automatically or partially-automatically or semi-automatically, by a suitable machine or production line or manufacturing line; which may comprise, for example, robotic arms, automated knitting machine or sewing machine, machine-controllable clothes-making machine or device, and/or other modules or units. Optionally, a computerized platform or a computer may be used, to control and/or manage the production of one or more components or of the entire product, the fastener and/or the bra. In some implementations, such computer or computing device may comprise, for example, a processor, a logic circuit, an integrated circuit, an input unit (keyboard, mouse, stylus), an output unit (e.g., screen or monitor), memory unit, storage unit, wireless communication modules, wired communication modules, power source, operating system, drivers, applications, and/or other suitable hardware components and/or software modules.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A shirt comprising:

a right-side sleeve;

a left-side sleeve;

a front area to cover a chest of a wearer;

a back area to cover a back of the wearer;

a right-side decoupling region to decouple movement of the right-side sleeve from movement of the front area and the back area such that movement of the right-side sleeve, which is recreated by the wearer, that does not cause the movement of said front area and said back area;

wherein the right-side decoupling region entirely separates between (a) the right-side sleeve, and (b) said front area;

wherein the right-side decoupling region entirely separates between (c) the right-side sleeve, and (d) said back area;

a left-side decoupling region to decouple movement of the left-side sleeve from movement of the front area and the back area such that movement of the right-side sleeve, which is recreated by the wearer, that does not cause the movement of said front area and said back area;

wherein the left-side decoupling region entirely separates between (A) the left-side sleeve, and (B) said front area;

wherein the left-side decoupling region entirely separates between (C) the left-side sleeve, and (D) said back area;

wherein the right-side decoupling region comprises a front side and a back side;

wherein each one of the front side and the back side of the right-side decoupling region comprises fabric knitted as expanding or shrinking accordion component that comprises a single panel comprising one or more stitch lines which run across said single panel to form a plurality of panels, and is confined by the following borders:

(A) a first line (251-252) defined between a first point (251) and a second point (252);

wherein the first point (251) is located between a neck area of the shirt and a shoulder-arm connection area of the shirt;

wherein the second point (252) is located (i) between said shoulder-arm connection area and a top portion of an arm region of the shirt, and (ii) below said shoulder-arm connection area of the shirt;

(B) a second line (252-253) connecting the second point (252) to a third point (253), wherein the third point (253) is located at the bottom side of the right-side sleeve 201, wherein the third point (253) is located at the top-third of the bottom side of the right-side sleeve;

wherein the third point (253) is located between: (a) a fourth point (254) that is located under a right armpit region of the shirt, and (b) a fifth point (255) that is the lowest point of the right-side sleeve;

wherein the third point (253) is closer to the fourth point (254) than to the fifth point (255);

(C) a third line connecting the third point (253) and the fourth point (254);

(D) a fourth line (254-256) connecting the fourth point (254) downwardly to a sixth point (256), wherein the sixth point (256) is located along the right-side contour or the shirt, wherein a distance between the fourth point (254) and the sixth point (256) is equal-or-greater than a distance between the second point (252) and the third point (253);

(E) a fifth, curved line (256-251) connecting the sixth point (256) and the first point (251).

2. The shirt of claim 1, wherein the right-side decoupling region and the left-side decoupling region are formed of fabric having a first type of thread knitting; wherein the right-side sleeve, the left-side sleeve, the front area and the back area are formed of fabric having a second, different, type of thread knitting.

3. The shirt of claim 1, wherein the right-side decoupling region and the left-side decoupling region are formed of shear-and-opaque fabric; wherein the right-side sleeve, the left-side sleeve, the front area and the back area are formed of non shear-and-opaque fabric.

4. The shirt of claim 1, wherein the right-side decoupling region and the left-side decoupling region are formed of shear-and-opaque fabric and comprises: a primary yarn having a first thread-count and a first elasticity value; and a secondary yarn that has a second, increased thread-count and a second, increased elasticity value.

5. The shirt of claim 1, wherein the right-side decoupling region comprises: said front side and said back side, wherein an area of the front side of the right-side decoupling region is generally identical to an area of the back side of the right-side decoupling region; wherein the left-side decoupling region comprises: a front side and a back side, wherein an area of the front side of the left-side decoupling region is generally identical to an area of the back side of the left-side decoupling region.

6. The shirt of claim 1, wherein the right-side decoupling region comprises: said front side and said back side, wherein an area of the front side of the right-side decoupling region is smaller than an area of the back side of the right-side decoupling region; wherein the left-side decoupling region comprises: a front side and a back side, wherein an area of the front side of the left-side decoupling region is smaller than an area of the back side of the left-side decoupling region.

7. The shirt of claim 1, wherein the right-side decoupling region comprises: said front side and said back side, wherein an area of the front side of the right-side decoupling region is greater than an area of the back side of the right-side decoupling region; wherein the left-side decoupling region comprises: a front side and a back side, wherein an area of the front side of the left-side decoupling region is greater than an area of the back side of the left-side decoupling region.

8. The shirt of claim 1, wherein the right-side decoupling region and the left-side decoupling region are formed of fabric that is knitted as accordion component which expands or shrinks in response to movement of the wearer.

9. The shirt of claim 1, wherein the right-side decoupling region is formed of fabric that is knitted as accordion component such that an area of the right-side decoupling region expands or shrinks in response to movement of the wearer;

wherein the left-side decoupling region is formed of fabric that is knitted as accordion component such that an area of the left-side decoupling region expands or shrinks in response to movement of the wearer.

10. The shirt of claim 1, wherein an area of the front side of the right-side decoupling region is in a range of 10 to 33 percent relative to the area of the back side of the right-side decoupling region.

11. The shirt of claim 1, wherein the area of the front side of the right-side decoupling region is in a range of 25 to 50 percent relative to the area of the back side of the right-side decoupling region.

12. The shirt of claim 1, wherein the right side decoupling region comprises said front side and said back side;

wherein a width east-to-west of the front side of the right-side decoupling region is in a range of 25 to 50 percent relative to a width east-to-west of the back side of the right-side decoupling region.

* * * * *